US006471428B2

(12) United States Patent
Iwasaki et al.

(10) Patent No.: US 6,471,428 B2
(45) **Date of Patent: *Oct. 29, 2002**

(54) FEEDING APPARATUS, PRINTING APPARATUS AND FEEDING CONTROL METHOD

(75) Inventors: Takeshi Iwasaki, Yokohama (JP); Koh Hasegawa, Yokohama (JP); Shinya Asano, Tokyo (JP); Hiroyuki Inoue, Yokohama (JP); Takashi Nojima, Tokyo (JP); Akira Kida, Kawasaki (JP); Noriko Kawasaki, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/290,262

(22) Filed: Apr. 13, 1999

(65) Prior Publication Data

US 2002/0003982 A1 Jan. 10, 2002

(30) Foreign Application Priority Data

Apr. 15, 1998 (JP) ..... 10-121832
Apr. 15, 1998 (JP) ..... 10-121833

(51) Int. Cl.[7] ..... B41J 11/44
(52) U.S. Cl. ..... 400/582; 400/578
(58) Field of Search ..... 400/582, 578

(56) References Cited

U.S. PATENT DOCUMENTS 5,312,196 A * 5/1994 Hock et al. ..... 400/624
5,451,039 A * 9/1995 Adachi ..... 271/9.6
5,480,247 A 1/1996 Saikawa et al.
5,542,487 A * 8/1996 Schultz et al. ..... 178/4.1 A
5,797,080 A 8/1998 Okamoto
5,831,656 A * 11/1998 Chosa ..... 347/108
5,847,729 A 12/1998 Takahashi et al.
5,850,243 A * 12/1998 Kinoshita et al. ..... 347/108
6,076,911 A 6/2000 Watanabe
6,200,043 B1 * 3/2001 Inoue et al. ..... 400/88

FOREIGN PATENT DOCUMENTS

| | | |
|---|---|---|
| EP | 0 492 638 | 7/1992 |
| EP | 0 659 568 | 6/1995 |
| JP | 4-303336 | 10/1992 |
| JP | 9-194085 | 7/1997 |

* cited by examiner

*Primary Examiner*—Andrew H. Hirshfeld
*Assistant Examiner*—Charles H. Nolan, Jr.
(74) *Attorney, Agent, or Firm*—Fitzpatrick, Cella, Harper & Scinto

(57) ABSTRACT

A feeding apparatus, a printing apparatus and a feeding control method can simplify control software significantly on a printing apparatus side and can provide freedom of design in the feeding apparatus. A communication port is provided for communication between the feeding apparatus and the printer. The feeding apparatus performs paper feeding operation after receiving a paper feeding command from the printer. When a sheet is fed in the printer, a feeding operation completion signal is transmitted to the printer. On the other hand, rotation of a feeding roller is resumed at a slightly earlier timing than a rotation start timing of a transporting roller. Therefore, back tension on the sheet by the feeding roller is minimized, and positioning the top of the sheet by the transporting roller is enhanced reliably.

44 Claims, 37 Drawing Sheets

〔INTIALIZATION FLOW C3 OF ASF〕

〔KIND JUDGMENT FLOW C1 OF PRINTER〕

DRIVE TABLE T

| T | PAPER KIND | DRIVE SPEED FOR REGISTRATION | PULSE NUMBER P5 FOR REGISTRATION |
|---|---|---|---|
| T1 | PLAIN PAPER | MEDIUM SPEED | SMALL |
| T2 | POSTCARD | MEDIUM SPEED | LARGE(P5=Pmax-Pc) |
| T3 | ENVELOPE | LOW SPEED | MEDIUM |
| T4 | GLOSSY PAPER | LOW SPEED | SMALL |
| T5 | NONE SPECIFIED | MEDIUM SPEED | LARGE(P5=Pmax-Pc) |

*FIG.38*

FEEDING APPARATUS, PRINTING APPARATUS AND FEEDING CONTROL METHOD

This application is based on Patent Application Nos. 121832/1998 and 121833/1998 both filed on Apr. 15, 1998 in Japan and the content of which is incorporated hereinto by reference.

BACKGROUND OF THE INVENTION

1. Field of the Invention

The present invention relates to a feeding apparatus and a printing apparatus which can be coupled with each other, and a feeding control method. More particularly, the invention relates to a feeding apparatus and a feeding control method for feeding a printing medium, such as a paper or the like, to a printing apparatus, and a printing apparatus for printing information, such as a document, graphic image and so on processed by an information processing system, on a printing medium, such as a paper or the like.

In the present invention, a feeding apparatus and a feeding control method perform feeding of a printing medium automatically in accordance with a command from a printing apparatus to which the feeding apparatus is connected. Therefore, they are also called an automatic feeding apparatus and an automatic feeding control method.

2. Description of the Related Art

Demand in the market for downsizing and weight lightening for a printer as a printing apparatus has been growing similarly to other various devices. For satisfying such demand, downsizing and weight lightening in the printer have progressed significantly. Seeking downsizing of the printer, there has been proposed a printer, in which a main body portion of the printer performing image printing and an automatic sheet feeder (hereinafter referred to as "ASF") portion for feeding a plurality of stacked sheets as printing media to an image forming portion one by one are separated, as disclosed in Japanese Patent Application Laid-open No. 4-303336 (1992). Namely, the ASF portion is made independent of the main body of the printer for external attachment. On the other hand, not only in the small size printer, but also in a printer having a plurality of paper feeding openings or a printer permitting only manual paper feeding, there has been conventionally known of ASFs which can be externally installed. It should be noted that various media in addition to paper are included as the printing media.

In the ASF disclosed in Japanese Patent Application Laid-open No. 4-303336, namely, in the ASF to be externally installed on the printer, a drive system of a feeding roller feeding a sheet one by one is constructed. The drive system is constructed by coupling driving power transmission means, such as a gear exposed outside of the ASF, and driving power transmission means exposed outside of a printer body. And, a driving force, such as a motor within the printer body, is used as the driving force of the feeding roller. In such driving method, since it becomes unnecessary to independently provide a driving source, such as a motor or the like and an electric source on the side of the ASF, the ASF can be constructed at low cost and light weight. However, on the other hand, for limitation of freedom of mechanical components arrangement in the ASF, it is not always possible to set optimal position for the ASF for downsizing and stability of performance.

On the other hand, for example, as disclosed in Japanese Patent Application Laid-open No. 9-194085 (1997), there has been proposed the ASF incorporating a motor as a driving source of the feeder roller for external installation. In this case, freedom of the mechanical components arrangement is increased to permit arrangement of the parts of the paper feeding mechanism independent of the construction of the printer body. Upon making the ASF perform paper feeding operation, through electrical contacts provided on a mating portion between the printer body and the ASF, a controller provided within the printer body applies an electrical signal to the motor for driving the paper feeder roller for driving the latter.

However, a sheet, on which an image is printed by the printer, is not limited to a plain paper, but can be of wide variety of size and thickness, such as a postcard, cardboard, envelope and so on. On the other hand, due to progress of printing technology in printers, such as that of an inkjet type and so on, more fine ink droplet or high and low density ink droplets can be ejected to permit formation of a high quality image with higher definition and superior tone reproducibility. For making high image quality effective depending upon purpose, special sheets, such as a coated paper, a glossy paper, a glossy film, an OHP film, a cloth, an iron transfer paper and so on have been developed.

In the ASF which can be installed in the printer, there has been required a performance for certainly feeding various kinds of sheets without causing any problem. However, the sheets as the printing medium should differentiate optical feeding conditions depending upon thickness, sizes or surface characteristics thereof.

Since the conventional ASF, which can be installed on the printer as set forth above, has no feeding operation control means for driving the feeding roller by driving the motor, control of the paper feeding operation by the ASF is performed by the printer. Therefore, control means within the printer is required to have feeding operation control function having feeding conditions adapted to various sheets. Therefore, in addition to control for the printer body, the necessity set forth above makes control software large and complicated.

On the other hand, in some printer bodies, it is required to use an external ASF dedicated for postcard feeding, an external ASF for continuous sheet feeding and so on in addition to the normal external ASF, or to use a new type and improved type of external ASF. If feeding operation control of the ASF is different even in part, the printer body has to have control functions for all of the feeding operation. Therefore, software in the printer body becomes further complicated, or in worse case, modification of the software becomes necessary, and a problem in compatibility is possibly caused. On the other hand, a large number of printer bodies are in the market so that modification of the software on the side of the printer body is substantially impossible. In the alternative, upon providing a new external ASF, it is required that paper feeding can be performed without causing any problem by the existing control function for the feeding operation which has been provided in the printer. Therefore, designing freedom of ASF is restricted significantly.

On the other hand, the ASF, such as that disclosed in Japanese Patent Application Laid-open No. 4-303336, is generally constructed with a pressure plate, on which sheets are stacked, a paper feeding roller for feeding sheets as the printing media stacked on the pressure plate one by one, a paper transporting roller and a pinch roller for pinching and transporting the sheets fed from the feeding roller. As the printing medium, in addition to paper, various other media should be included. In the sheet feeding operation, at first, the feeding roller on the upstream side in a transporting direction is driven for rotation, so that the sheet is fed. Thus the tip end of the sheet abuts with a nip portion formed by the transporting roller and the pinch roller on the downstream side in the transporting direction. Subsequently, the sheet is forced into the nip portion by further rotating the feeding roller to perform registration. Thereafter, by driving the transporting roller, the sheet is transported to be fed into a printing portion of the printing apparatus.

On the other hand, in so-called positioning top of sheet, by rotation of the transporting roller, the transporting roller grips the tip end portion of the sheet abutted to the nip portion. Upon such positioning top of sheet, when the feeding roller is in pressure contact with the rear end portion of the sheet, significant back tension should be exerted on the sheet on the downstream side in the transporting direction, so that precision of positioning top of the sheet is degraded. In order to prevent this, an arc-shaped roller is used as the feeding roller, or a construction to forcedly release depression of the pressure plate onto the feeding roller by means of a cam or so on can be employed. By such construction, when the feeding roller is in a particular rotational phase, load is not applied to the sheet. In this case, upon positioning top of the sheet, it is frequently performed to drive both of the transporting roller and the feeding roller so as not to exert the back tension on the sheet by the feeding roller.

However, in the conventional ASF as set forth above, problems are still caused as follows.

Namely, in the conventional ASF, upon positioning top of sheet, driving of the transporting roller and the feeding roller are initiated simultaneously. However, in practice, due to factor of backlash of the gears, delay in transmission of driving force, the rotation start timing of the paper feeding roller on the upstream side in the transporting direction can be slightly delayed from the rotation start timing of the transporting roller on the downstream side in the transporting direction. In this case, the feeding roller should exert back tension to the sheet. As a result, upon positioning top of the sheet, precision of feeding can be disturbed to affect precision of the print start position. On the other hand, when a common motor is used for driving the transporting roller and the feeding roller, it is possible that reduction ratios of the transporting roller and the feeding roller cannot be the same due to restriction of arrangement of the components. As a result, if the peripheral speed of the feeding roller is lower than the peripheral speed of the transporting roller, back tension can be exerted on the sheet. Therefore, upon positioning top of the sheet, adverse influence for precision of the print start position is caused due to disturbance of precision of sheet feeding. Conversely, if the peripheral speed of the feeding roller is higher than the peripheral speed of the transporting roller, bending of the sheet can be caused due to difference in speed of the rollers.

SUMMARY OF THE INVENTION

It is an object of the present invention to provide a feeding apparatus, a printing apparatus and a feeding control method, which can significantly simplify a control software on a side of the printing apparatus and can acquire designing freedom of the feeding apparatus.

Another object of the present invention is to provide a feeding apparatus, a printing apparatus and a feeding control method, which can certainly stabilize precision of feeding of a printing medium and can be more reliable.

In a first aspect of the present invention, there is provided a feeding apparatus which is installed to a printing apparatus printing an image on a printing medium and can feed the printing medium to the printing apparatus comprising:

a communication port for communicating with the printing apparatus; and control means for executing a process depending upon a command signal received from the printing apparatus through the communication port and transmitting a response signal depending upon a result of the process to the printing apparatus through the communication port.

In a second aspect of the present invention, there is provided a printing apparatus installed to a feeding apparatus and printing an image on a printing medium comprising:

a communication port for communicating with the feeding apparatus; and control means for transmitting a command signal to the feeding apparatus through the communication port, for receiving a response signal responsive to the command signal from the feeding apparatus through the communication port, and for performing control depending upon the response signal.

In a third aspect of the present invention, there is provided a feeding control method feeding a printing medium from a feeding apparatus installed to a printing apparatus, and controlling printing of an image on the printing medium by a printing head of the printing apparatus, comprising:

step of transmitting a command signal to the feeding apparatus through a communication port for communicating with the feeding apparatus;

step of executing a process depending upon the command signal received from the printing apparatus through the communication port and transmitting a response signal depending upon a result of the process through the communication port; and step of performing a control depending upon the response signal received from the feeding apparatus through the communication port.

In a fourth aspect of the present invention, there is provided a feeding apparatus which is installed to a printing apparatus having a transporting roller for transporting a printing medium in a predetermined transporting direction and printing an image on the printing medium, and the feeding apparatus can feed the printing medium to the printing apparatus comprising:

stacking means for stacking the printing medium;

a feeding roller for feeding the printing medium stacked on the stacking means toward a transportation start position for the transporting roller; and control means for demanding that the printing apparatus perform transportation of the printing medium by the transporting roller, when a predetermined delay period from initiation of feeding the printing medium by the feeding roller in a transporting direction in which the printing medium is transported by the transporting roller is passed, after feeding the printing medium to the transportation start portion by the transporting roller.

In a fifth aspect of the present invention, there is provided a printing apparatus printing an image on a printing medium by using a printing head, the printing medium being fed by a feeding roller, comprising:

a transporting roller for transporting the printing medium in a predetermined transporting direction; and control means for transporting the printing medium by the transporting roller, when a predetermined delay period from initiation of feeding the printing medium by the feeding roller in a transporting direction in which the printing medium is transported by the transporting roller is passed, after feeding the printing medium to the transportation start portion by the transporting roller.

In a sixth aspect of the present invention, there is provided a printing apparatus installed to a feeding apparatus feeding a printing medium to a predetermined feeding direction by a feeding roller, the printing medium being fed from the feeding apparatus to the printing apparatus, the printing apparatus printing an image on the printing medium by using a printing head, comprising:

a transporting roller for transporting the printing medium fed from the feeding apparatus in a predetermined transporting direction; and control means for transporting the printing medium by the transporting roller, when a predetermined delay period from initiation of feeding the printing medium by the feeding roller in a transporting direction in which the printing medium is transported by the transporting roller is passed, after feeding the printing medium to the transportation start portion by the transporting roller.

In a seventh aspect of the present invention, there is provided a feeding control method for transporting a printing medium fed by a feeding roller, in a predetermined transporting direction by a transporting roller, comprising a step of:

transporting the printing medium by the transporting roller, when a predetermined delay period from initiation of feeding the printing medium by the feeding roller in a transporting direction in which the printing medium is transported by the transporting roller is passed, after feeding the printing medium to the transportation start portion by the transporting roller.

According to the present invention, the feeding apparatus can perform a part of control of control means incorporated in the conventional printing apparatus so that significant simplification of the control program on the side of the printing apparatus is permitted.

For example, when the control means of the external feeding apparatus has an optimal feeding operation control program corresponding to various media, the printing apparatus completes feeding operation simply by transmitting a feeding command signal to the external feeding apparatus and receiving the feeding completion signal from the external feeding apparatus. Therefore, it becomes unnecessary to provide feeding operation control programs adapted to various printing media in the printing apparatus. Accordingly, the control software in the printing apparatus can be simplified significantly.

On the other hand, for example, if an external feeding apparatus dedicated for postcard, an external feeding apparatus dedicated for continuos sheet or an external feeding apparatus which will be developed in the future have the feeding operation control program similar to that of the external feeding apparatus of the present invention, the printing apparatus may complete feeding operation simply by transmitting a feeding command signal to the external feeding apparatus and receiving the feeding completion signal from the external feeding apparatus. Therefore, another feeding apparatus or new external feeding apparatus may be used easily.

Furthermore, for example, as long as another feeding apparatus is set at the position of the communication port at a position for establishing communication with the printing apparatus, arrangement freedom of other components is not limited. Therefore, high freedom in designing can be provided upon designing the new type or improved type feeding apparatus.

On the other hand, the external feeding apparatus according to the present invention can read the result of detection of the feeding detection sensor within the printing apparatus via the communication port. By this, on the side of the feeding apparatus, a sensor detecting the printing medium becomes unnecessary to contribute for lowering cost. Furthermore, by arranging the feeding detection sensor within the printing apparatus in the vicinity of the feeding roller, the printing medium can be fed into the printing apparatus at higher precision. On the other hand, by directly reading whether the feeding detection sensor detects the printing medium or not through the communication port not via the control portion of the printing apparatus, it becomes unnecessary to repeat communication with the printing apparatus to eliminate time loss. Accordingly, as compared with a case in which the feeding apparatus does not have the detection sensor for the printing medium, feeding operation can be performed at a completely comparable period.

On the other hand, by supplying a power for driving the feeding apparatus control portion or the feeding motor from the printing apparatus through the communication port, the feeding apparatus does not need to have the electric source. Therefore, with respect to the feeding apparatus, downsizing, space-saving, reducing of weight, cost-down or improvement of handling ability in cordless construction is contributed.

Furthermore, by the present invention, rotation of the feeding roller is started at slightly earlier timing than starting of rotation of the transporting roller. Therefore, upon initiation of rotation of the transporting roller, the feeding roller will not exert back tension on the printing medium.

On the other hand, by separately providing motors for independently driving the transporting roller and the feeding roller, the peripheral speeds of these rollers can be varied freely. Therefore, if the transporting roller and the feeding roller are driven for rotation simultaneously, the appropriate peripheral speed, at which disturbance of precision in feeding can be minimum, can be set.

Thus, upon positioning top of the printing medium by the transporting roller, precision in feeding can be certainly stabilized to provide more reliable feeding apparatus, feeding control method and the printing apparatus.

On the other hand, as another effect by providing the motors for driving the transporting roller and the feeding roller independently, the portion including the transporting roller and its driving motor are provided on the side of the printing apparatus and the portion including the feeding roller and its driving motor are provided on the side of the feeding apparatus. As a result, the printing apparatus superior in portability and the external feeding apparatus superior in operability can be realized.

The above and other objects, effects, features and advantages of the present invention will become more apparent from the following description of embodiments thereof taken in conjunction with the accompanying drawings.

BRIEF DESCRIPTION OF THE DRAWINGS

FIG. 38 is an explanatory illustration of a drive table of the automatic feeding apparatus in the second embodiment of the present invention.

DETAILED DESCRIPTION OF THE PREFERRED EMBODIMENT

The preferred embodiment of the present invention will be described hereinafter in detail with reference to the accompanying drawings.

Figure 1:
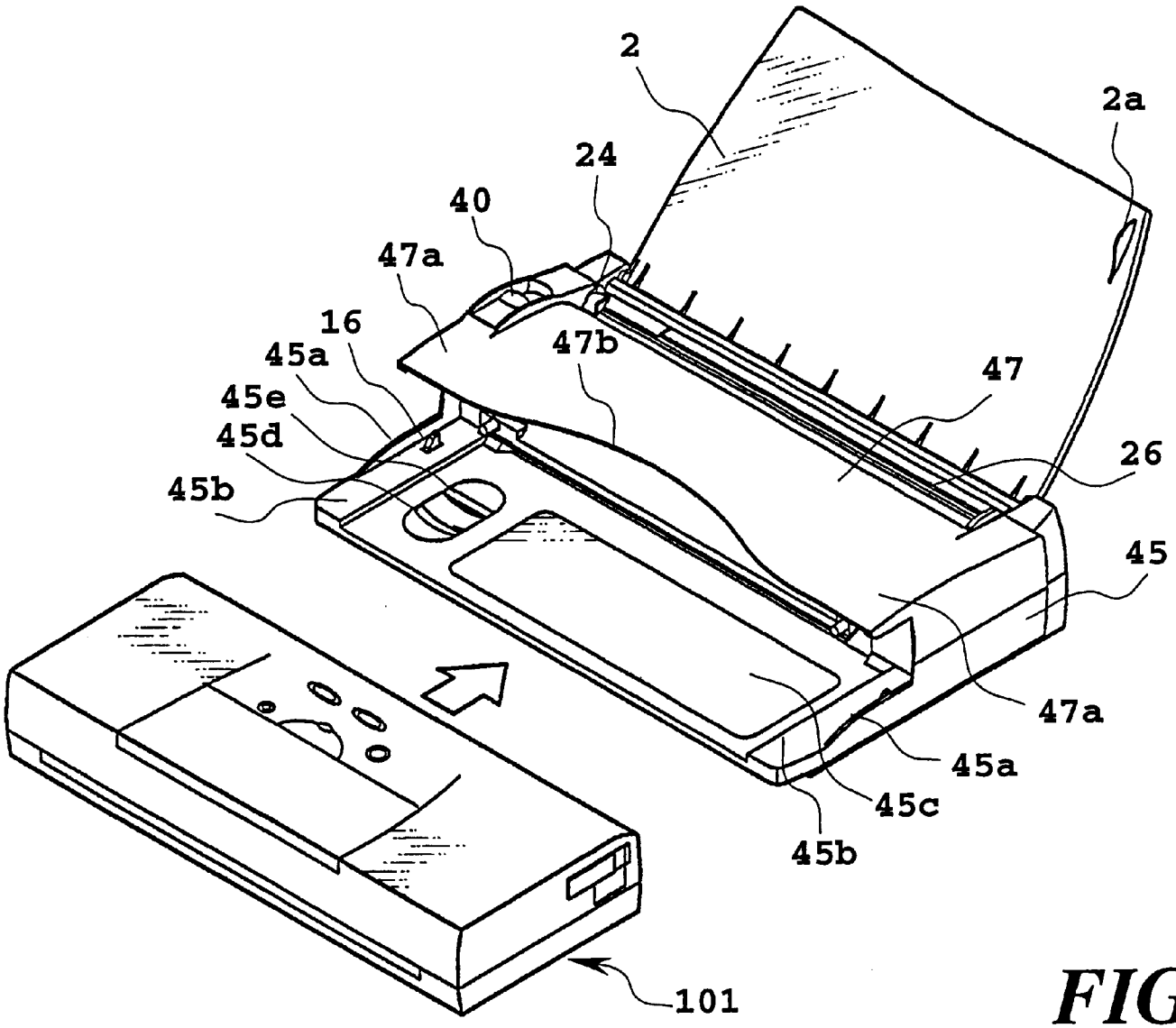
FIG. 1 is a perspective view of the first embodiment of a printing apparatus and an automatic feeding apparatus according to the present invention, illustrated in a separated condition.
Figure 2:
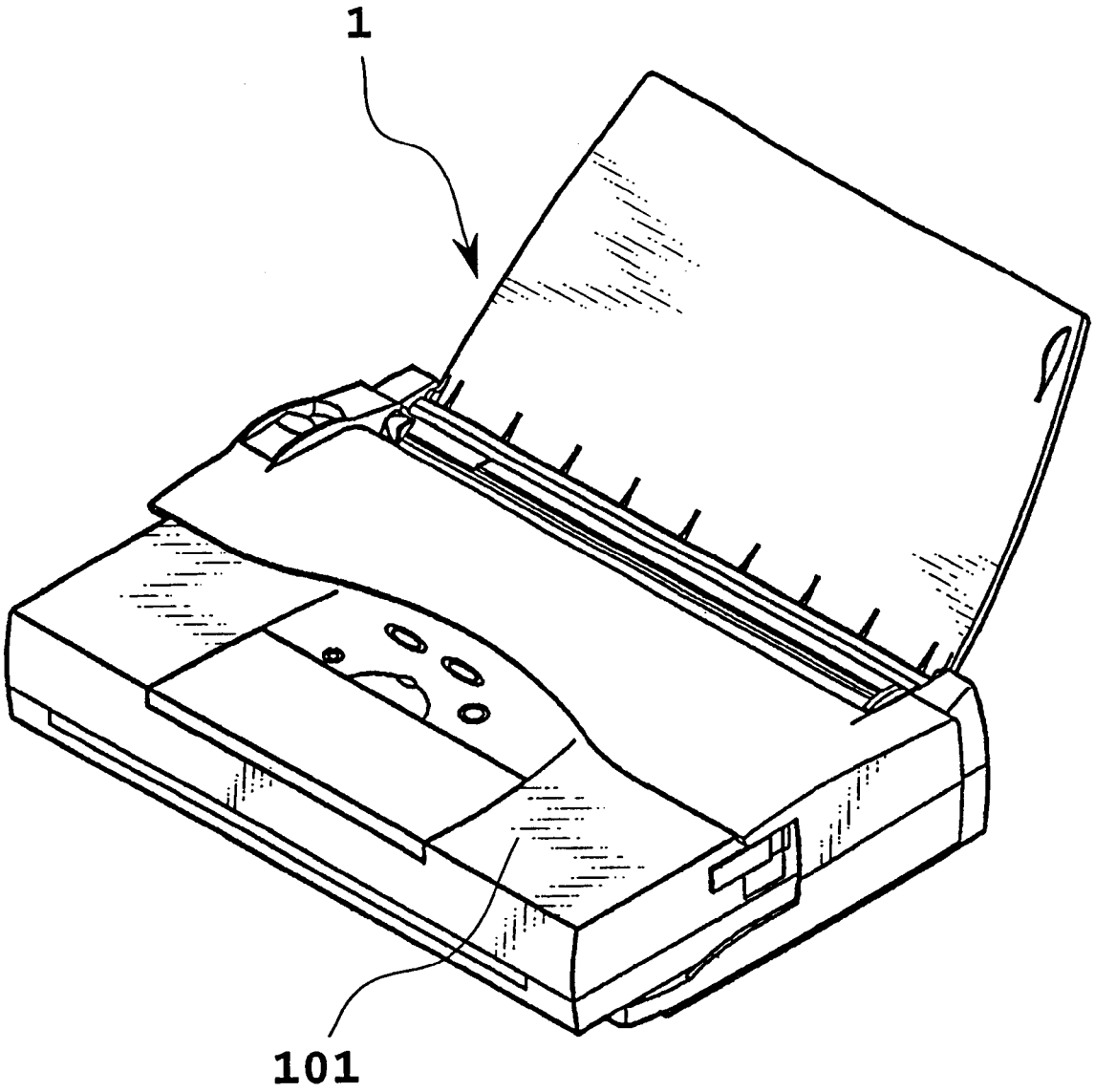
FIG. 2 is a perspective view of the first embodiment of a printing apparatus and an automatic feeding apparatus according to the present invention, illustrated in an assembled condition.
Figure 3:
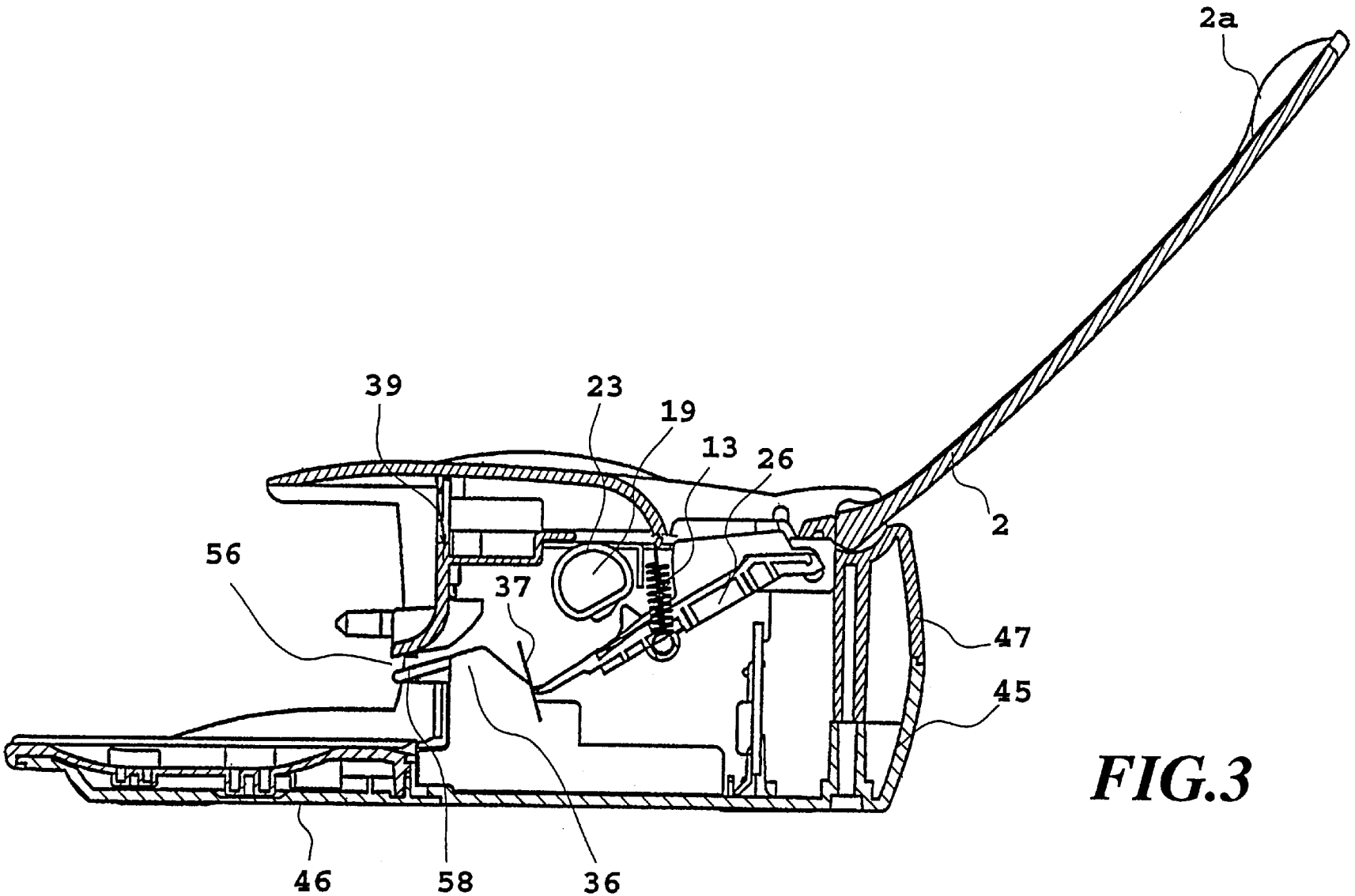
FIG. 3 is a section in the first embodiment of the automatic feeding apparatus according to the present invention.
Figure 4:
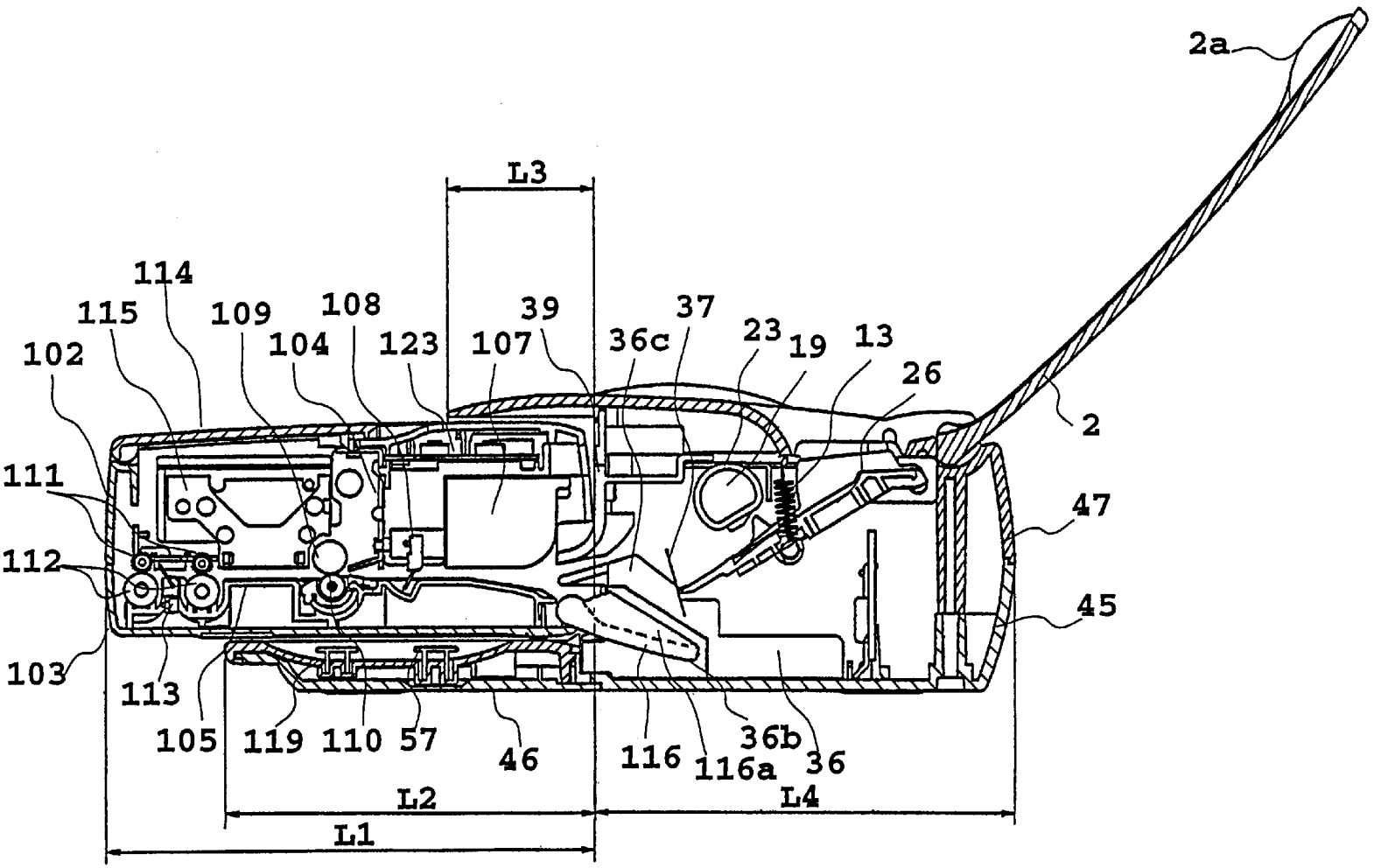
FIG. 4 is a section of the first embodiment of the printing apparatus and the automatic feeding apparatus according to the present invention, illustrated in the assembled condition.

FIGS. 1 and 2 are perspective views showing a first embodiment of an automatic sheet feeder (hereinafter referred to as "ASF") as an automatic feeding apparatus, and a printing apparatus performing printing on a printing paper as a printing medium automatically fed by the ASF. FIG. 3 is a section of the printing apparatus, and FIG. 4 is a section of a printing apparatus and the ASF.

(Concerning Construction of ASF)

At first, the ASF as the automatic feeding apparatus will be briefly explained with reference to FIGS. 1 to 4. The reference numeral 1 denotes an ASF and 101 denotes a printer as a printing apparatus. In the shown embodiment, the ASF 1 and the printer 101 are constructed independently. The 11 printer 101 is constructed to be releasably installed to and from the ASF 1. The printer 101 has a battery and is a so-called mobile printer which is compact and portable. In the shown embodiment, the printer 101 is not built in the ASF. As a sole unit of the printer 101, the printer is constructed to perform paper feeding only by manual paper feeding. By the construction set forth above, downsizing, simplification and cost down of the sole unit of the printer 101 can be realized to have an optimal form as a mobile printer. Needless to say, the present invention is applicable even in the case where a compact ASF is built in the printer 101. As a situation where such compact and portable printer 101 is used, outdoors, within a vehicle, a customer's office when a salesman visits the customer's office, and so forth can be considered. In such situation, since the number of necessary pages to be printed is relatively small, no inconvenience will be caused even with only manual feeding or simply using an ASF having small capacity. When such printer is used in one's own office, there is a need to perform printing with relatively large amount of printing paper as wide variety of printing media. For such need, ASF 1 separated from the printer 101 is quite preferable. Namely, ASF 1 is in a form of so-called desktop type to be constantly kept on a desk in the office. By installing the printer 101 to such ASF 1, the printer 101 may perform as a desktop printer. With the construction explained later, the ASF 1 can automatically feed various printing media (hereinafter also referred to as "printing medium"), such as postcard, envelope, plastic film, cloth or so on as well as a plain paper.

The shown embodiment can provide a printer having quite high added value, in which the ultra compact mobile printer 101 as a sole unit of the printer is used as a high performance desktop printer by installing the ASF 1. In this case, the ASF 1 also serves as a storage plate for the printer 101 while the printer 101 is not used as the sole and independent unit. Accordingly, when the printer 101 is received within the ASF 1, automatic paper feeding function is added to the printer 101. Thus, the ASF 1 serves as docking station. Here, the ASF serves as stable stand-alone unit when the printer is not installed, and can be separated from the printer in a condition where sheets as the printing medium are stacked. By simply installing the printer to the self-supported ASF, the user may place the printer in operation stand-by state as the desktop printer. For the user, the ASF can serve as a docking station which is quite useful.

When the foregoing printer is properly used as a mobile printer and the desktop printer, it is quite important to quite simply and easily perform installing and separating operation between the ASF 1 and the printer 101. The reason is that, for the user who separates the printer 101 from the ASF 1 and carries it out of the office almost every day and assembles the printer 101 to the ASF 1 when carried back to the office, it is quite troublesome if installation and separating operation is complicated and takes a long time.

In the shown embodiment, as shown in FIG. 3, a large opening portion is provided in a front side (left side in FIG. 3) of the ASF 1. This front opening portion serves as receptacle portion of the printer 101. In the printer 101, a passage of the sheet as the printing medium is so-called horizontal path extending in substantially horizontal direction. A sheet supply side at a rear side of the printer 101 is shifted in substantially horizontal direction toward the ASF 1 as shown in FIG. 1. Then, the sheet supply side is pushed into the front opening portion of the ASF 1 as shown in FIG. 2 to form the paper path which will be explained later. Namely, the shown embodiment is constructed to install the printer 101 having the horizontal path by pushing the same into the ASF 1 in substantially horizontal direction. When the printer 101 is pushed into the ASF 1 in substantially horizontal direction, the printer 101 is automatically fixed within the ASF 1. A method for fixing the printer 101 within the ASF 1 when the printer is assembled within the ASF 1 will be explained later.

On the other hand, upon separating the printer 101 from the ASF 1, fixing of the printer 101 within the ASF 1 can be released, and the ASF 1 is pushed frontwardly simply by pushing a push lever 40 which is provided in an upper face of the ASF 1.

With the construction set forth above, the user may quite easily and simply install and separate the printer 101 and the ASF 1. Thus, the printer may be properly used as the mobile printer and the desktop printer.

In the shown embodiment, in order to simplify and facilitate operation for installing and separating the ASF 1 and the printer 101, a table portion 45*c* is provided on the front side of the ASF 1. Upon installing the printer 101 into the ASF 1, the printer 101 is first placed on the table portion 45*c*. At this time, the user is merely required to grip the upper and lower faces in the vicinity of center portion on the proximal side (paper discharge side: left side of FIG. 4) of the printer 101 by one hand, and to place the distal side (paper feeding side: right side in FIG. 4) of the printer 101 on the table portion 45*c* (right and left side portions of the printer 101 may be gripped by both hands). After placing the printer 101 on the table portion 45*c*, the user may push the printer 101 toward the distal side. By this, the printer 101 is guided by printer side guide portions 45*a* provided on both side (right and left side) end portions of the table portion 45*c* to be led to a positioning boss which will be explained later, and positioned by engaging with a positioning bore which will be explained later. In this case, it is merely required to push the printer 101 after placing the printer 101 at substantially center portion of the table portion 45*c*. Thus, troublesome positioning becomes unnecessary.

The table portion 45*c* has printer slide portions 45*b* on both sides. These printer slide portions 45*b* are portions to slidingly contact with back surface of the printer 101 when the printer 101 is pushed into the ASF 1. A portion between the printer slide portions 45*b* on both sides is a stepped down portion. In the stepped down portion, the printer 101 and the ASF 1 are not in contact. On the back surface of the printer 101, a plurality of rubber legs are provided. The rubber legs are used for frictionally restricting movement of the printer 101 by external force while the sole unit of the printer 101 is used by mounting on the desk or the like. When the printer 101 is installed within the ASF 1, if the rubber legs are assumed to be placed in contact with the table portion 45*c*, a force required for the user to push the printer 101 into the ASF 1 becomes large to cause difficulty in operation. Therefore, in order to prevent the rubber legs from contacting with the table portion 45*c*, the stepped down portion between the slide portions 45*b* is provided greater depth than the height of the rubber legs.

On the other hand, the reference numeral 47*a* denotes an overhang portion 47*a* formed in an upper case 47 of the ASF 1. The overhang portion 47*a* is formed substantially parallel to the table portion 45*c* and forms a pocket portion to receive the printer 101 therein. The pocket portion thus formed physically indicates to the user that a direction to push the printer 101 into the ASF 1 is substantially horizontal direction, and thus prevents the user from pushing the printer 101 into the ASF 1 in another direction. The pushing direction matches with a contact direction of both connectors which establish electrical connection between the printer 101 and the ASF 1. During operation for setting by pushing the printer 101 into the ASF 1, electrical connection is established by the connectors. Thus constructed, it becomes unnecessary to perform another operation for establishing electrical connection through the connectors for achieving high operability and avoids pushing of the printer 101 in the direction different from contact direction of the connectors for successfully preventing the connectors from being damaged due to abnormal interference between the connectors. Furthermore, the construction of such pocket portion may prevent a drawback that can be caused when a force upwardly deflects the front side (paper discharge side) of the installed printer 101, damaging the installing portion, and causing unwanted release of the installed printer 101. It should be noted the overhang portion 47*a* in the shown embodiment has the greatest overhang amount at both side portions. On the other hand, a center portion of the overhang portion 47*a* is a recessed overhang portion 47*b*. Accordingly, when an operating portion, such as a power switch and so on is provided on the upper face of the printer 101 as in the shown embodiment, the overhang portion 47*a* is formed into a shape so as not to cover the operating portion. By setting a clearance between the overhang portion 47*a* and the upper face of the printer 101 to an extent of about 0.5 mm to 2 mm, the lifting of the ASF 1 can be prevented successfully. If the clearance is excessively large, the desired effect cannot be obtained.

Here, as shown in FIG. 4, it is assumed that the length of the printer 101 in the back and forth direction is L1 (mm) and a length of the table portion 45*c* in the back and forth direction is L2 (mm), and the length of the overhang portion 47*a* is L3 (mm). Then, the following relationship is established.

$$L\tfrac{1}{2} \leqq L2 \leqq (L1-15)\ \text{mm}$$

At first, the length L2 in the back and forth direction of the table portion 45*c* is set to be greater than half (L½) of the length L1 of the printer 101 in the back and forth direction. Thus, the stable condition when the printer 101 is installed in the ASF 1 can be certainly maintained. Assuming that a relationship of L½>L2 is established, the printer 101 in the installed condition can be significantly projected from the ASF 1, in which the printer 101 is installed, quite unstable for causing lifting of the rear side of the overall ASF 1. It should be noted that it is required that the relationship (L½<L2) is established in a part of the table portion 45*c* and is not required to be established in the overall table portion 45*c*.

On the other hand, by setting L2 in the back and forth direction of the table portion 45*c* to be smaller in the extent less than or equal to 15 mm in comparison with L1 of the printer 101 in the back and forth direction, on the proximal side of the lower portion of the printer 101, a space to insert the user's finger can be certainly provided. By this, upon installation and separation of the printer 101, the user can perform operation with gripping the upper and lower faces of the printer 101 in one hand (of course, it is possible to grip the printer 101 with both hands). Such condition of L2≦(L1−15) mm is not required to be satisfied in the overall range in the width direction of the table portion 45*c*. For example, it is sufficient that a recessed portion satisfying the foregoing condition may be formed partially in the center portion or both side portions of the table portion 45*c*. On the other hand, since a space is formed in the lower portion of the proximal side of the printer 101, a design, by which a size in the height direction is visually not perceptible, can be obtained. On the other hand, a thickness (height) of the table portion 45*c* is desired to be greater than or equal to about 10 mm so as to facilitate insertion of the finger into the lower side of the printer 101.

Furthermore, in the shown embodiment, the following relationship is also established.

$$L\tfrac{1}{4} \leqq L3 \leqq L\tfrac{1}{2}$$

By setting the projecting length L3 of the overhang portion 47*a* to be greater than or equal to one fourth of L1 of the printer 101 in the back and forth direction, upward displacement of the printer 101 can be successfully prevented. Furthermore, it has been appreciated that the foregoing setting is also effective for limiting the inserting direction of the printer 101. Assuming that the projecting length L3 of the overhang portion 47*a* is greater than or equal to one half of L1 of the printer 101 in the back and forth direction, the pushing amount in installation of the printer 101 relative to the length thereon in the back and forth direction becomes relatively excessive to degrade operation feeling. On the other hand, excessively large projection amount of the overhang portion 47*a* should cause visual feeling that the overall apparatus is large to cause a drawback of giving an unwieldy feeling for the user. Furthermore, excessively large projection of the overhang portion 47*a* could cause interference with operation in the upper face of the printer 101. In this connection, it has been found that the projecting length of the overhang portion 47*a* is most desirable to be less than or equal to one half of the length of the printer 101 in the back and forth direction. With the projecting amount of such extent, sufficient strength of the projecting overhang portion 47*a* can be certainly maintained to achieve sufficient strength of the apparatus.

By forming the table portion 45*c* and the overhang portion 47*a* satisfying the conditions set forth above, a form which can achieve quite high operability, limiting effect in pushing the printer 101 into the ASF 1 and prevention of upward displacement of the printer 101, can be successfully obtained.

On the other hand, in a side face portion between the table portion 45*c* and the overhang portion 47*a*, a large opening portion is formed. A height of the printer side guide portion 45*a* is only required to be greater than or equal to a clearance between the overhang portion 47*a* and the upper face of the printer 101. The large opening portion formed in the side face portion will avoid interference in the case where a power cable, an interface connector or light emitting and receiving portion for infrared ray communication are provided on the side surface of the printer 101. Namely, the printer 101 may be installed in the ASF 1 in a condition where the power cable and/or interface connector is mounted on the printer 101. Also, the printer 101 may be separated from the ASF 1 with maintaining the power cable and/or interface connector as being mounted on the printer 101.

(Concerning Connector Cover)

Next, a connector cover of the connector portion, which establishes electrical connection between the printer 101 and the ASF 1 set forth above, will be described.

When the printer 101 is used for a long period in a condition separated from the ASF 1, the connectors for establishing electrical connection between the printer 101 and the ASF 1 are held independent of each other and not in the connected condition. In such case, dust and dirt may penetrate into the connector portion. Also, it is possible that excessively large electrostatic charge may propagate into the internal electric circuit through the connector to damage the electric circuit. In order to prevent this problem, the shown embodiment employs a connector cover for protecting each connector. The connector cover is an independent part and can be removed when the printer 101 is installed in the ASF 1. In case of super compact printer, such as the mobile printer, a space is quite strictly limited. As the connector cover which is quite cheap and of minimum space, the removable type connector cover set forth above is optimum.

Figure 6:
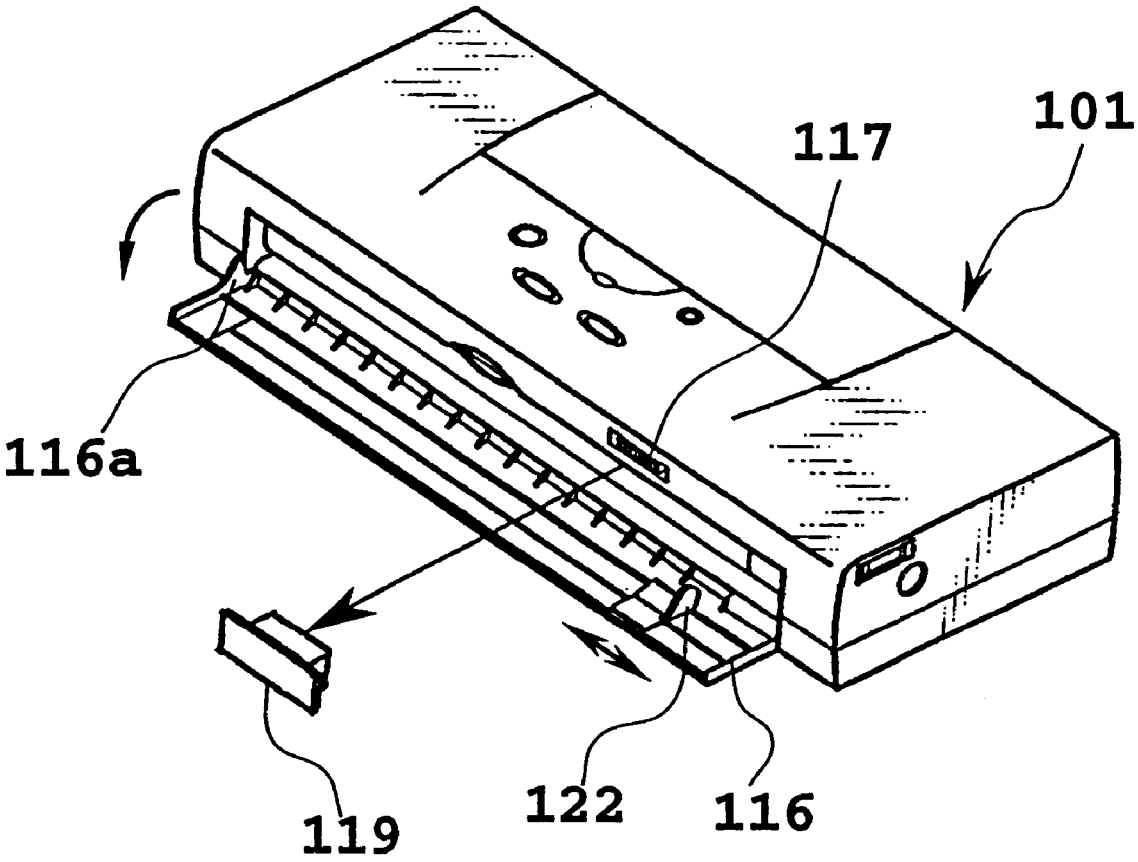
FIG. 6 is a perspective view of the first embodiment of the printing apparatus according to the present invention, upon opening of a paper feeding tray.

For example, the printer 101 has a printer connector 117 in an upper portion of a rear face mating with the ASF 1 as installed thereto. When the printer 101 is installed in the ASF 1, a paper feeder tray 116 is held in open condition as shown in FIG. 6 and a printer connector cover 119 is removed from the printer connector 117. Similarly, an ASF connector cover 57 engaged with an ASF connector 44 (see FIG. 11) on the side of ASF 1 is removed. Upon connecting these connectors, the removed connector covers 119 and 57 may be stored in connector cover receptacle portions 45*d* and 45*e* of the table portion 45*c*. These connector cover receptacle portions 45*d* and 45*e* are constructed to have projecting portions of dimensions equal to the connectors utilizing thickness of the table portion 45*c*. By storing the connector covers 119 and 57 in the connector cover receptacle portions 45*d* and 45*e* while the printer 101 is installed in the ASF 1, the connector covers 119 and 57 are prevented from being lost. For simply storing the connector covers 119 and 57 within the connector cover receptacle portions 45*d* and 45*e*, such connector cover receptacle portions 45*d* and 45*e* may be arranged at any position in the ASF 1 and the printer 101. However, by providing the connector cover receptacle portions 45*d* and 45*e* on the table portion 45*c*, the connector covers 119 and 57 are stored between the ASF 1 and the printer 101, and dropping the connector covers 119 and 57 can be successfully prevented. Furthermore, it is preferable to hide the connector covers 119 and 57 from external view. On the other hand, when the printer 101 is separated, the connector covers 119 and 57 are exposed again to encourage setting of these connector covers 119 and 57 to the connectors 117 and 44 to prevent forgetting of setting of the connector covers to the connectors.

In the shown embodiment, for respective ones of a plurality of connector covers, the connector cover receptacle portions can be provided. Concerning the connector covers, features similar to those used in the relationship between the printer and the ASF can be used in relationships like the notebook computer and station, for example.

(Brief Summary of Paper Feeding and Printing Operation)

Next, operation in paper feeding and printing in the condition where the printer 101 is installed in the ASF 1 will be explained (detail will be explained later).

Figure 25:
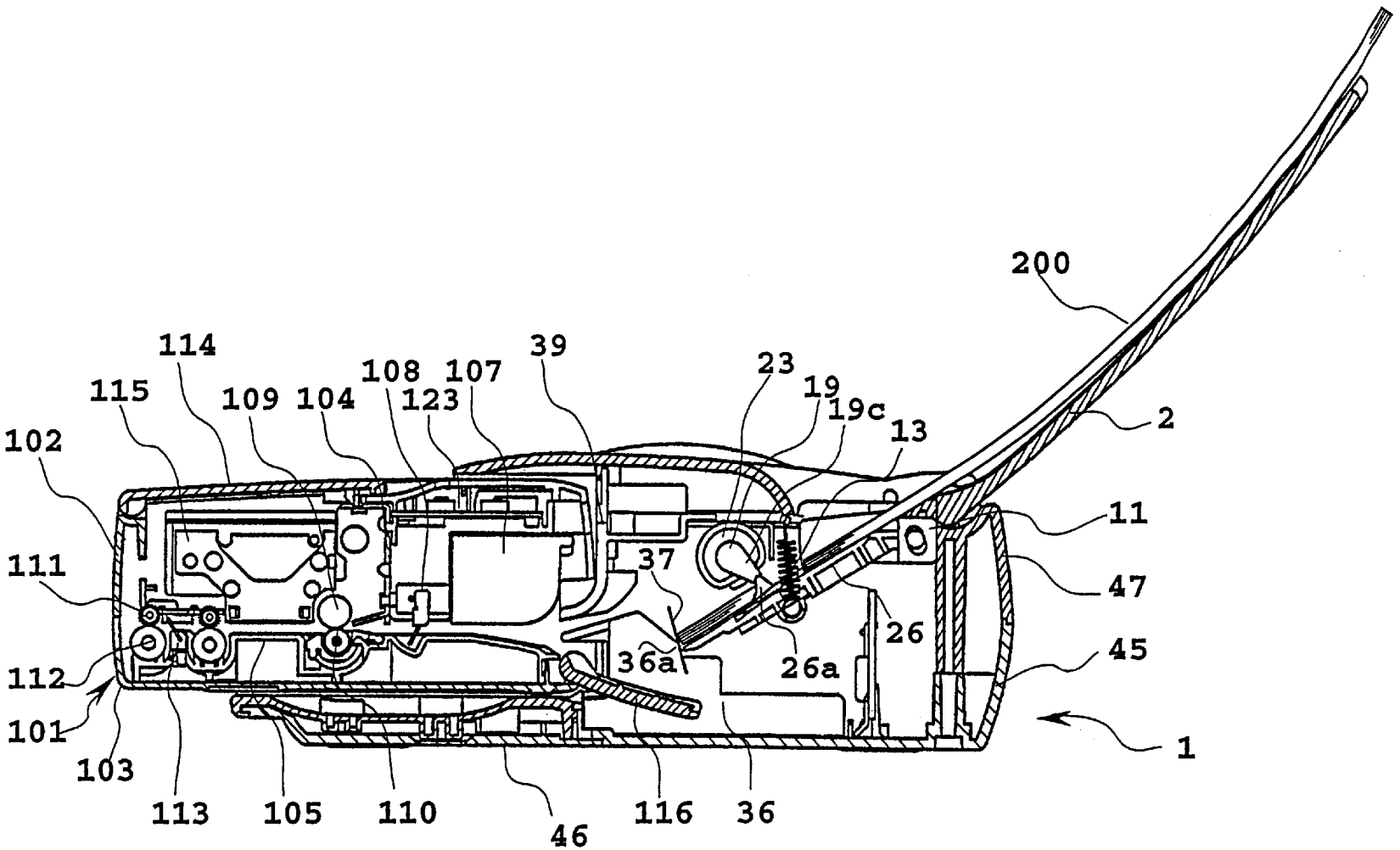
FIG. 25 is a section of the first embodiment of the printing apparatus and the automatic feeding apparatus according to the present invention, illustrated in the assembled condition.

FIG. 4 is a section of the condition where the printer 101 is installed in the ASF 1. On a pressure plate 26, a predetermined number of sheets 200 as the printing medium are set, as shown in FIG. 25. The pressure plate 26 is pivotably supported on an ASF chassis 11 at one end portion of an upper side. By means of a pressure plate spring 13, the pressure plate 26 is biased in clockwise direction toward a pick-up rubber 23 which is wrapped around a pick-up roller 19 as a feeding roller. Upon setting of the sheets 200, the pressure plate 26 is held in a position displaced away from the pick-up rubber 23 on the pick-up roller 19 as the feeding roller by a not shown cam. At this time, between the pick-up rubber 23 and the pressure plate 26, a predetermined clearance is formed. Within the clearance, the sheets 200 are inserted and set. Abutting the tip ends of the sheets 200 onto a plastic film form ridge sheet 37 provided on a ridge, the tip ends of the sheets 200 are positioned. Most of rear portion of the sheet 200 is supported by an ASF sheet feeding tray 2. The ASF sheet feeding tray 2 is pivotably supported on an ASF upper case 47 at one end portion of the lower side. Upon supporting the sheet 200, the ASF sheet feeding tray 2 is held with a predetermined angle, as shown in FIG. 4.

When the ASF 1 receives a sheet feeding instruction from the printer 101, the pick-up roller 19 initiates rotation in the clockwise direction. At the same time, holding of the pressure plate 26 is released by the not shown cam, and the pressure plate 26 causes pressure contact between the sheet 200 and the pick-up rubber 23. Then, the sheet 200 is started to move by surface friction of the pick-up rubber 23. Only one sheet 200 is separated from the rest of the sheets by the ridge sheet 37 to be transported into an ASF sheet path 58 (see FIG. 3) formed by the ridge 36 and a positioning base 39. Subsequently, the sheet 200 is transferred from an ASF sheet discharge portion 56 (see FIG. 3) to a sheet path of the printer 101. The sheet 200 is then transferred into the sheet path formed between a platen 105 and a lower surface of a battery 107 within the printer 101. The sheet path is so-called manual feeding opening while used as sole unit of the printer 101. Subsequently, by detecting the sheet by a paper end sensor 108, the printer 101 may recognize that the sheet 200 is fed thereinto from the ASF 1. Then, the tip end of the sheet 200 abuts onto a pressure contact portion between a transporting roller (hereinafter referred to as "LF roller") 109 and a pinch roller 110. The ASF 1 receives detection information of the paper end sensor 108 from the printer 101 and transmits a response signal indicative of completion of sheet feeding to the printer 101 at a predetermined timing. At this time, the sheet 200 is depressed between the LF roller 109 and the pinch roller 110 with a predetermined pressure depending upon stiffness of the sheet 200 for so-called registration of the tip end of the sheet. In this condition, the printer 101 receiving the response signal indicative of completion of sheet feeding from the ASF 1 drives the LF roller 109 to rotate at the predetermined timing to feed the sheet 200 to a printing portion. Associating with a predetermined feeding operation for the sheet 200, a printing head 115 performs printing onto a printing surface of the sheet 200. Furthermore, the sheet 200 is transported between a paper discharge roller 112 and a spur 111 and discharged.

In the shown embodiment, when the printer 101 is in a condition installed to the ASF 1, the paper path set forth above is constructed. Extending direction of the paper path in the printer 101 and connecting direction of the connectors 44 and 117 are substantially parallel to each other. If blocking of the sheet 200 is caused at any position while the sheet 200 is present over both of the ASF 1 and the printer 101 for transferring the sheet 200 from the ASF 1 to the printer 101, it becomes necessary to separate the printer 101 from ASF 1. Orienting the paper path substantially parallel to the connecting direction permits separation of the printer 101 and the ASF 1 in the case set forth above. Assuming that the paper path and the connecting direction of the connectors intersect perpendicularly relative to each other, since it becomes necessary to separate the printer 101 in the connecting direction of the connectors, it is necessary to move the sheet 200 in the thickness direction or so forth to possibly cause tearing of the sheet. In a worse case, the torn debris of the sheet 200 may reside within the apparatus. Furthermore, in case of a thick sheet which is difficult to tear, it becomes impossible to separate the printer 101. In the shown embodiment, since the paper path and the connecting direction of the connectors are set substantially parallel to each other, the printer 101 may move in a direction permitting withdrawal of the sheet 200 at the occurrence of blocking of the sheet. Treatment at the occurrence of blocking of the sheet becomes quite simple, rupture or tearing of the sheet 200 and residing of the sheet 200 within the apparatus will never be caused.

(Concerning Reference in Width Direction of Sheet)

Next, explanation will be given with respect to a reference position in the width direction of the sheet in the paper path as set forth above.

At first, explanation will be given for a reference in the width direction of the sheet in the printer 101.

Figure 5:
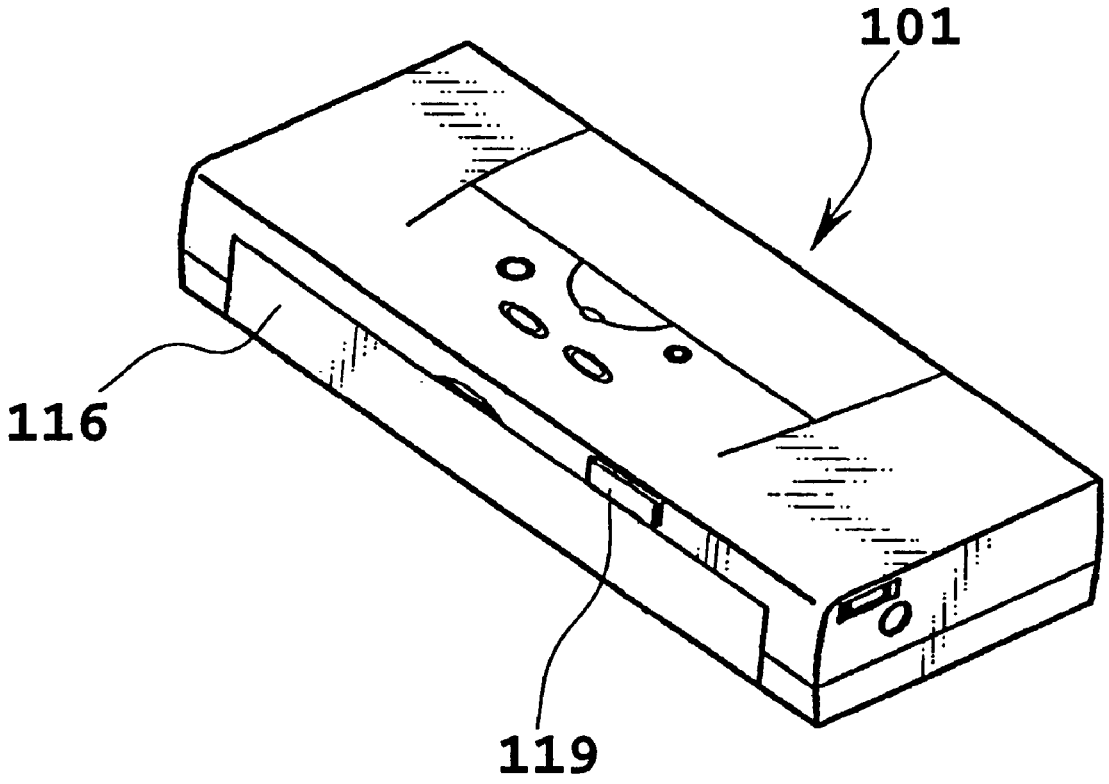
FIG. 5 is a perspective view of the first embodiment of the printing apparatus according to the present invention.

As shown in FIGS. 5 and 6, one end of the paper feeder tray 116 is pivotably supported on a predetermined position of the printer 101. Upon using the printer 101 as sole unit, the paper feeder tray 116 stabilizes feeding operation of the sheet in hand. When the paper feeder tray 116 is placed in open condition as shown in FIG. 6, a reference guide 116*a* provided vertically at one end of the paper feeder tray 116 appears. The sheet 200 is inserted along the reference guide 116*a*. In the shown embodiment, a reference in the width direction of the sheet 200 is defined by the reference guide 116*a*. By inserting the sheet 200 by placing the side edge portion of the sheet 200 along the reference guide 116*a*, positioning of the sheet 200 in the width direction can be performed. In the shown embodiment, within the printer 101, similar reference guide is provided at the same position as the reference guide 116*a* in the width direction of the sheet 200. The later-mentioned reference guide serves for positioning of the sheet 200 in the width direction together with the reference guide 116*a*. It should be preferable to provide a length of the reference guides for positioning the sheet 200 in the width direction, as long as possible in the transporting direction of the sheet 200 in view of stabilization of the sheet 200. Positioning of the sheet 200 in the width direction can be stabilized by using the reference guide 116*a* provided in the paper feeder tray 116, and thus skewing of the sheet 200 can be prevented. It is also possible to guide the sheet 200 only by the reference guide 116*a* provided in the movable paper feeder tray 116 and neglecting the reference guide within the printer 101.

Particularly in ultra compact mobile printer, it is quite difficult to separately provide a paper feeding opening for manual paper feeding and paper feeding opening for automatic paper feeding by the ASF, and respectively independent sheet guide, in view of limited space. Therefore, it becomes necessary to use a common paper feeding opening in place of these paper feeding openings.

Therefore, when the printer 101 is installed in the ASF 1, the reference guide 116*a* as the reference for the sheet upon manual paper feeding has to be used even upon automatic paper feeding by the ASF 1. However, it is difficult to feed the sheet with placing the side edge portion of the sheet automatically fed from the ASF 1 along the reference guide 116*a*. The reason is that, for making the ASF 1 perform an operation the same as the operation that the user places the side edge of the sheet along the reference guide 116*a* with adjusting by hand, it becomes necessary to completely match the sheet references of the printer 101 and the ASF 1. The sheet reference of the ASF 1 is an ASF sheet reference 26*a* (see FIG. 25) provided on the pressure plate 26. By placing the side edge of the sheet along the ASF sheet reference 26*a*, the sheet is fed in a condition where the sheet is positioned at the predetermined position. However, the position of the ASF sheet reference 26*a* and the position of the reference guide 116*a* accumulate various tolerances in the construction to cause substantial difficulty in matching these. For realizing this, quite high cost and complicated mechanism are required. If these sheet references do not match, interference between the side edge portion of the sheet and the reference guide 116*a* is caused to result in skewing of the sheet, to damage the side edge portion of the sheet, or to cause blocking of the sheet by colliding the tip end of the sheet to the sheet reference 116*a*.

Therefore, when the reference guide 116*a* is provided only at relatively upstream side in the paper feeding direction of the manual feeding portion in the printer 101, namely, when the reference in the width direction of the sheet is determined only by the reference guide 116*a* which appears when the paper feeder tray 116 is opened and no member is provided for restricting the position in the width direction of the sheet at the position on the downstream side in the paper feeding direction as shown in FIG. 6, the paper path is set so that the sheet will pass the upper side of the reference guide 116*a* when the printer 101 is installed within the ASF 1. By this, only positioning of the sheet effected by the sheet reference 26*a* of the ASF 1 becomes effective, and thus interference with the sheet reference of the printer 101 can be avoided.

In the sole unit of the printer 101, in a condition where the paper feeder tray 116 is opened as shown in FIG. 6, namely in a condition of manual paper feeding, the surface of the paper feeder tray 116 guiding the sheet becomes substantially horizontal. On the other hand, in the condition where the printer is installed in the ASF 1, the movable paper feeder tray 116 is pivoted downwardly from the position of FIG. 6 in the sole unit of the printer, as shown in FIG. 4. By this, the paper path becomes close to that upon manual paper feeding. In the ASF 1, as a space for receiving the paper feeder tray 116 pivoted downwardly, a reference guide receptacle portion 36*b* is formed. When the printer 101 is pushed into the ASF 1, the reference guide 116*a* is pivoted downwardly as guided by a reference guide guiding portion 36*c* forming the reference guide receptacle portion 36*b* and thus received within the reference guide receptacle portion 36*b*. As a result, necessary shift amount for avoiding interference between the reference guide 116*a* and the paper path, namely shifting amount of the paper path of the ASF 1 relative to the paper path upon manual feeding can be made small to prevent problems, such as back tension on the sheet or the like, due to non-smooth paper path.

Furthermore, in the paper feeder tray 116 on the printer 101 side, a right end guide 122 guiding the side edge portion of the sheet on the opposite side of reference side, is provided, as shown in FIG. 6. The right end guide 122 is slidably provided in the width direction of the sheet for guiding the side edge portion on the side opposite to the reference side of the sheet. A shape of the right end guide 122 as viewed from a thickness direction of the sheet in the paper path is substantially the same shape as the reference guide 116*a*. Upon installing the printer 101 into the ASF 1, the right end guide 122, the paper feeder tray 116 and the reference guide 116*a* are received within the reference guide receptacle portion 36*b*. The right end guide 122 is movable to an arbitrary position within a predetermined range in the paper feeder tray 116. Therefore, the paper feeder tray 116 at any position within the predetermined range may be received within the reference guide receptacle portion 36*b*.

Thus, upon installing the printer within the ASF, by setting the paper path at a position avoiding the reference guide on the ASF side, the sheet reference on the side of the main body of the printer is made null and only the sheet reference on the ASF side is effective. Accordingly, complication of the apparatus for matching both of the sheet references of the printer and the ASF and cost-up can be successfully avoided. Then, a problem to be caused when interference is caused between the sheet fed from the ASF and the sheet reference on the side of the main body of the printer, namely skewing of the sheet, damaging of the side edge of the sheet, blocking of the sheet by colliding onto the sheet reference, can be successfully avoided.

Figure 7:
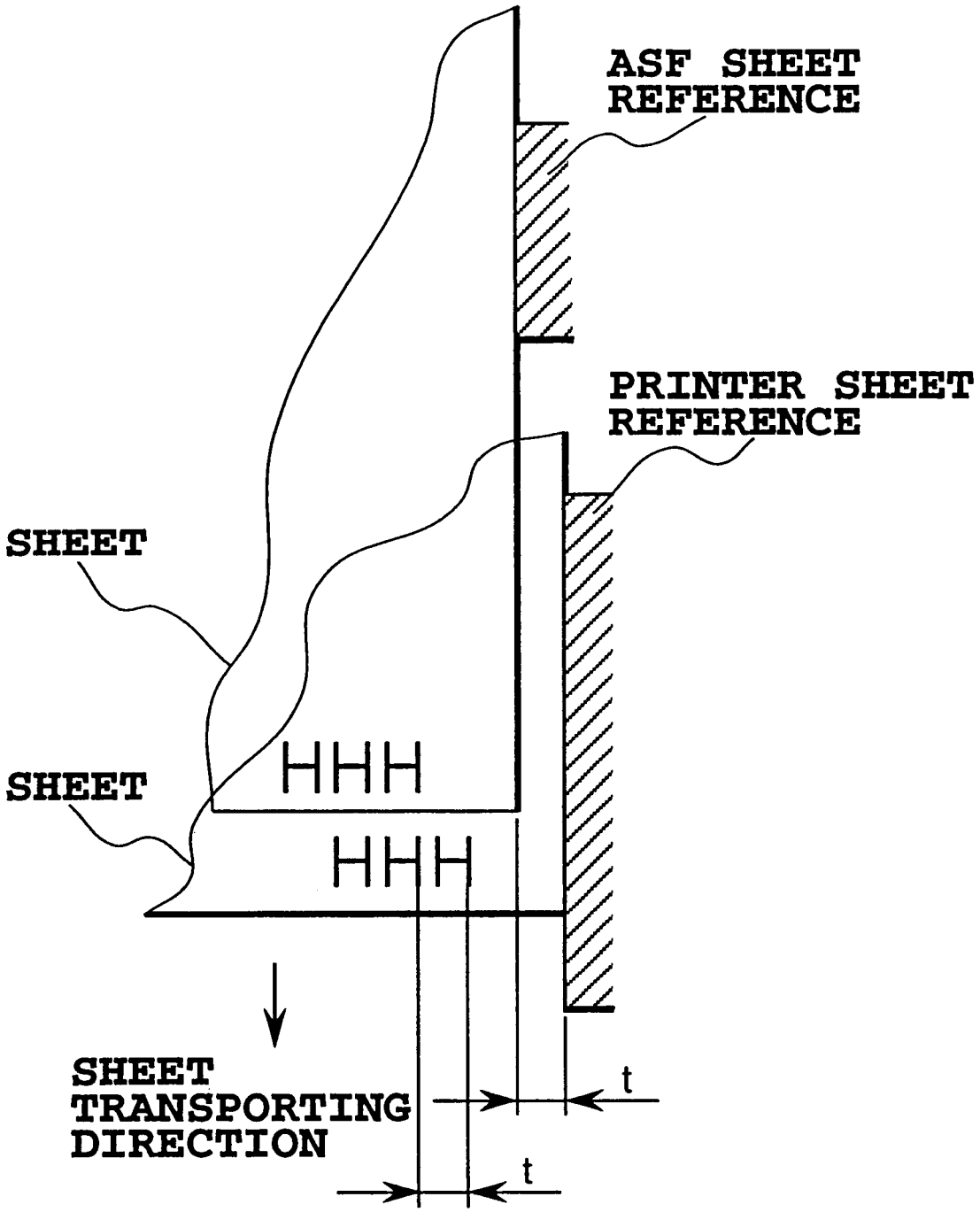
FIG. 7 is a diagrammatic plan view of a sheet reference position in the first embodiment of the present invention.

On the other hand, there are some printers 101 which have a reference guide at the same position as the reference guide 116*a* in the width direction of the sheet, and a relatively long length of the former reference guide is provided to make positioning of the sheet stable, it is difficult to set the paper path with avoiding all of the reference guides. Therefore, in this case, the sheet reference on the side of the main body of the printer and the sheet reference on the side of the ASF are set at preliminarily offset positions. Namely, as shown in FIG. 7, inside of the sheet reference on the side of the printer, namely the position shifting in a distance t toward the side of the printing position by the head, the sheet reference is set on the ASF side so as not to cause interference between the sheet fed from the ASF and the sheet reference on the printer side. Shifting amount t of the sheet reference is greater than or equal to the tolerance in positioning of the width direction of the sheet between the printer and the ASF, and is determined in consideration of the case where skewing of the sheet occurs. In the shown embodiment, the offset amount t is approximately 0.6 mm.

In this case, the sheet reference should offset between that upon performing printing by the sole unit of the printer and that upon performing printing in the condition installed in the ASF. If similar printing by the head is performed upon performing both printing without taking the offset into account, in both of these, a distance up to the printing position from the side edge portion of the sheet can be different. Therefore, in the shown embodiment, the printing position is shifted for the amount t corresponding to the offset amount of the sheet reference position between that in the sole unit of the printer and that in the condition installed in the ASF. In the shown embodiment, since the printer 101 and the ASF 1 are electrically connected by the connectors, the printer 101 can electrically detect installed condition and released condition of the ASF 1. By this result of detection, judgment for offset of the printing position can be made. Other than the method for detecting electrical connection, it can be performed by means of an ASF detection switch or so on. By offsetting the sheet reference between that in the sole unit of the printer and that in the condition installed in the ASF, with avoiding interference of the reference guides, the printing position onto the sheet can be made the same. Accordingly, in printing both in the sole unit of the printer and in the condition installed in the ASF, a problem, such as difference of the printing positions on a preprinted paper, which can be caused due to difference of the printing position, can be successfully avoided. Here, the sheet reference shifting amount t and the shifting amount of the printing position are not required to be completely the same amount, but can be different values within an allowable range.

(Concerning ASF Feeder Tray)

Next, explanation will be given for the ASF feeder tray supporting the stacked sheets.

Figure 8:
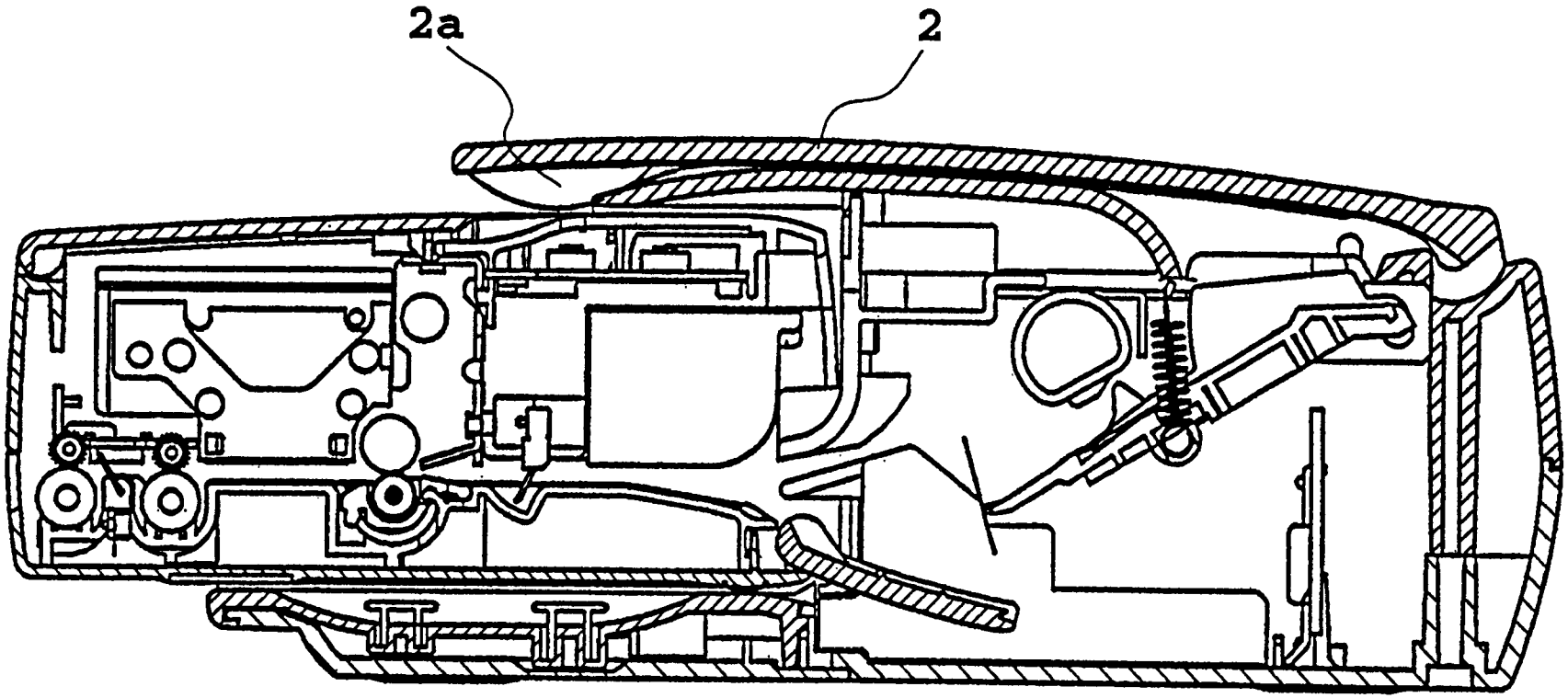
FIG. 8 is a section of the first embodiment of the printing apparatus and the automatic feeding apparatus according to the present invention, illustrated in the assembled condition.
Figure 10:
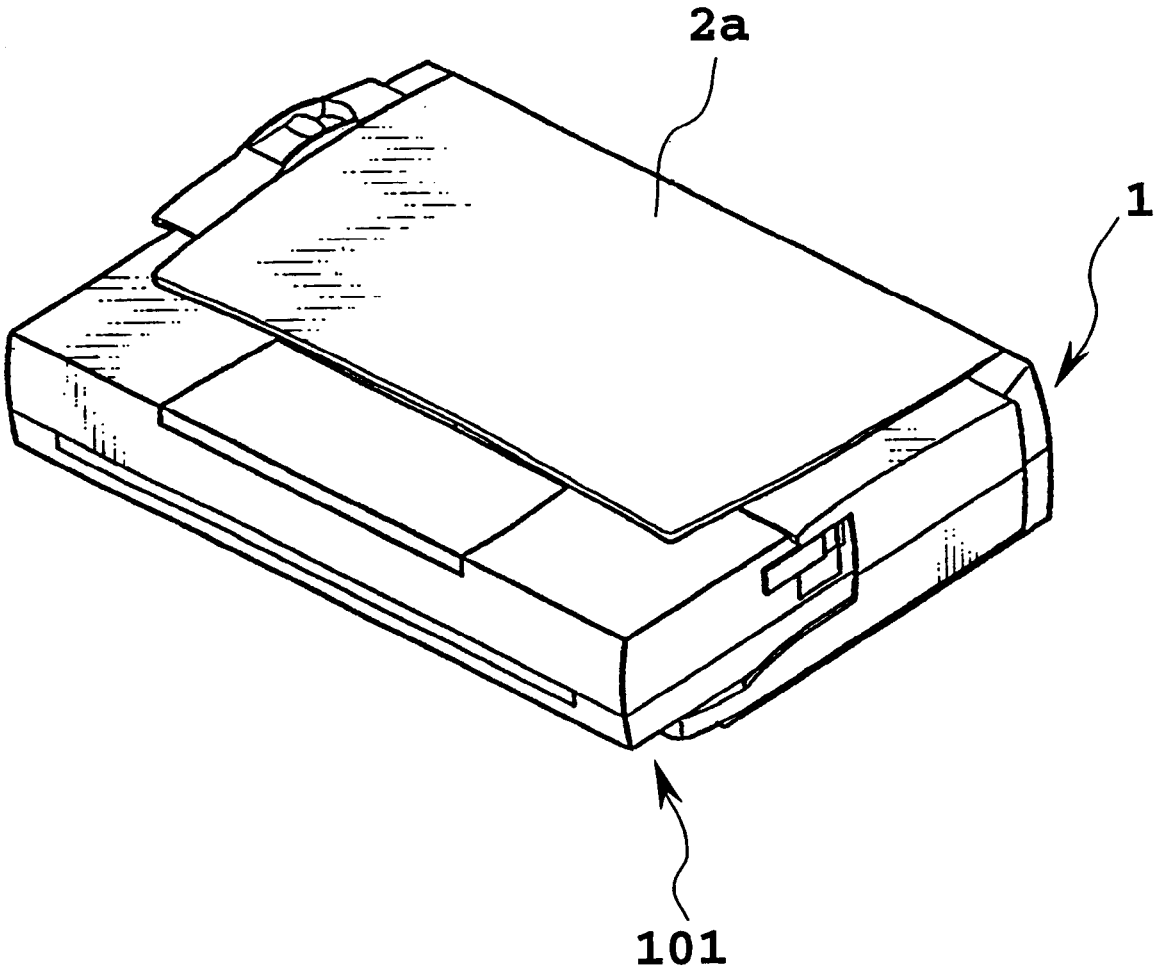
FIG. 10 is a perspective view of the first embodiment of the printing apparatus and the automatic feeding apparatus according to the present invention.

As shown in FIGS. 1 to 4, the ASF feeder tray 2, at one end of which, is supported on the ASF 2 upper case 47, and is pivotable about the support portion. FIG. 8 shows a condition where the ASF feeder tray 2 is closed. The ASF feeder tray 2 is opened with a predetermined angle when the sheets are stacked, and is closed while the sheets are not stacked. This means that the shown embodiment of the ASF 1 is not only for using the portable type printer 101 as desktop type but also for enabling hand carrying in the condition where the printer 101 is installed in the ASF 1 for a quite compact assembled condition. In order to realize such use condition, when the ASF feeder tray 2 is in closed condition, it becomes necessary that the ASF feeder tray 2 is closed along the outer contour of the ASF 1 in the printer installed condition. Therefore, the ASF feeder tray 2 is in thin plate form. On the other hand, the shown embodiment of the ASF feeder tray 2 is in a form covering the operating portion of the printer 101, as shown in FIG. 10. Therefore, when the ASF feeder tray 2 is hand carried in the condition where the ASF feeder tray 2 is closed with maintaining the printer 101 installed in the ASF 1, unwanted access to the operating portion to cause unintentional operation of the printer can be avoided. On the other hand, when the ASF feeder tray 2 is closed, by engaging the arbitrary portion with the ASF upper case 47, the ASF feeder tray 2 may not be opened unwantedly during hand carrying.

Figure 9:
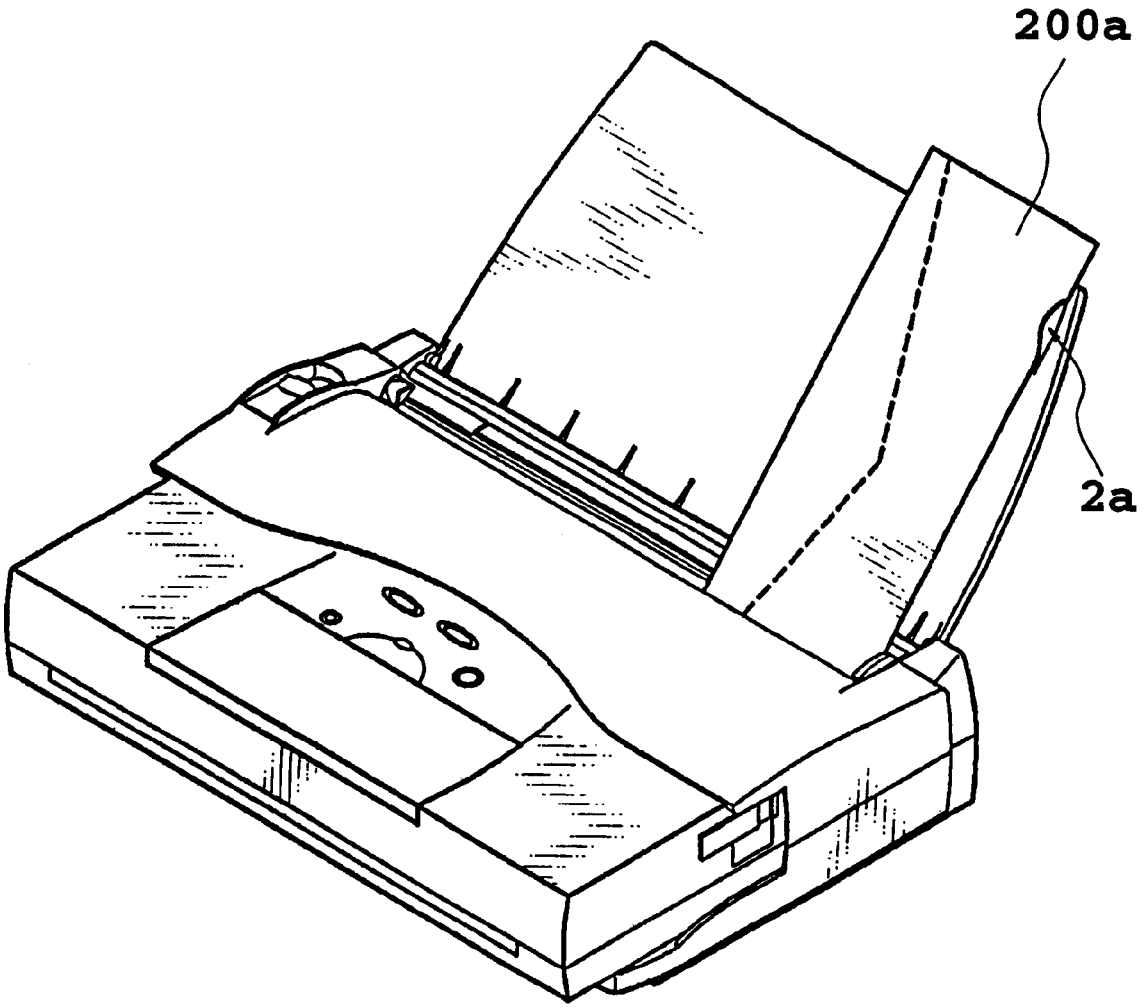
FIG. 9 is a perspective view of the first embodiment of the printing apparatus and the automatic feeding apparatus according to the present invention.

On the other hand, as shown in FIG. 9, when an envelope 200*a* is fed in a longitudinal direction by the ASF 1, a tab of the envelope 200*a* is normally placed on left side. In the shown embodiment of the ASF 1 and so on, due to the envelope tab possibly being expanded in accordance with humidity, the tab side (left side) of the envelope 200*a* is given greater resistance (hereinafter also referred to as "resistance of the tab") when the envelope 200*a* is fed. By this, the envelope 200*a* may be subject to a force to cause pivoting in clockwise direction. In the shown embodiment, in order to prevent pivotal motion of the envelope 200*a* in clockwise direction, an ASF feeder tray side guide portion 2*a* (hereinafter also referred to as "side guide portion") is provided on the upstream side portion of the ASF feeder tray 2 in the sheet feeding direction. When the envelope 200*a* is set in the ASF 1 longitudinally, the right side of the rear end of the envelope 200*a* is positioned along the side guide 2*a* to prevent further pivotal movement in the clockwise direction. In case of longitudinal paper feeding of the envelope 200*a*, resistance of the tab is received at a timing for feeding the envelope 200*a*. In the shown embodiment, when the envelope 200*a* moves over the ridge sheet 37, resistance of the tab is exerted. Also, when the tip end of the envelope 200*a* is lifted up along the tilted surface of the ridge 36 immediately after moving over the ridge sheet 37, resistance of the tab is exerted. After this timing, influence of resistance of the tab becomes small to cause no pivotal motion in the clockwise direction even when the side guide 2*a* is not provided. For such reason, in the shown embodiment, the side guide 2*a* is provided in a part of the portion of the ASF feeder tray 2. Namely, the side guide 2*a* is opposite to the vicinity of the rear end of the envelope 200*a* to prevent pivotal motion of the envelope 200*a* in the clockwise direction, and the side guide 2*a* is not provided over the entire range in the longitudinal direction of the envelope 200*a*. Such partly provided side guide 2*a* is received in a stepped portion formed between the ASF upper case 47 and the printer 101 when the ASF feeder tray 2 is closed. Thus, when the ASF feeder tray 2 is closed, the side guide 2*a* does not cause interference with other portions. Therefore, the ASF feeder tray 2 can be received in a form along the outer contour of the ASF 1 to acquire portability.

On the other hand, the height of the side guide portion 2*a* may be effective as long as it has a height greater than or equal to a total thickness of the envelopes when the envelopes are stacked. A stepped portion having the height greater than or equal to the total thickness of the stacked envelopes is required to be provided between the ASF upper case 47 and the printer 101.

The shown embodiment of the ASF feeder tray 2 is effective for preventing pivotal motion of the envelope in clockwise direction in longitudinal feeding of the envelope. Also, when pivoting force in clockwise direction is caused for some reason for other sheets having a length equivalent to that of the envelope, such pivotal motion in clockwise direction can be prevented.

On the other hand, the side guide 2*a* is formed integrally with the ASF feeder tray 2 to permit lowering of the cost therefor.

It is also possible that, instead of receiving the side guide 2*a* within the stepped portion when the ASF feeder tray 2 is closed, the side guide 2*a* may be received in a recessed portion (dented portion) preliminarily formed in the printer 101 or the ASF 1.

(Installation and Releasing Mechanism of ASF and Printer)

Figure 11:
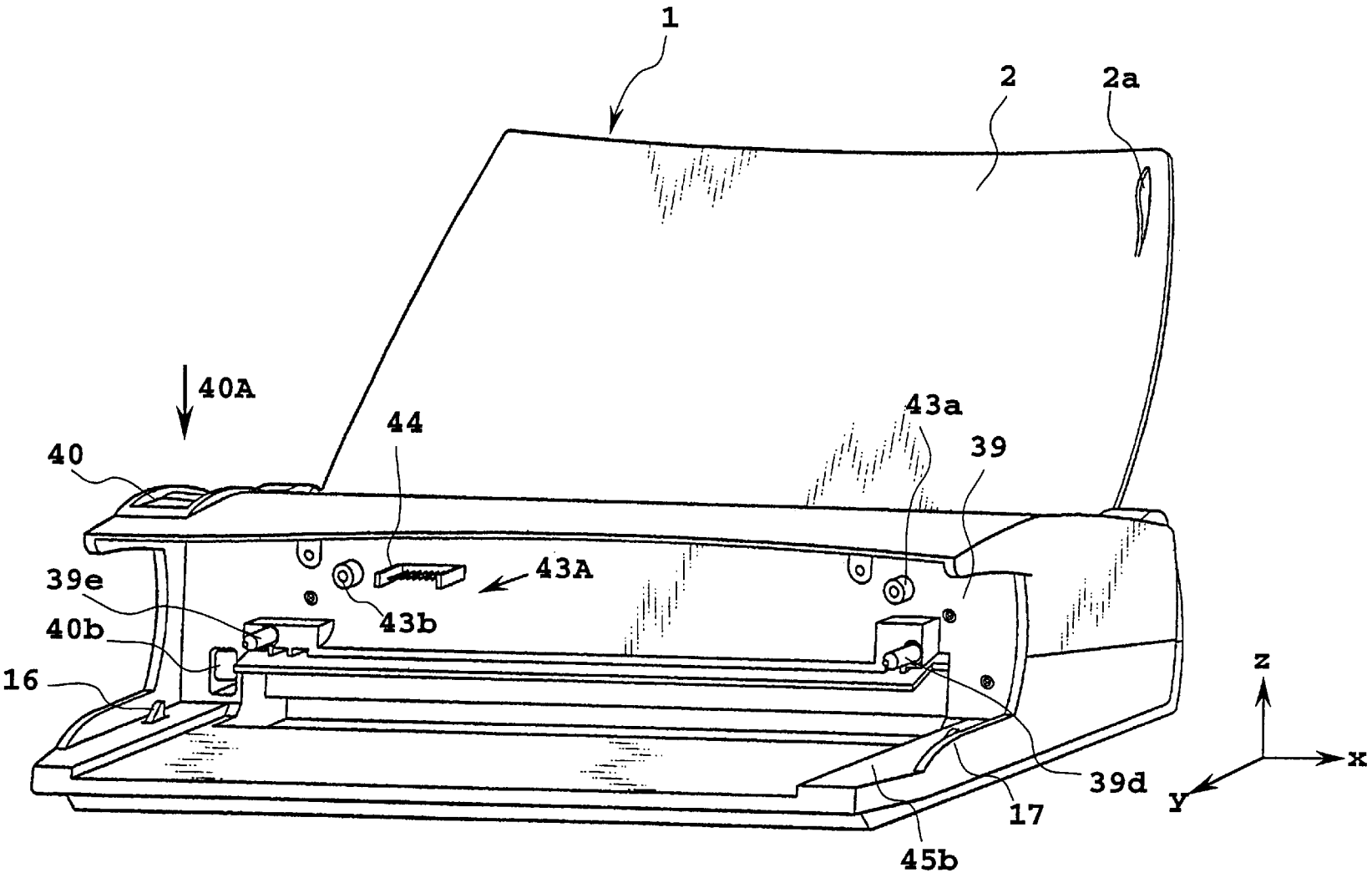
FIG. 11 is a perspective view showing arrangement of parts associated with installation and releasing in the automatic feeding apparatus in the first embodiment of the present invention.
Figure 12:
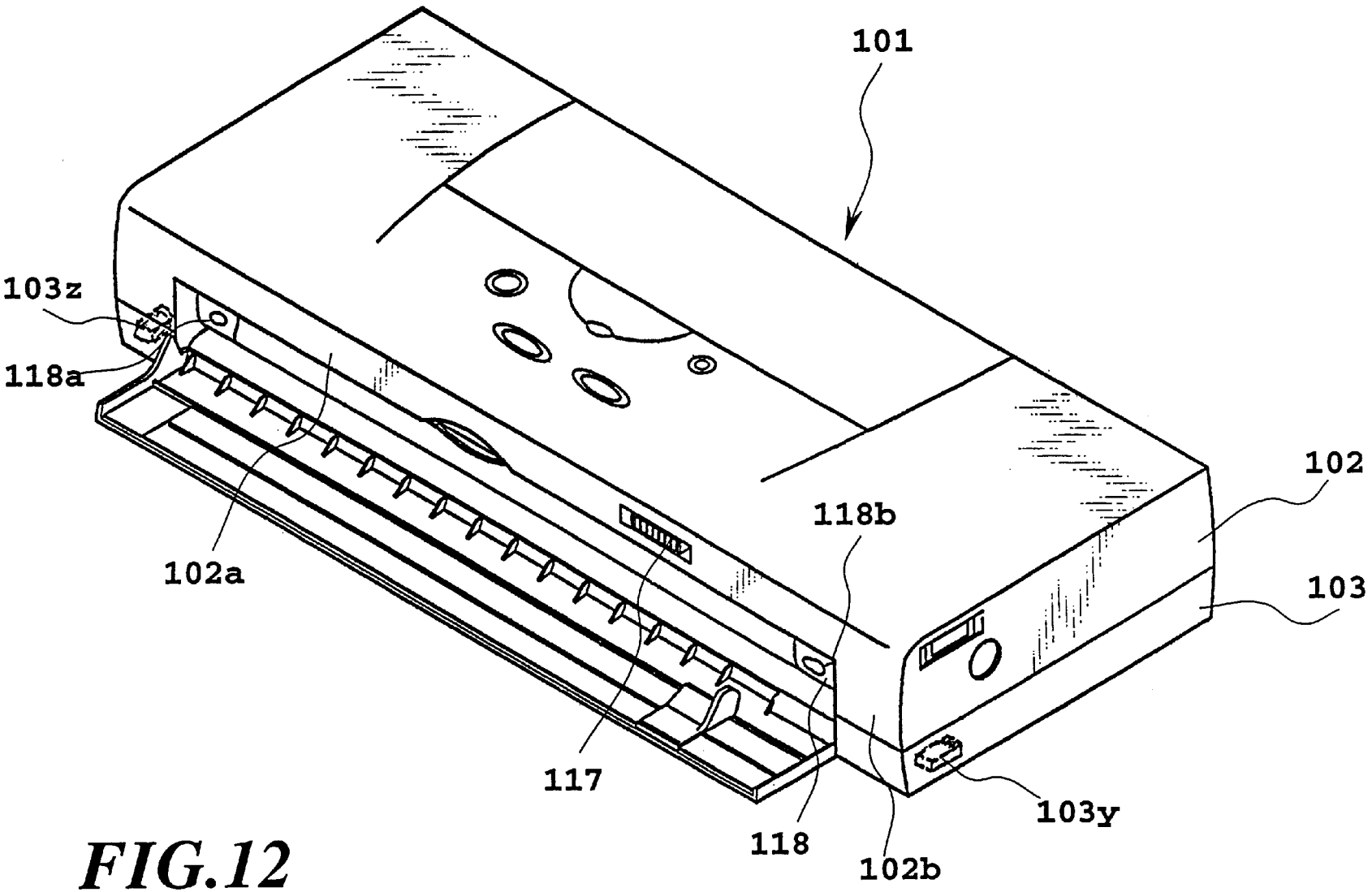
FIG. 12 is a perspective view showing arrangement of parts associated with installation and releasing in the printing apparatus in the first embodiment of the present invention.

FIG. 11 is a perspective view showing arrangement of parts associated with printer installation and releasing mechanism in the ASF 1. Also, FIG. 12 is a perspective view showing arrangement of parts associated with printer installation and releasing mechanism in the printer 101.

In FIG. 11, a positioning base 39 is a member for performing positioning of paper paths between the ASF 1 and the printer 101 and for positioning for connection between the ASF connector 44 of the ASF 1 and the connector 117 of the printer 101. Namely, in the positioning base 39, two positioning bosses 39*d* and 39*e* are provided. When the printer 101 is installed in the ASF 1, in advance of connection between the ASF connector 44 and the connector 117, the positioning boss 39*d* is engaged with a positioning hole 118*a* provided in a substrate holder 118 of the printer 101, and the positioning boss 39*e* is engaged with a positioning elongated hole 118*b*. Accordingly, connection between the connectors 44 and 117 is performed after positioning to prevent phase shift therebetween and damaging of the connectors 44 and 117 due to phase shift. By engagement between the bosses 39*d*, 39*e* and the holes 118*a*, 118*b*, positioning between the ASF 1 and the printer 101 in x and z directions is performed. Therefore, positioning of paper path between the printer 101 and the ASF 1 can be done simultaneously.

In the ASF 1, in order to position the printer 101 in y direction after installation, a hook (left side) 16 and a hook (right side) 17 are provided. On the other hand, in both sides of the base 103 of the printer 101, hook engaging holes 103*y*, 103*z* engaging with respective hooks 16 and 17 are provided. When the printer 101 is installed in the ASF 1, the hook (left side) 16 and the hook (right side) 17 provided in the ASF 1 are engaged with the hook engaging holes 103*y* and 103*z* provided in the printer 101 to perform positioning of the printer 101 in y direction.

Removal of the printer 101 from the ASF 1 is achieved when the user pushes the push lever 40 in the direction of arrow 40A. Namely, when the push lever 40 is pushed in the direction of arrow 40A, the hook (left side) 16 and the hook (right side) 17 set forth later are retracted in the direction of arrow 40A to release engagement from the hook engaging holes 103*y* and 103*z* of the printer 101. Then, by means of pop-ups 43*a* and 43*b* provided in the ASF 1, a portion 102*a* of the printer 101 is pushed in the direction of arrow 43A(Y) to release connection between the connectors 44 and 117. The pop-ups 43*a* and 43*b* are biased in the direction of arrow 43A(y) by a not shown elastic member and are slidable in y-direction. Biasing force of the pop-ups 43*a* and 43*b* acts as reaction force upon installation of the printer 101 into the ASF 1. Accordingly, if the biasing force of the pop-ups 43*a* and 43*b* is excessive, the printer 101 may not be pushed into the ASF 1 so that installation of the printer 101 becomes impossible. Therefore, the biasing force to be exerted on the pop-ups 43*a* and 43*b* is set appropriately (in the extent that the ASF 1 may not be moved by the biasing force upon installation of the printer 101 into the ASF 1).

If a force required for disconnection of the connectors 44 and 117 becomes greater than the biasing force to the pop-ups 43*a* and 43*b*, it becomes impossible to release connection between the connectors 44 and 117 only by the pop-ups 43*a* and 43*b*. Therefore, in the shown construction, by pushing the push lever 40 in the direction of arrow 40A, a portion 40*b* of the push lever 40 projects in the direction of arrow y. Accordingly, by projecting the portion 40*b* of the push lever 40 to push a portion 102*b* of the printer 101 in the direction of arrow y, the connectors 44 and 117 are disconnected. Accordingly, the user may easily withdraw the printer 101 from the ASF 1 in the direction of arrow y in the condition where engagement of the printer 101 and the ASF 1 in y direction and connection between the connectors 44 and 117 are released.

FIGS. 13 to 18 are sections for explaining greater detail of the installation and releasing mechanism of the ASF 1 and the printer 101, set forth above.

Figure 13:
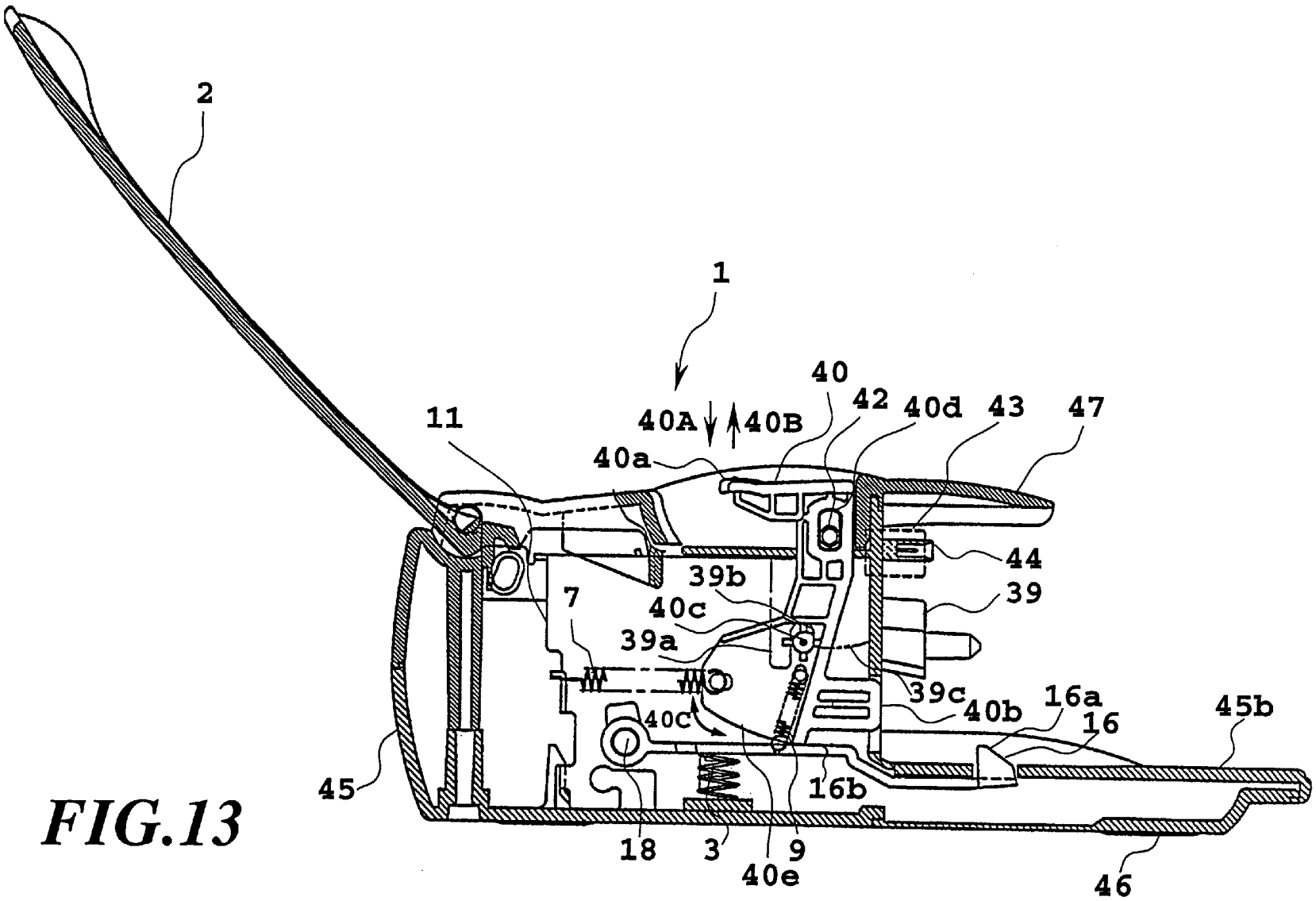
FIG. 13 is a section of the first embodiment of the automatic feeding apparatus according to the present invention.

FIG. 13 is a section showing arrangement of components associated with installation and releasing of the printer 101 to and from the ASF 1. In FIG. 13, the push lever 40 is mounted on a lever shaft 42 fixed to the positioning base 39 for movement in the direction of arrows 40A and 40B and for pivoting in a direction of arrow 40C. On the other hand, between the hook lever 40 and the chassis 11, a push lever spring 7 is stretched. On the push lever 40, a boss 40*c* is provided as pivoting stopper. On the other hand, on the positioning base 39, sliding surfaces 39*a*, 39*b* and 39*c* for guiding the bosses 40*c* are provided. In FIG. 13, the sliding surfaces 39*a*, 39*b* and 39*c* are shown by two-dotted lines for the purpose of illustration and facilitating understanding of the construction. With the shown construction, pivotal motion of the push lever 40 about the lever shaft 42 is restricted by abutting the boss 40*c* of the push lever 40 onto the guide surface 39*b*.

The hook (left side) 16 is fixed to the hook shaft 18 which is rotatably mounted on the ASF chassis 11. Not shown hook (right side) 17 is also fixed on the hook shaft 18, similarly. The hook (left side) 16 and the hook (right side) 17 cooperate. The hook (left side) 16 and the push lever 40 are biased toward each other by a connecting spring 9. The sliding surface 40*e* of the push lever 40 and the portion 16*b* of the hook (left side) 16 are constantly held in contact. On the other hand, between the hook (left side) 16 and the ASF base 45, a hook spring 3 is disposed in compression. By the biasing force of the hook spring 3, a claw portion 16*a* of the hook (left side) 16 is projected from the surface of the printer sliding portion 45*b* of the base 45.

(Installation Operation of Printer)

Figure 14:
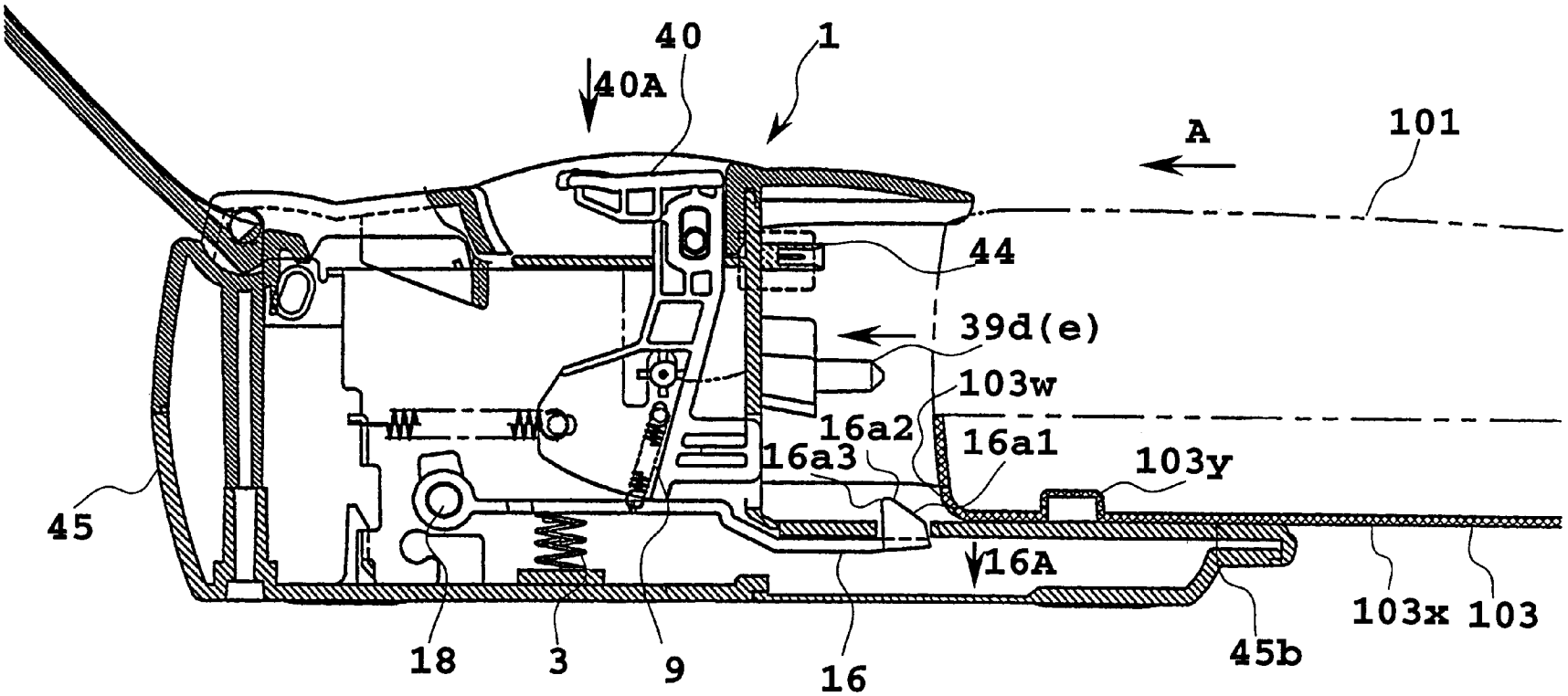
FIG. 14 is a section showing the first embodiment of the printing apparatus and the automatic feeding apparatus according to the present invention, illustrated in a condition at mid-way of assembling.

FIG. 14 shows a condition where the printer 101 is mounted on the printer sliding portion 45*b* in order to install the printer 101 into the ASF 1. In FIG. 14, in order to clearly explain the mechanism, the printer 101 is illustrated in two-dotted line and the base 103 of the printer 101 is shown by section.

The printer 101 is moved in the direction of arrow A along the printer sliding portion 45*b* of the ASF base 45. From the condition shown in FIG. 14, when the printer 101 is further pushed in the direction of arrow A, the tilted surface 16*a*1 of the claw portion of the hook (left side) 16 contacts with a bottom surface 103*w* of the base of the printer 101.

By further pushing the printer 101, the hook (left side) 16 is pivoted about the hook shaft 18 downwardly in the direction of arrow 16A, so that the flat surface 16*a*2 of the claw portion of the hook (left side) 16 contacts the bottom surface 103*w* of the base. At the same time, the push lever 40 linked with the hook (left side) 16 by the connecting spring 9 is pivoted downwardly in the direction of arrow 40A. At the pushed position of the printer 101, the positioning bosses 39*d* and 39*e* are placed in engaged condition with the positioning hole 18*a* and the positioning elongated hole 18*b* (see FIG. 12), so that positioning between the ASF connector 44 and the connector 117 on the printer side is established before connection.

Figure 16:
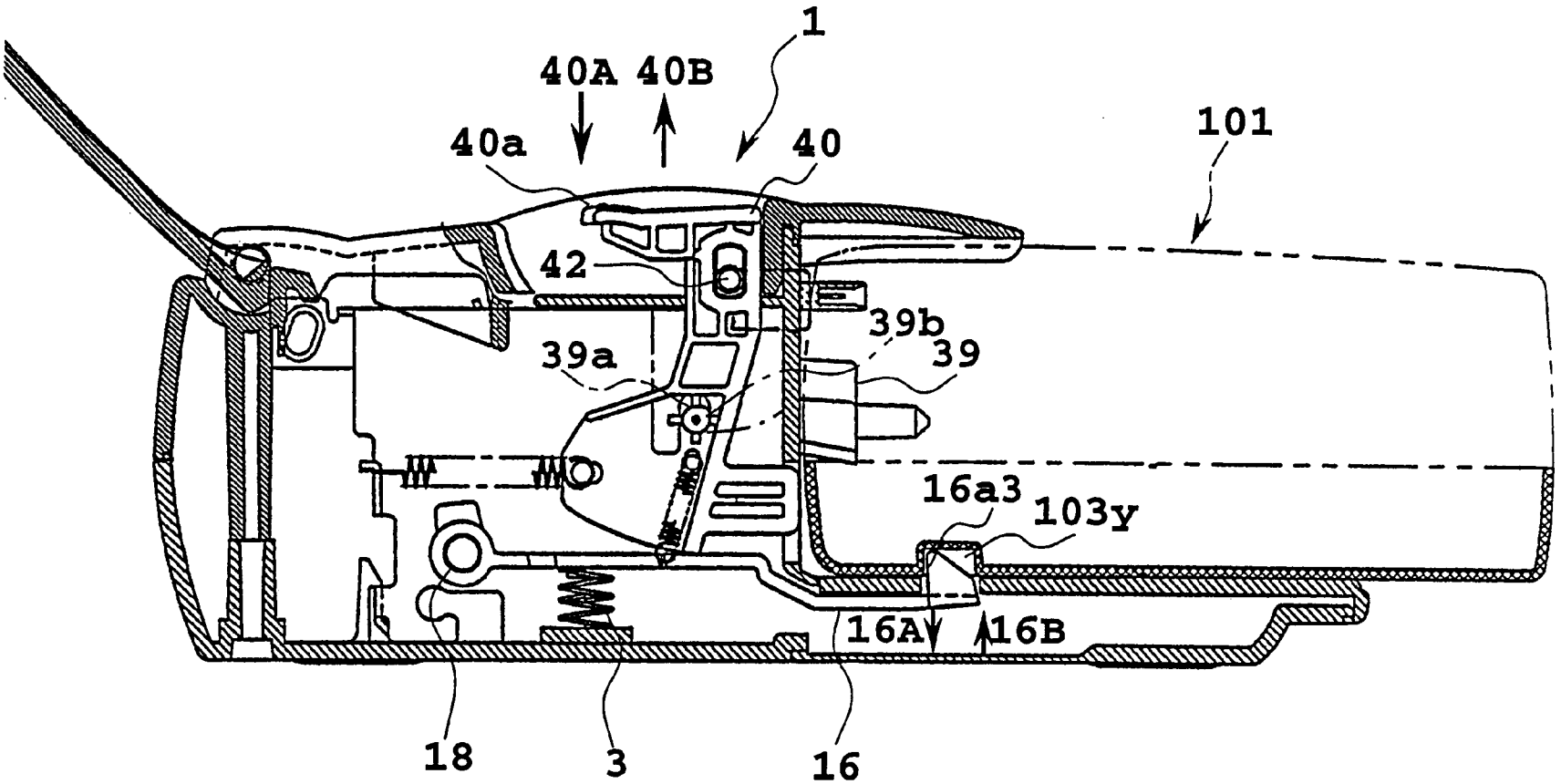
FIG. 16 is a section showing the first embodiment of the printing apparatus and the automatic feeding apparatus according to the present invention, illustrated in a condition as assembling.

By further pushing the printer 101 in the direction of arrow A, the ASF connector 44 and the connector 117 are connected. Then, if the claw portion 16*a* of the hook (left side) 16 reaches the position opposing to the hook engaging hole 103*y* of the printer 101, the hook (left side) 16 is lifted upwardly in the direction of arrow 16B by the biasing force of the hook spring 3, as shown in FIG. 16. Then, a fixing surface 16*a*3 of the claw portion of the hook (left side) 16 abuts onto the wall of the hook fixing hole 103*y* of the printer 101 to be placed in engaging condition. Simultaneously, the push lever 40 is cooperated to be lifted up in the direction of arrow 40B. By this, the user can confirm installation (fixing) of the printer 101 into the ASF 1.

On the other hand, since the hook (left side) 16 and the hook (right side) 17 are fixed on the hook shaft 18, unless these hooks 16 and 17 are engaged with the corresponding hook fixing holes 103*y* and 103*z* of the printer 101, the push lever 40 will never be lifted up in the direction of arrow 40B. Accordingly, when one of the hooks 16 and 17 is not engaged with the fixing hole 103*y* or 103*z* of the printer 101, for example, due to installation failure in which the printer 101 is installed with respect to the ASF 1 obliquely, by checking the height position of the push lever 40, installation failure can be successfully prevented by the user. In the shown construction, the engaging positions between the hooks 16 and 17 and the printer 1 are set at the same height position as the rotation center of the hooks 16 and 17 or slightly higher than the position of the rotation center. By this, when attempt is made to forcedly withdraw the printer 101 from the ASF 1, the hooks 16 and 17 are stopped at the position where force balance is established. Namely, the hooks 16 and 17 are stopped at the same height as the rotation center of the hooks 16 and 17. Therefore, the printer 101 will never withdraw from the ASF 1.

(Operation for Withdrawing Printer)

Next, explanation will be given for the case where the printer 101 is withdrawn from the ASF 1.

Figure 17:
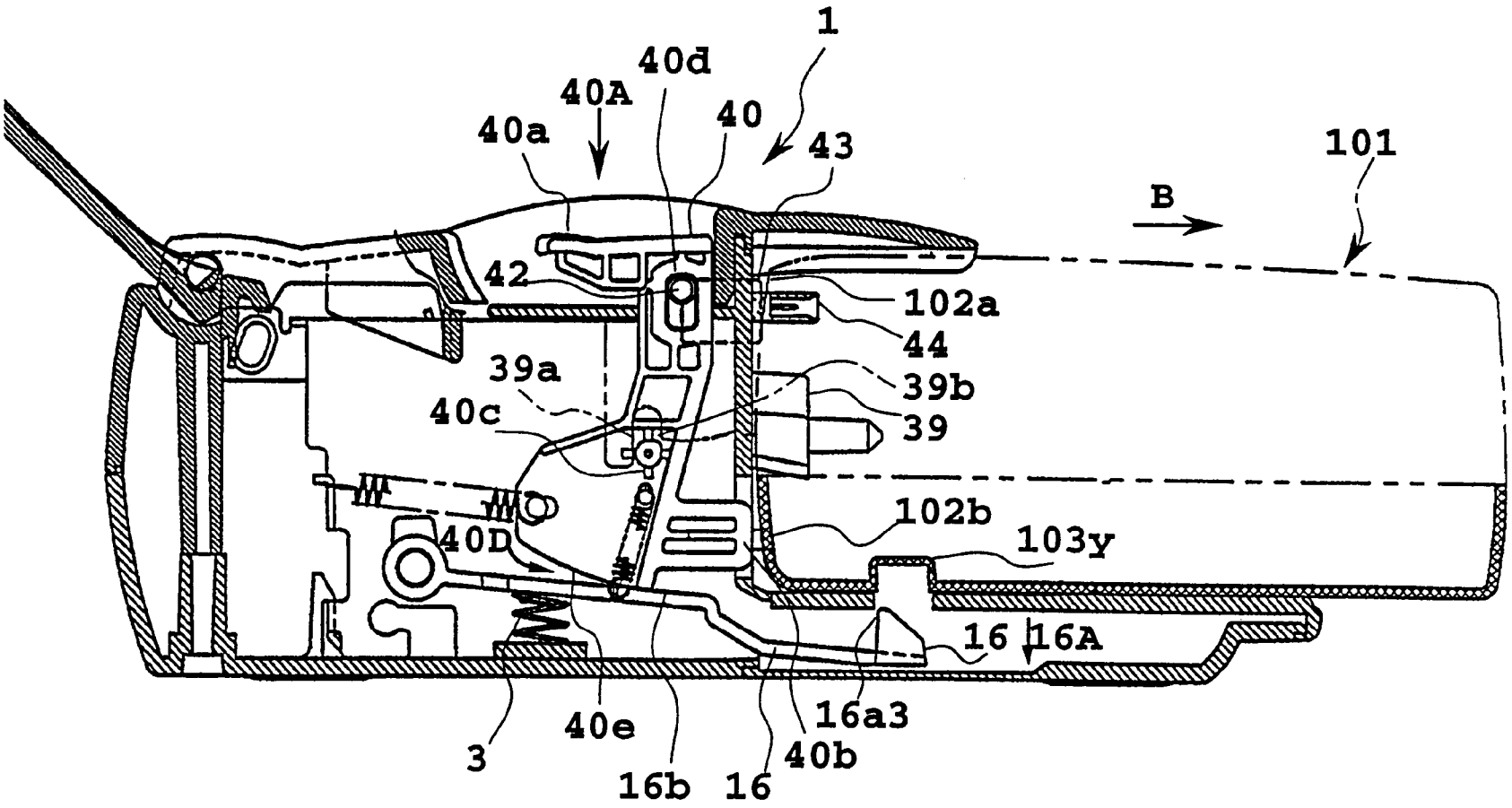
FIG. 17 is a section showing the first embodiment of the printing apparatus and the automatic feeding apparatus according to the present invention, illustrated in a condition at initiation of separation.

When the user wants to remove the printer 101 from the ASF 1, at first, the push portion 40*a* of the push lever 40 is pushed by the finger in the direction of arrow 40A. At this time, the boss 40*c* of the push lever 40 is disposed between the guide surfaces 39*a* and 39*b* provided in the positioning base 39. Therefore, the push lever 40 cannot be pivoted about the lever shaft 42 until the boss portion 40*c* is downwardly released from the guide surface 39*b*, so that push lever 40 is lowered in the direction of arrow 40A. On the other hand, since the push lever 40 and the hook (left side) 16 are linked, the hook (left side) 16 is pivoted in the direction of arrow 16A about the hook shaft 18 simultaneously with lowering of the push lever 40. By this, as shown in FIG. 17, engagement between the hook engaging hole 103*y* of the printer 101 and the fixing surface 16*a*3 of claw portion of the hook (left side) 16 is released. On the other hand, popup contacting portion 102*a* of the printer 101 is pushed in the direction of arrow B by the pop-up 43 (43*a* and 43*b*) shown by broken line in FIG. 17. At the same time, connection between the ASF connector 44 and the connector 117 is released. In this condition, when the user releases the pushing of the push lever 40 in the direction of arrow A, the condition is placed to shown in FIG. 15. This condition is that connection between the connectors 44 and 117 is released and the hooks 16 and 17 and the printer 101 are disengaged. At this condition, the user may easily withdraw the printer 101 from the ASF 1.

Here, it is possible that the pushing force of the pop-up 43 is grown to exceed a force required for disconnection between the connectors 44 and 117. In such condition, even when engagement between the hooks 16 and 17 and the printer 101 is released, the printer 101 cannot be moved to place and the condition shown in FIG. 15. Therefore, the user may not withdraw the printer 101 from the ASF 1. Therefore, in the shown construction, an ejecting function by the user is added.

Namely, in the condition shown in FIG. 17, the hook (left side) 16 is placed in a position where engagement with the hook engaging hole 103*y* is released. Thus, since the boss 40*c* of the push lever 40 is released downwardly from the guide surface 39*b* of the positioning base 39, restriction of movement in the direction of the arrow 40A by the guide surface 39*b* is released. On the other hand, the push lever 40 is in a position where the upper end surface of the hole portion 40*d* is pushed onto the lever shaft 42 so that pushing down of the hooks 16 and 17 is restricted. The sliding surface 40*e* of the push lever 40 for the hook is formed into an arc-shaped configuration centered as the lever shaft 42. Therefore, even if the push lever 40 is pivoted, the position of the hook (left side) 16 is held unchanged.

Figure 18:
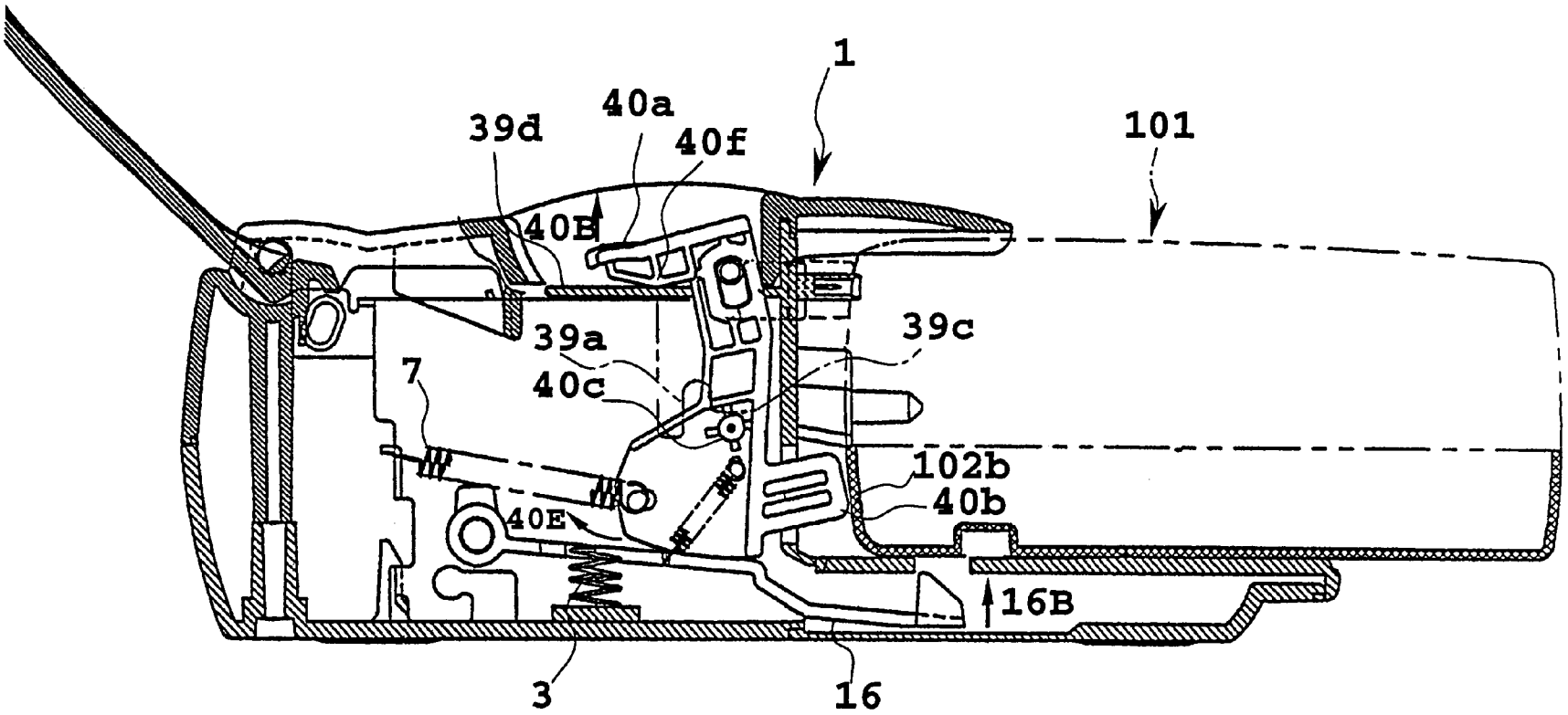
FIG. 18 is a section showing the first embodiment of the printing apparatus and the automatic feeding apparatus according to the present invention, illustrated in a condition at mid-way of separation.

In the condition shown in FIG. 17, when the user further pushes the pushing portion 40*a* of the push lever 40 in the direction of arrow 40A, the push lever 40 is pivoted in the direction of arrow 40D (see FIG. 17) about the lever shaft 42. Then, with maintaining the hooks 16 and 17 and the printer 101 in disengaged condition, the pushing portion 40*b* of the push lever 40 abuts onto the contact portion 102*b* of the printer 101 so that the printer is pushed in the direction of arrow B. The push lever 40 is restricted in pivotal motion by abutting the stopper portion 40*f* onto the stopper portion 39*f* of the positioning base 39, as shown in FIG. 18. Here, a pushing amount of the printer 101 by the push lever 40 is set to an amount for releasing engagement between the hooks 16 and 17 and the printer 101 and releasing connection between the connectors 44 and 117.

Figure 15:
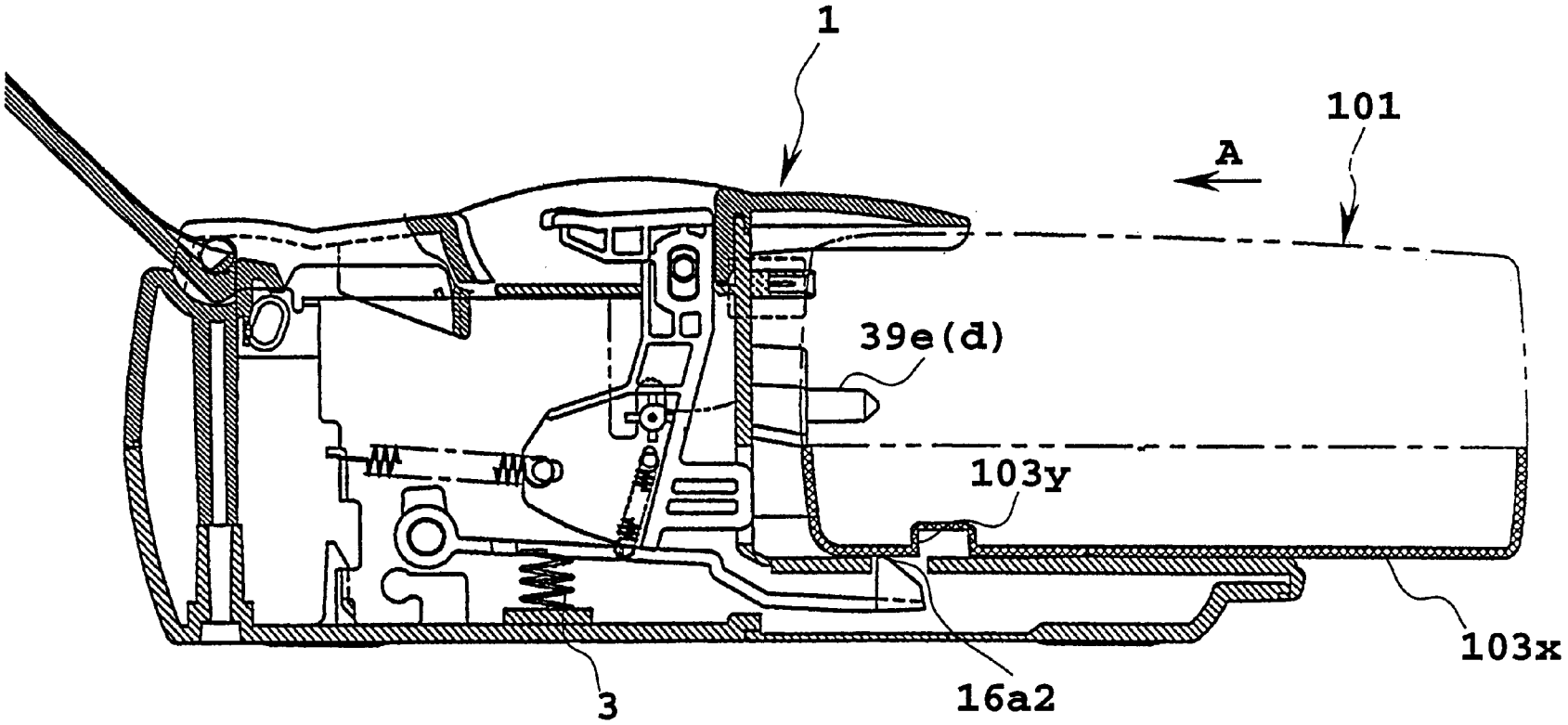
FIG. 15 is a section showing the first embodiment of the printing apparatus and the automatic feeding apparatus according to the present invention, illustrated in a condition at mid-way of assembling.

After pushing the printer 101, the user releases a pushing force to the push portion 40*a* of the push lever 40. When the pushing force is released, the hook (left side) 16 is lifted up in the direction of arrow 16B by the hook spring 3. At the same time, the push lever 40 is also pushed upwardly by the hook (left side) 16, so that the boss 40*c* of the push lever 40 is abutted onto the guide surface 39*c* of the positioning base 39. Then, by a tension force of the push lever spring 7, the push lever 40 is pivoted in the direction of arrow 40E. And, by abutting the boss 40*c* of the push lever 40 onto the guide surface 39*a* of the positioning base 39, pivotal motion of the push lever 40 is restricted. Then, by a spring force of the hook spring 3, the push lever is lifted upwardly in the direction of arrow 40B. Finally, as shown in FIG. 15, connection between the connectors 44 and 117 is released. Also, the hooks 16, 17 and the printer 101 are released from engagement. Then, the user may easily withdraw the printer 101 from the ASF 1.

In the construction as set forth above, the push lever 40 is pushed in substantially vertical direction and the printer 101 is withdrawn in substantially horizontal direction. By pushing the push lever 40 in substantially vertical direction, a force in vertical direction acts on the ASF 1. Therefore, even when the printer 101 is pushed out in substantially horizontal direction, the ASF 1 will never be displaced in horizontal direction. On the other hand, since the printer 101 is pushed out in substantially horizontal direction, it will never moves back toward installing direction by its own weight so that failure in withdrawal is not caused.

(Arrangement Relationship of Installation and Releasing of ASF and Printer and so on)

Figure 19:
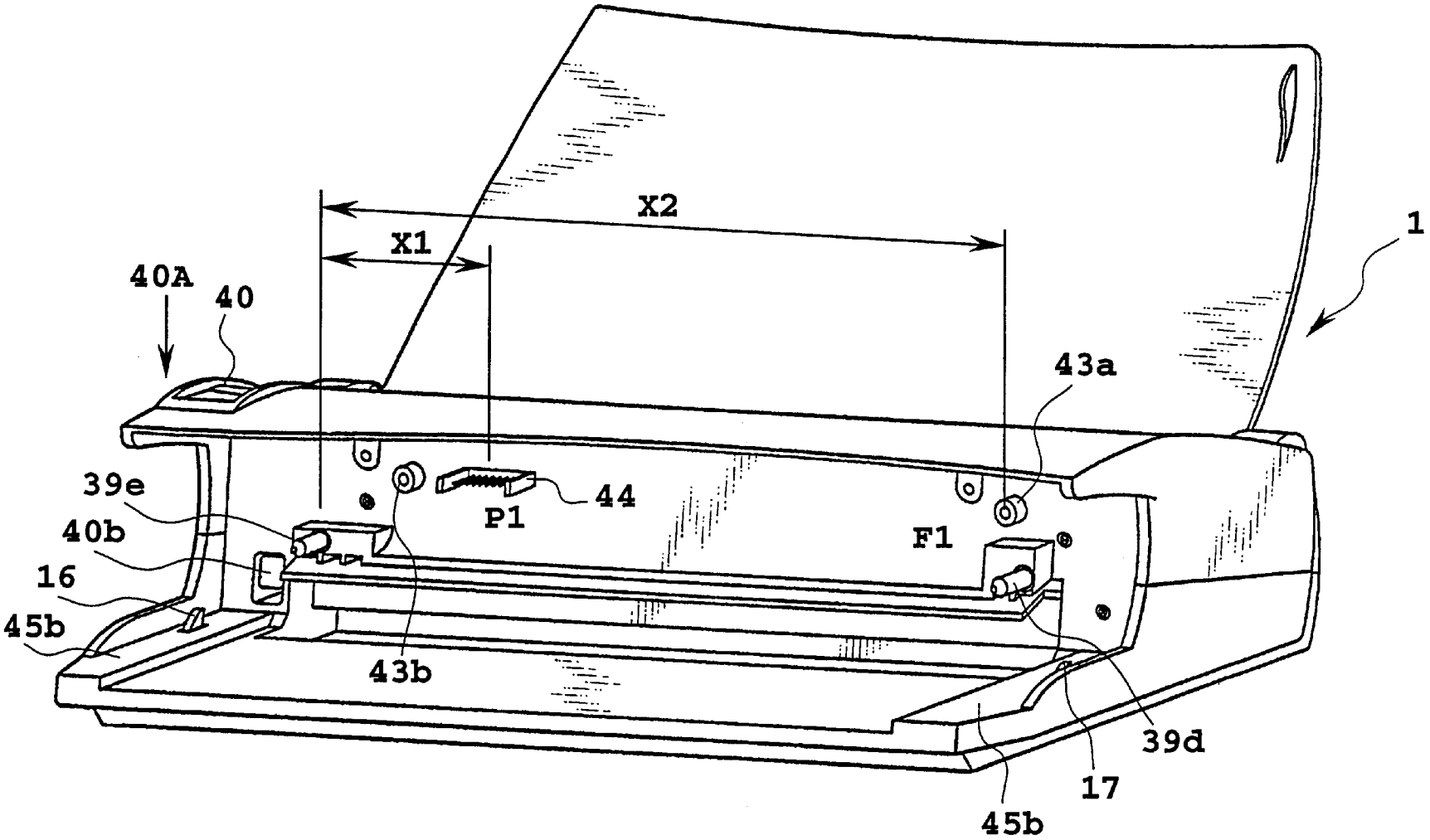
FIG. 19 is a perspective view for explaining arrangement and force relationship of the parts associated with installation and releasing in the automatic feeding apparatus in the first embodiment of the present invention.

FIG. 19 is an explanatory illustration showing arrangement relationship of the push lever 40, the pop-ups 43*a*, 43*b*, the positioning boss 39*d*, 39*e*, the hook (left side) 16, and the hook (right side) 17. On the other hand, FIGS. 20 to 23 are simplified top plan views of the printer 101.

The positioning bosses 39*d* and 39*e* of the printer 101 and the hooks 16 and 17 are provided in the vicinity of both end portions in the width direction of the printer 101. The ASF connector 44 is arranged between the positioning bosses 39*e* and 39*d*, and is positioned relatively near to the boss 39*e*. The push lever 40 and the pop-up 43*b* are arranged at a position away from the ASF connector 44 as viewed from the positioning boss 39*d*. In such construction, when the printer 101 is withdrawn from the ASF 101, the push lever 40 is pushed in the direction of arrow 40A. Therefore, the hooks 16 and 17 are released from the engaging holes 103*y* and 103*z* of the printer 101, and the pushing portion 40*b* of the push lever 40 is abutted onto the printer 101, so that the printer 101 is pushed out. By this, releasing of connection between the connectors 44 and 117, and releasing of engagement between the hooks 16 and 17 and the hook engaging holes 103*y* and 103*z* can be achieved.

The pop-ups 43*a* and 43*b* are auxiliary members for reducing pushing force to be exerted on the push lever 40 by the user, and are biased in a direction for pushing out the printer 101 by a not shown elastic member. In this construction, upon pushing out of the printer 101, the printer 101 is pushed out with sliding on the printer sliding portion 45*b* with taking the positioning bosses 39*d* and 39*e* as pivots. The positioning hole 118*a* engaging with the positioning boss 39*d* is provided with the printer 101, and is formed into a circular hole. The positioning hole 118*b* engaging with the positioning boss 39*e* is provided with the printer 101, and is formed into an elongated hole.

Figure 20:
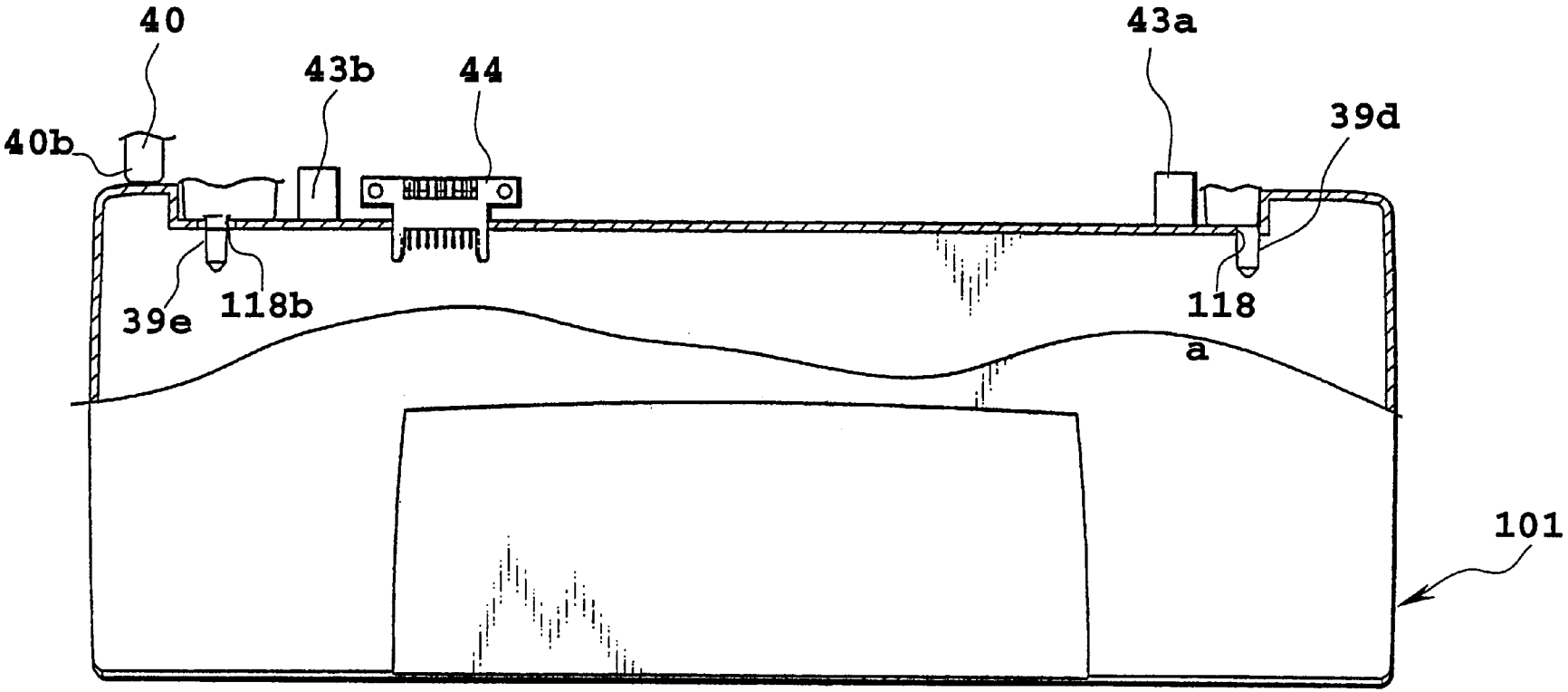
FIG. 20 is a section of the major part for explaining an installation and releasing mechanism in the printing apparatus and the automatic feeding apparatus in the first embodiment of the present invention.
Figure 21:
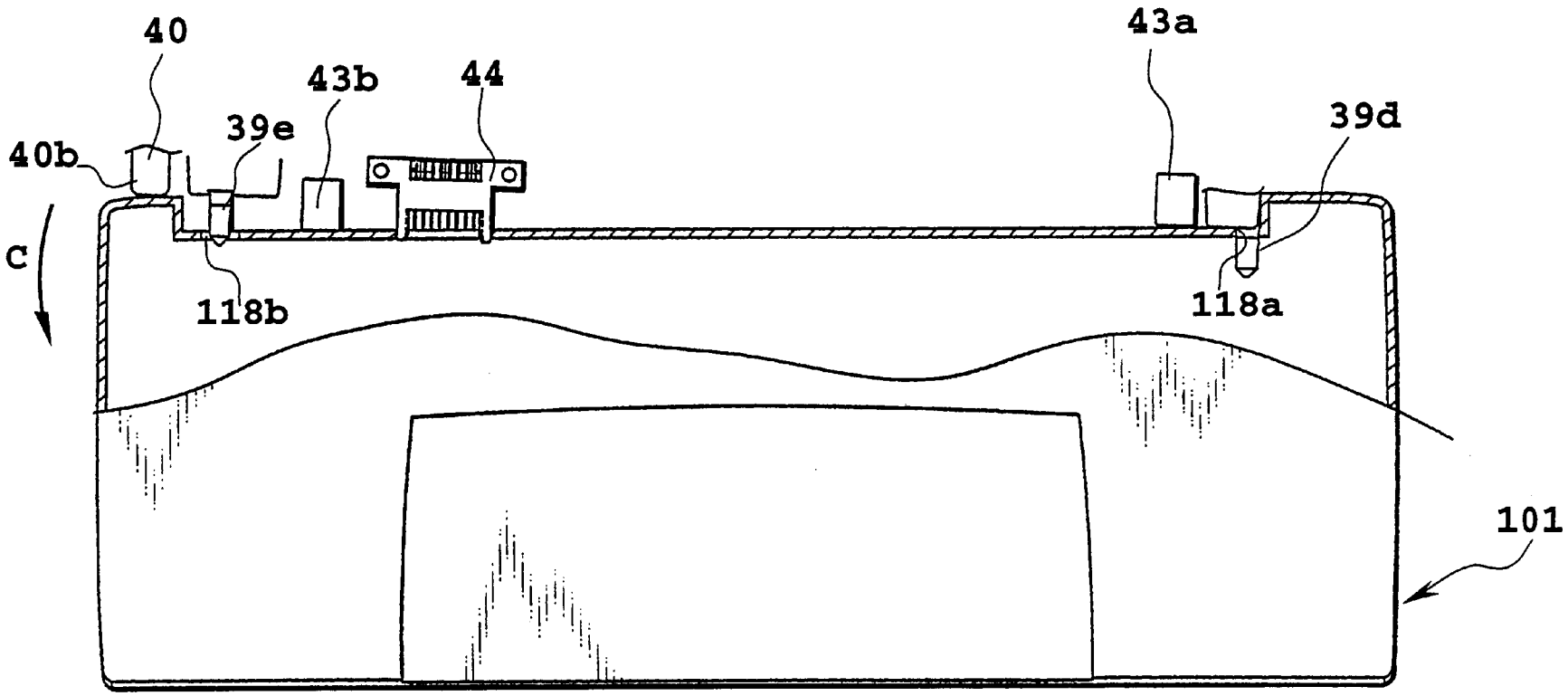
FIG. 21 is a section of the major part for explaining an installation and releasing mechanism in the printing apparatus and the automatic feeding apparatus in the first embodiment of the present invention.

Here, in a condition shown in FIG. 20, when the printer 101 is to be withdrawn from the ASF 1 with taking the positioning boss 39*d* as a pivot, a positional relationship between the printer 101 and the ASF 1 is shown in FIG. 21. However, in the condition shown in FIG. 21, biting is caused between the positioning boss 39*d* and the positioning hole 118*a*, so that it is made to be impossible to move the printer 101 only by the pushing force from the pop-up 43*a*. On the other hand, when the user attempts to forcedly withdraw the printer 101 from the ASF 1, the positioning boss 39*d* is deformed and broken.

Then, in the shown construction, before pushing out the printer 101 by the push lever 40 and the pop-up 43*b*, the engaging position between the positioning boss 39*d* and the positioning hole 118*a* serving as a pivot of the printer 101, is shifted in the disconnecting direction of the connectors 44 and 117 by the pushing force from the pop-up 43*a*. By this, biting between the positioning boss and the positioning hole can be successfully prevented.

Namely, in the arrangement relationship shown in FIG. 19, by a pushing force from the pop-up 43*a*, a necessary force F1 for pushing out the printer 101 with taking the positioning boss 39*a* as the pivot is expressed as follow:

$$F1>(X1/X2)\times P1+P2$$

wherein F1 is a pushing out force to be exerted on the printer 101 by the pop-up 43*a*, P1 is a force required for disconnection of the connectors, P2 is a friction force between the printer 101 and the printer sliding surface 45*b*, X1 is a distance from the positioning boss 39*e* as the pivot to the connector 44 and X2 is a distance from the positioning boss 39*e* as the pivot to the pop-up 43*a*.

As can be clear from the foregoing expression, at greater distance between the pop-up 43*a* and the ASF connector 44, namely, at smaller value of (X1/X2), the pushing out force F1 from the pop-up 43*a* can be set smaller. The pushing out force F1 from the pop-up 43*a* acts as a reaction force upon installation of the printer 101 into the ASF 1. In general, considering that the force required for withdrawal of connector is 1 to 2 kgf, the value of (X1/X2) of less than or equal to 0.5 is proper.

Furthermore, the height of the claw portion 17*a* of the hook (right side) 17 is set to be lower than the height of the claw portion of the hook (left side) 16. Accordingly, a timing where the hook (left side) 16 is released from the hook engaging hole 103*y* of the printer 101 is earlier than a timing where the hook (right side) 17 is released from the hook engaging hole 103*z*.

Figure 22:
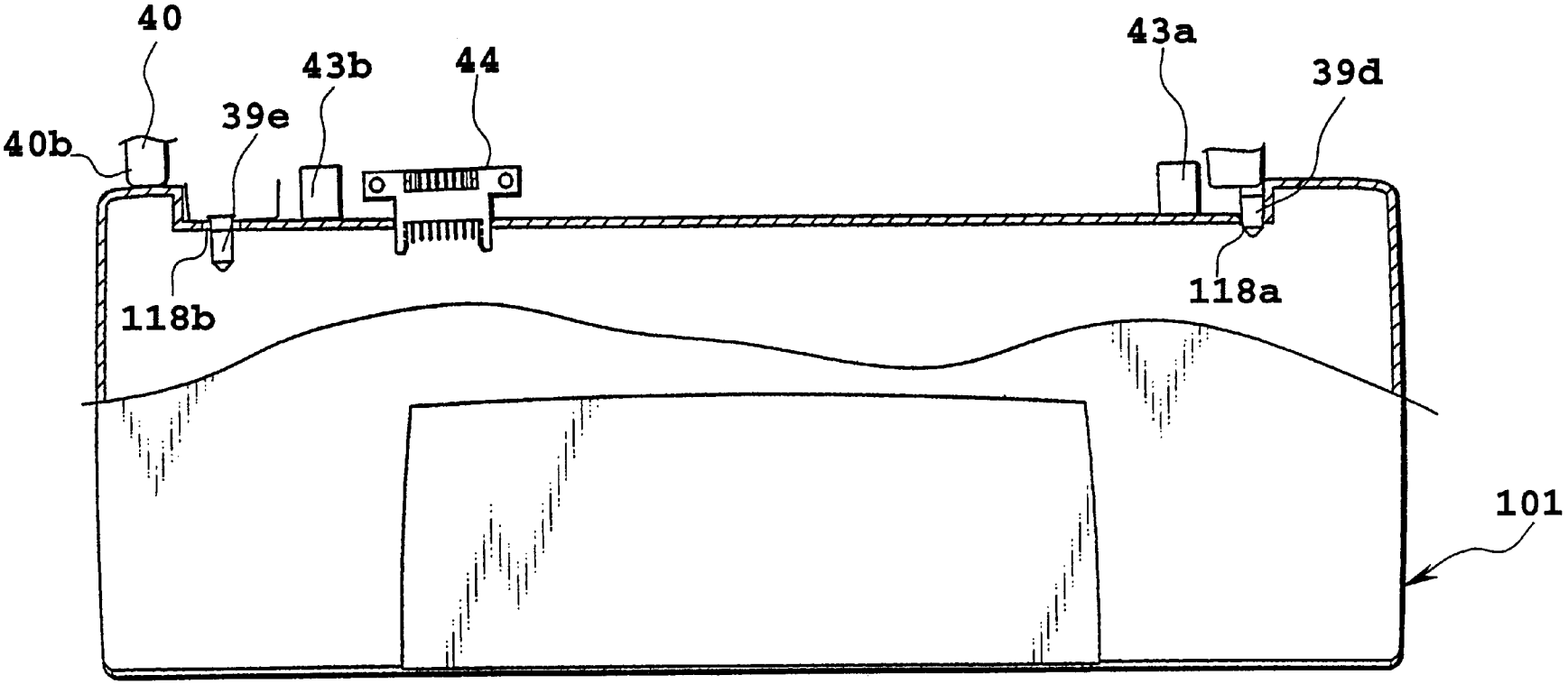
FIG. 22 is a section of the major part for explaining an installation and releasing mechanism in the printing apparatus and the automatic feeding apparatus in the first embodiment of the present invention.
Figure 23:
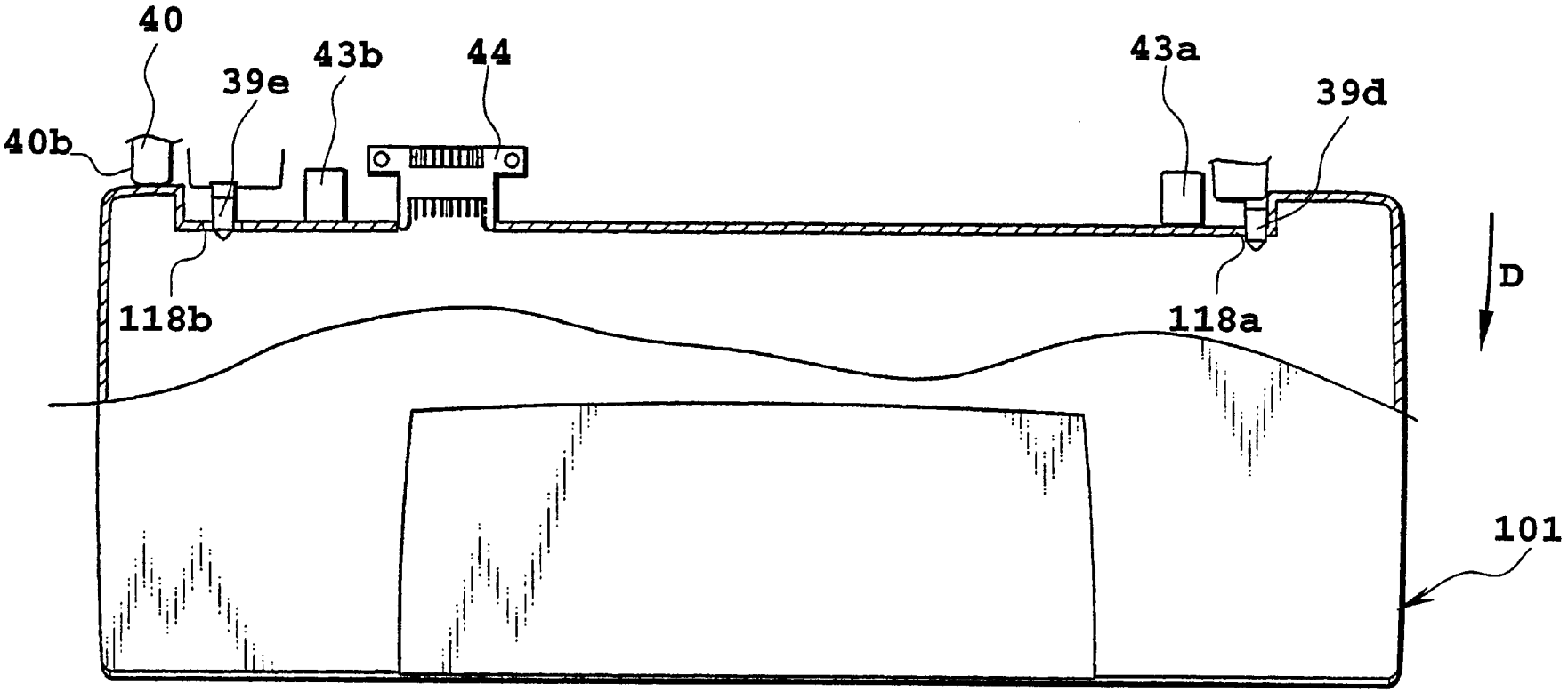
FIG. 23 is a section of the major part for explaining an installation and releasing mechanism in the printing apparatus and the automatic feeding apparatus in the first embodiment of the present invention.

By this, the printer 101 is pivoted with taking the positioning boss 39*e* as the pivot by the pushing force of the pop-up 43*a* as shown in FIG. 22, at a moment where engagement between the hook (right side) 17 and the hook engaging hole 103*z* is released, so that movement of the positioning boss 39*d* and the positioning hole 118*a* is away from each other in disconnecting direction of the connectors 44 and 117. Thereafter, after releasing engagement between the hook (left side) 16 and the hook engaging hole 103*y* of the printer 101, the printer 101 is pushed out by the push lever 40 and the popup 43*b*, as shown in FIG. 23. As a result, in a condition where biting between the positioning bosses 39*a* and 39*b* and the positioning holes 118*a* and 118*b* has not occurred, the printer 101 can be removed from the ASF 1.

Here, assuming that the push lever 40 and the pop-up 43*b* are arranged between the positioning boss 39*d* and the ASF connector 44, if a connection holding force between the connectors 44 and 117 is large, the connector 44 may serve as pivot of the printer 101. Therefore, biting can be caused between the positioning boss 39*d* and the positioning hole 118*a* in circular hole engagement, so that concern for deformation and breakage of the bitten boss 39*d* is raised. Thus, the push lever 40 and the pop-up 43*b* are required to be arranged at a position away from the ASF connector 44 as viewed from the positioning boss 39*d* as the pivot of the printer 101.

(Control Portion)

Figure 24:
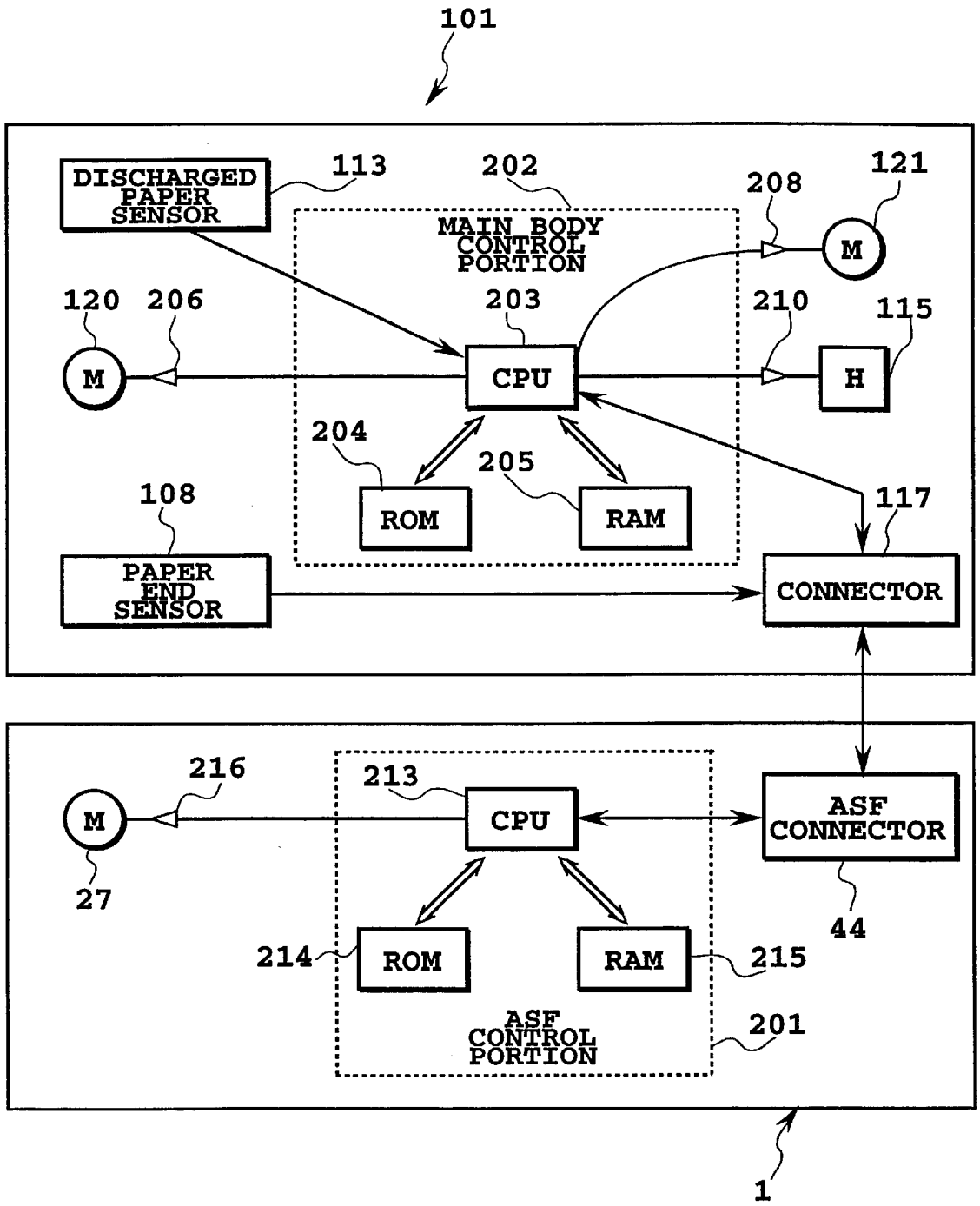
FIG. 24 is a block diagram of the first embodiment of the printing apparatus and the automatic feeding apparatus according to the present invention.

FIG. 24 is a block diagram of a main body control portion 202 of the printer 101 and a control portion 201 of an external ASF 1.

The main body control portion 202 for controlling the printer 101 is arranged on a main body substrate 123 shown in FIG. 4, and has a microcomputer, in which CPU 203, ROM 204 and RAM 205 are connected by a bus. When the printer 101 performs printing, the main body control portion 202 performs the following function according to a main body control program stored in ROM 204. At first, when a carriage motor 121 for moving a not shown carriage is driven via a motor driver 208, printing is performed for one line on the sheet by driving a printing head 115 mounted on the not shown carriage. The printing head 115 is driven via a head driver 210. Thereafter, a paper feeder motor 120 is driven via a motor driver 260 by the main body control portion 202, so that the sheet is fed for a predetermined amount. Subsequently, the carriage motor 121 and the printing head 115 are driven to perform printing for one line. Then, by repeating printing and sheet feeding, printing for the sheet is completed.

The reference numeral 117 denotes the connector which serves for externally outputting an instruction signal from CPU 203 of the main body control portion, and serves for inputting an external response signal to CPU 203. Therefore, the connector 117 serves as a communication port for bidirectional communication. The connector 117 can also perform power supply to an external unit. The reference numeral 108 denotes a paper end sensor incorporated within a printer main body. The paper end sensor has an optical switch or a mechanical switch. When the sheet 200 is inserted into the printer main body, an output voltage of the paper end sensor 108 transits from "LOW" condition to "HIGH" condition. On the other hand, the reference numeral 113 denotes a discharge paper sensor having a similar function to the paper end sensor 108. When a residual sheet is present within the main body of the printer after image printing, the output voltage of the discharge paper sensor 113 becomes "HIGH" condition. The output voltages of the paper end sensor 108 and the discharged paper sensor 113 can be monitored by CPU 203, and the output voltage of the paper end sensor 108 can perform direct external output via the connector 117.

The ASF control portion 201 controlling the external ASF 1 has a microcomputer, in which CPU 213, ROM 214 and RAM 215 are connected by a bus. CPU 213 drives a paper feeder motor 27 via a motor driver 216 on the basis of an ASF control program stored in ROM 214. The reference numeral 44 denotes the ASF connector which receives a signal from external unit, such as the printer 101 and outputs a signal from CPU 213 of the ASF control portion 201. Thus, the ASF connector 44 serves as a communication port permitting bidirectional communication.

(Communication Port Portion)

Figure 35:
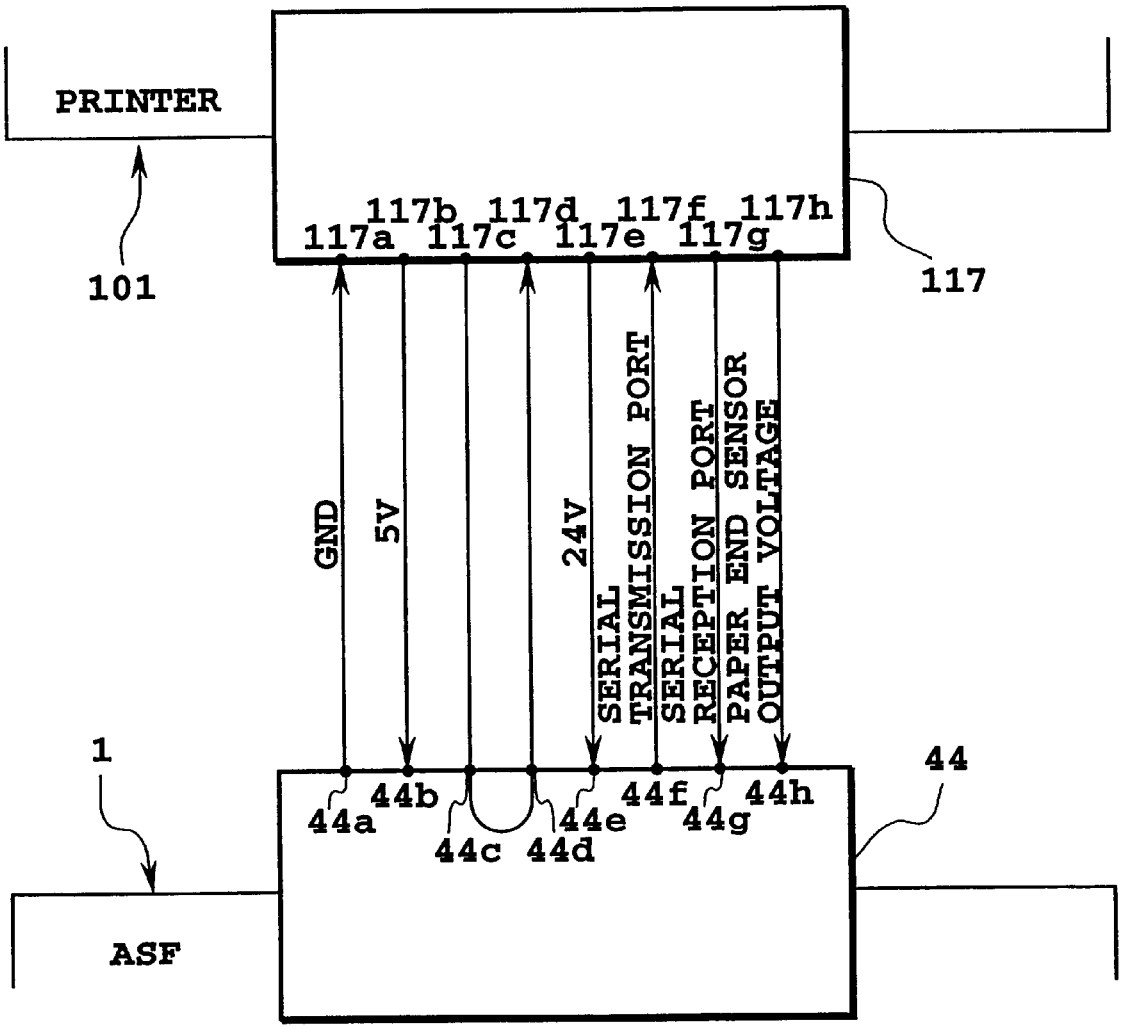
FIG. 35 is a diagrammatic illustration of a connecting portion between the printing apparatus and the automatic feeding apparatus in the second embodiment of the present invention.

FIG. 35 diagrammatically shows a detailed construction of the connector 117 and the ASF connector 44.

The connector 117 and the ASF connector 44 respectively have eight ports 117*a* to 117*h* and 44*a* to 44*h*. When the ASF 1 is relatively installed within the printer 101, ports having the corresponding Arabic characters are electrically connected. Ports 44*a* and 117*a* form a GND line, ports 44*b* and 117*b* form a 5V power source line for a signal, ports 44*e* and 117*e* form a 24V power source line for driving the paper feeder motor 27. On the other hand, the port 44*f* is a transmission port for transmitting a signal to the port 117*f*, the port 44*g* is a reception port for receiving a signal from the port 117*g*, and the port 44*h* is a port receiving the output voltage of the paper end sensor 108 from the port 117*h*. It should be noted that since the ports 44*c* and 44*d* are shorted, it becomes possible to recognize whether a unit is externally connected or not utilizing the ports 117*c* and 117*d* on the side of the printer 101.

(ASF Separating and Transporting Mechanism Portion)

FIG. 25 is section for showing a condition where the external ASF 1 is relatively installed within the printer 101.

The reference numeral 19 denotes the paper feeder roller for feeding the sheet 200. On the paper feeder roller 19, the paper feeding rubber 23 is fitted. When the paper feeder roller 19 is rotated, the sheet 200 is transported by a friction force of the paper feeding rubber 23. The reference numeral 26 denotes the pressure plate, on which the sheets 200 is stacked. Both ends on the upstream side in the sheet transporting direction of the pressure plate 26 are pivoted on the ASF chassis 11. The pressure plate 26 is biased in a direction of the paper feeding rubber 23 by the pressure plate spring 13. In the initial state, a cam portion 19*c* provided on both ends of the paper feeder roller 19 and the cam portion 26*a* provided on both ends of the pressure plate 26 are contacted, so that the paper feeding roller 23 and the pressure plate 26 are separated away from each other to permit smooth setting of the sheets 200. The ridge 36 has an abutting surface 36*a* positioned on an extension of a sheet transporting direction. The sheet 200 is set with abutting the tip end onto the abutting surface 36*a*. On the abutting surface 36*a*, a ridge sheet 37 as sheet separating member is provided. The ridge sheet 37 is a sheet formed of an elastic body, such as a plastic film and has a function for separating the sheets 200 one by one using elastic force caused upon deflection.

A distance between the abutting surface 36*a* and the paper end sensor 108 is set to be greater than a transporting amount of the sheet 200 when the paper feeder roller 19 makes one revolution, and set to be smaller than a transporting amount of the sheet 200 when the paper feeder roller 19 makes two revolutions.

(Printer Transporting Mechanism and Printing Mechanism)

Next, explanation will be given for a transporting mechanism portion and a printing mechanism portion of the printer 101 in FIG. 25.

The reference numeral 109 denotes an LF roller for transporting the sheet 200. The LF roller 109 forms a coat layer of a material having high friction coefficient, such as urethane resin, on the surface of a metal pipe. The LF roller 109 is rotatingly driven by a paper feeder motor 120 shown in FIG. 25 and transports the sheet 200 by gripping the sheet 200 in cooperation with the pinch roller 110. The reference numeral 115 denotes the printing head for printing an image on the sheet 200 transported by the LF roller 109, which printing head 115 is mounted on the not shown carriage reciprocally movable in the longitudinal direction of the LF roller 109. The printing head 115 is reciprocally movable in a paper width direction (a direction from surface to back in the sheet surface of the drawing in FIG. 25), together with the carriage driven by the carriage motor 121 in FIG. 25.

The spur 111 and the paper discharging roller 112 are located on the downstream side of the LF roller 109 and the printing head 115 in the sheet transporting direction. The spur 111 and the paper discharging roller 112 form roller pairs of two sets for transporting the sheet 200 image printing is completed. The paper discharging roller 112 is coupled with the LF roller 109 via a not shown drive transmission member. The paper discharging roller 112 transports the sheet 200 in the same direction as the transporting direction by the LF roller 109, with the LF roller 109 as a driving source. In the sheet transporting direction, on the paper path of the upstream side from the LF roller 109, the paper end sensor 108 is provided. On the other hand, between two sets of the paper discharging rollers 112, 112, the discharged paper sensor 113 is provided. These sensors 108 and 109 transit the output voltage from "LOW" condition to "HIGH" condition in response to the sheet 200 moving thereacross.

(ASF Driving Mechanism Portion)

Figure 26:
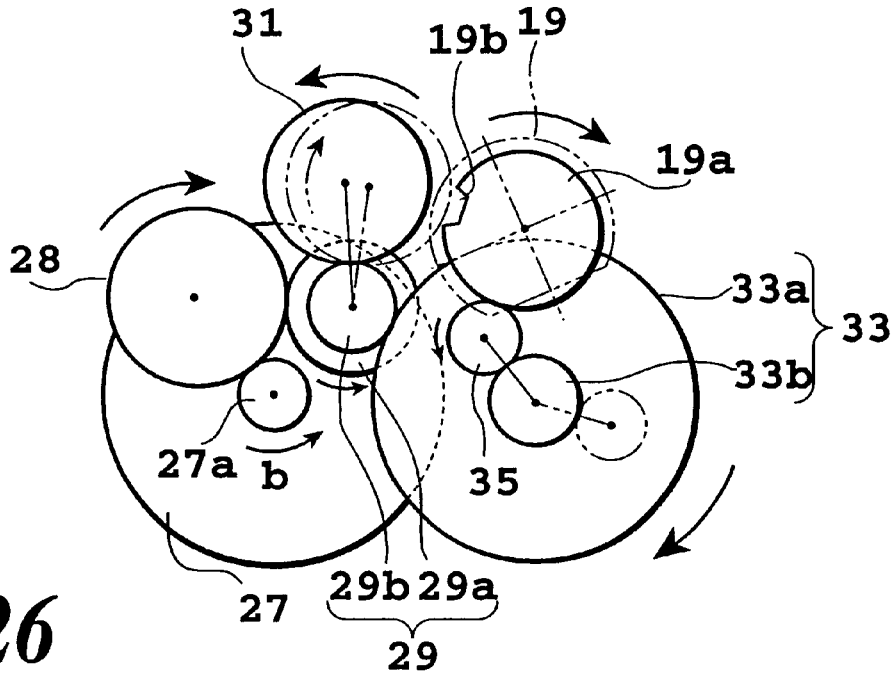
FIG. 26 is a diagrammatic illustration for explaining operation of a drive mechanism portion of the first embodiment of the automatic feeding apparatus according to the present invention.
Figure 27:
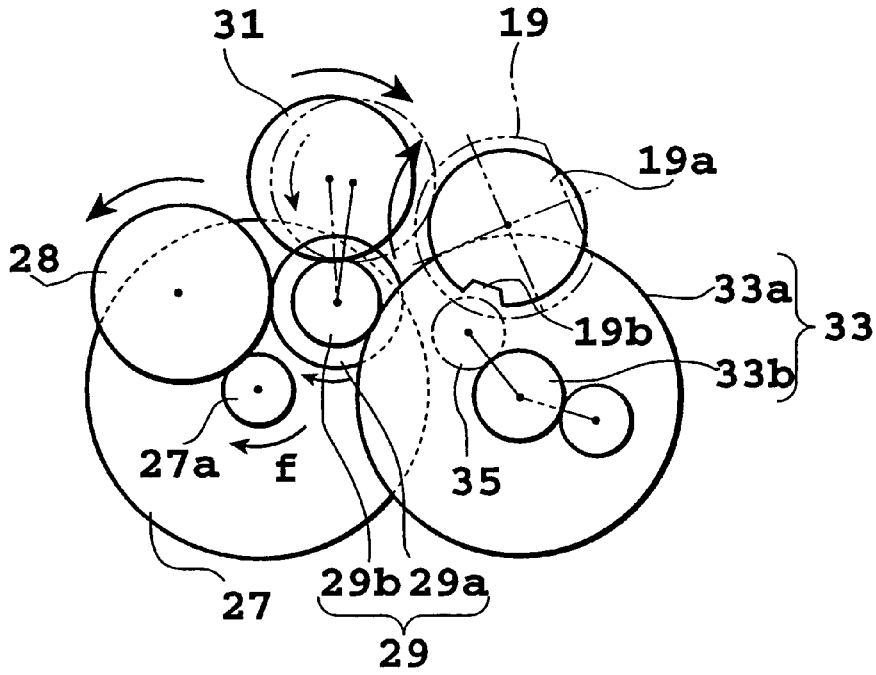
FIG. 27 is a diagrammatic illustration for explaining operation of a drive mechanism portion of the first embodiment of the automatic feeding apparatus according to the present invention.

A driving mechanism of the external ASF 1 is shown in FIGS. 26 and 27. The paper feeder motor 27 is a stepping motor which can be driven for revolution in forward and reverse directions. The reference numeral 28 denotes an idler gear which is meshed with a motor gear 27*a* of the paper feeder motor 27. The reference numeral 29 denotes an ASF double gear having two stage gears 29*a* and 29*b* having different large and small diameters. The large diameter gear 29*a* is meshed with the idler gear 28. The reference numeral 31 denotes a forward planetary gear, and is meshed with a small diameter gear 29*b* of the ASF double gear 29 to move around the ASF double gear 29. The reference numeral 33 denotes a reverse sun gear having two stage gears 33*a* and 33*b* having different large and small diameters. The large diameter gear 33*a* of the reverse sun gear 33 is meshed with the small gear 29*b* of the ASF double gear 28. The reference numeral 35 denotes a reverse planetary gear which is meshed with the small gear 33*b* of the reverse sun gear 33 to move around the reverse sun gear 33. The reference numeral 19*a* denotes a paper feeder roller gear provided on an axial end of the paper feeder roller 19 and has a teeth-less recessed portion 19*b*. The paper feeder gear 19*a* is located on a trace of orbital motion of the forward planetary gear 31 and the reverse planetary gear 35 and arranged for meshing with these gears 31 and 35.

In FIG. 26, when the paper feeder motor 27 is driven to rotate (reverse drive) in the direction of arrow b, respective gears rotate in the directions of the arrows, respectively. Namely, the reverse planetary gear 35 causes orbital motion in the clockwise direction toward the position illustrated by solid line from the position illustrated by twodotted line in FIG. 26, around the small diameter gear 33 of the reverse sun gear 33, via the idle gear 28 and the ASF double gear 29, to mesh with the paper feeder roller gear 19*a*. By this, the paper feeder roller 19 is driven to rotate in the direction of the arrow in the clockwise direction (the direction for feeding the sheet 200 stacked on the pressure plate 26 to the printer 101). The paper feeder roller gear 19*a* meshing and rotating with the reverse planetary gear 35 is released from meshing engagement with the reverse planetary gear 35 when the teeth-less recessed portion 19*b* is rotated to the position opposing to the reverse planetary gear 35. Therefore, the paper feeder roller gear 19*a* is prevented from further rotation even when the paper feeder motor 27 is driven in the reverse direction. At this time, the forward planetary gear 31 causes orbital motion in counterclockwise direction toward the position illustrated by solid line from the position illustrated by two-dotted line in FIG. 26, to stop by abutting onto a not shown stopper. Therefore, it does not influence rotation of the paper feeder roller 19.

Next, in FIG. 27, when the paper feeder motor 27 is driven to rotate (forward drive) in the direction of arrow f, respective gears are rotated in the direction of arrows in FIG. 27. Namely, the forward planetary gear 31 causes orbital motion from the position illustrated by two-dotted line in FIG. 27 to the position illustrated by the solid line in the clockwise direction around the small diameter gear 29*b* of the ASF double gear 29, via the idle gear 28 and the ASF double gear 29, to mesh with the paper feeder gear 19*a*. By this, the paper feeder roller 19 is rotated in clockwise direction as shown by the arrow (the direction for feeding the sheet 200 on the pressure plate 26 to the printer 101). The paper feeder roller 19*a* meshing and rotating with the forward planetary gear 31 is released from meshing with the forward planetary gear 31 when the teeth-less recessed portion 19*b* is rotated to the position opposing the forward planetary gear 31. Therefore, the paper feeder roller 19*a* is prevented from further rotation even when the paper feeder motor 27 is driven in forward direction. At this time, the reverse planetary gear 33 causes orbital motion from the position shown by two-dotted line in FIG. 27 to the position shown by the solid line in the counterclockwise direction to stop by abutting onto a not shown stopper. Therefore, it does not influence rotation of the paper feeder roller 19.

Furthermore, when the teeth-less recessed portion 19*b* of the paper feeder roller gear 19*a* opposes the forward planetary gear 31, the cam portion 19*c* of the paper feeder roller 19 meshes with the cam portion 26*a* of the pressure plate 26, to be the same phase as the initial state. Thus, the pressure plate 26 is placed away from the paper feeder rubber 23. Accordingly, when the paper feeder motor 27 is driven for continuous rotation in the forward direction, the pressure plate 26 is held in a condition away from the paper feeder rubber 23 by meshing of the paper feeder roller cam portion 19*c* and the pressure plate cam portion 26*a*, to stop rotation of the paper feeder roller 19 at the phase the same as the initial state. Subsequently, both of the forward planetary gear 33 and the reverse planetary gear 35 idle at the positions shown by the solid lines in FIG. 27, to be stable in the condition not transmitting rotation to the paper feeder roller 19.

(Paper Feeding Operation and Printing Operation (Printer Side))

Next, explanation will be given for operation for feeding, transporting and discharging after printing of the sheet 200 by the printer 101 and the ASF 1.

Figure 28:
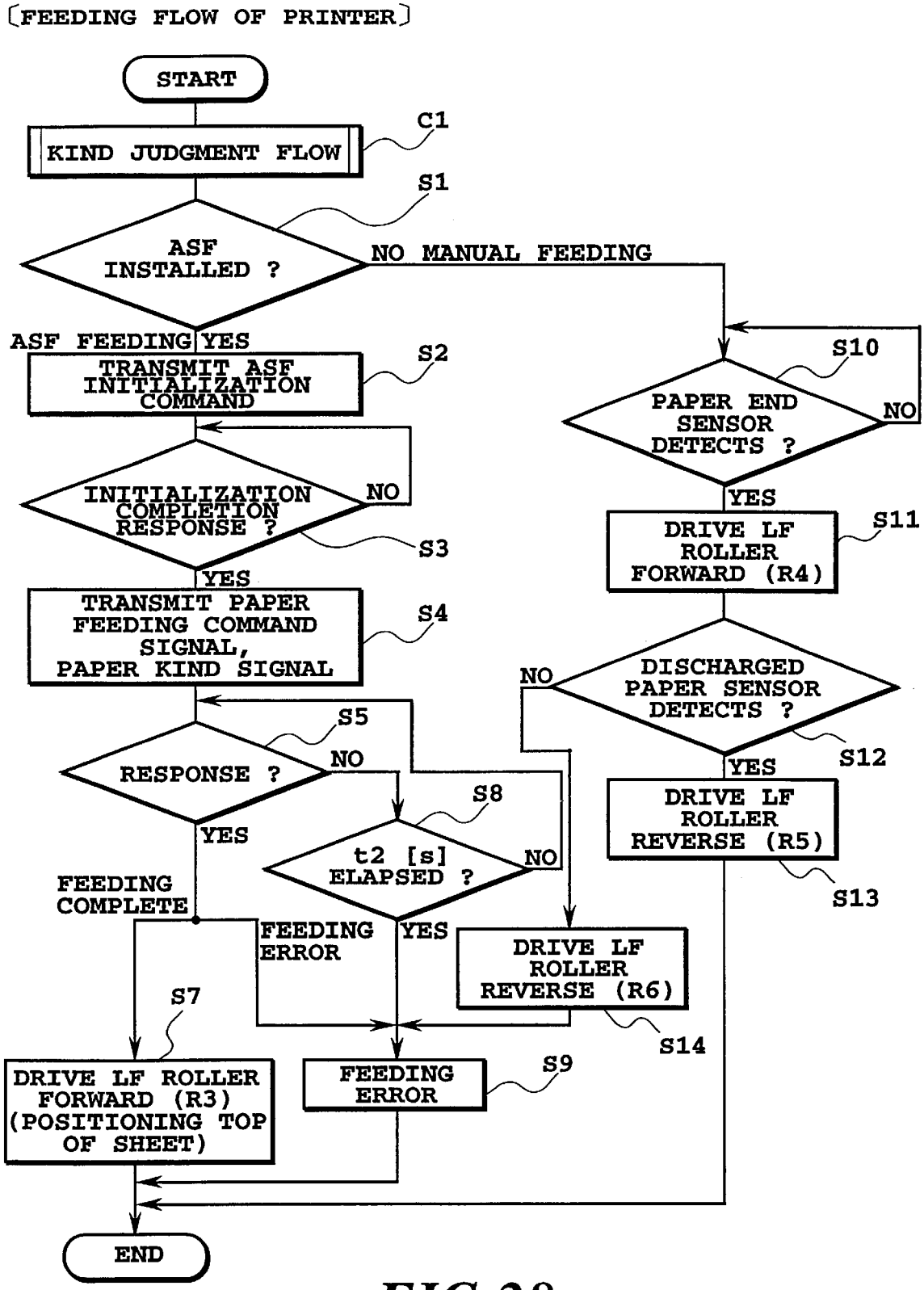
FIG. 28 is a flowchart for explaining feeding operation in the first embodiment of the printing apparatus according to the present invention.

The printer 101 is responsive to receive a printing instruction from the external information unit, such as a computer. Namely, the printer 101 performs paper feeding operation, at first, and then performs printing operation. FIG. 28 is a flowchart for explaining the paper feeding operation of the printer 101.

At first, the main body control portion 202 of the printer 101 executes a sub-routine C1. The subroutine C1 is to perform judgment of kind of the unit externally connected to the printer 101 via the ports 117*f* and 117*g* shown in FIG. 35. A detail of the shown sub-routine C1 will be explained with reference to FIG. 32.

Next, a process is advanced to step S1. When a result of judgment by the sub-routine C1 indicates installation of the ASF 1 to the printer 101, the process is advanced to step S2 since the paper feeding mode becomes ASF feeding mode. At step S2, the main body control portion 202 transmits an initialization command signal to the ASF 1. Then, process is advanced to step S3. At step S3, a response signal indicative of completion of initialization from the ASF 1 is awaited. In response to the response signal, the process is advanced to step S4. At step S4, the main body control portion 202 transmits a paper feeding command signal and a paper kind signal indicative of a kind of the sheet (plain paper, coated paper, postcard, glossy film and the like). Then, the process is advanced to step S5.

At step S5, while the response signal is not received from the ASF 1, the process is advanced to step S8. At step S8, if a predetermined time limit t2 is not yet expired, the process is returned to step S5. On the other hand, when the time limit t2 from initiation of paper feeding is expired, the process is advanced to step S9. At step S9, paper feeding operation is terminated with outputting a paper feeding error indicative alarm by the main body control portion 202.

At step S5, when the response signal is received from the ASF 1 and the received response signal is a signal indicative of completion of paper feeding, the process is advanced to step S7. Step S7 is a step for performing so-called positioning top of the sheet 200. At this step S7, the main body control portion 202 drives the paper feeder motor 120 to rotate the LF roller 108 for a predetermined amount R3 in the sheet transporting direction (forward direction) upon printing. Therefore, paper feeding operation is terminated. The predetermined amount R3 is set so that the tip end portion of the sheet 200 does not reach to a sheet detectable range of the discharged paper sensor 113, but the tip end portion of the sheet 200 is placed underneath the printing head 115. Accordingly, when the printer 101 initiates printing on the sheet 200, it becomes unnecessary to backwardly feed the sheet 200 toward the upstream side in the sheet transporting direction. Thus, the rear end of the sheet 200 will never collide onto the component within the ASF 1, so that holding or mis-feed of the sheet 200 is prevented.

On the other hand, at step S5, when the response signal from the ASF 1 is present and the response signal is indicative of paper feeding error, the process is advanced to step S9. Then, the main body control portion 202 terminates the paper feeding operation with issuing of a paper feeding error alarm.

At step S1, when the result of judgment by the sub-routine C1 is that the ASF 1 is not installed to the printer 101, the process is advanced to step S10 since the paper feeding mode becomes a manual feeding mode. At step S10, detection of the sheet 200 by the paper end sensor 108 is awaited. When the user does not yet insert the sheet 200, the paper end sensor 108 does not detect the sheet 200 and the output voltage thereof is maintained at "LOW" condition". When the user inserts the sheet 200 into the printer 101 and the sheet 200 abuts LF roller 109, the output voltage of the paper end sensor 108 becomes "HIGH" level, so that the sheet 200 is detected. Then, process is advanced to step S11. At step S11, the main body control portion 202 drives the paper feeder motor 120 via the paper feeder motor driver 206 so as to drive the LF roller 109 for a predetermined amount R4 in the forward direction (rotating direction for transporting the sheet 200 in the sheet transporting direction upon printing). The predetermined amount R4 is set so that the tip end of the sheet 200 falls within the sheet detectable region of the discharged paper sensor 113.

Next, the process is advanced to step S12. If the discharged paper sensor 113 detects the sheet 200, judgment is made that paper feeding is successful. Then, process is advanced to step S13. At step S13, the main body control portion 202 drives the paper feeder motor 120 via the paper feeder motor driver 206, so that the LF roller 109 is rotated for a predetermined amount R5 in the reverse direction (rotating direction for transporting the sheet 200 in the direction opposite to the sheet transporting direction upon printing). The predetermined amount R5 is set for returning the sheet 200 transmitted into the sheet detectable range of the discharged paper sensor 113 to the printing start position, and is set for the tip end of the sheet 200 to never come out from the position between the LF roller 109 and the pinch roller 110.

On the other hand, at step S12, if the discharged paper sensor 113 does not detect the sheet 200, for example, if the sheet 200 is not property gripped between the LF roller 109 and the pinch roller 110 because abutment force to the LF roller is insufficient, or if the tip end of the sheet 200 does not reach the sheet detectable range of the discharged paper sensor 113 even after transportation for the predetermined amount R4 because oblique abutment of the sheet 200 onto the LF roller 108 is caused, the main body control portion 202 makes judgment that manual paper feeding is in failure. Then, the process is advanced to step S14. At step S14, the main body control portion 202 drives the paper feeder motor 120 via the paper feeder motor driver 206, so that the LF roller 109 is driven for a predetermined amount R6 in the reverse direction. The predetermined amount R6 is set for pulling back the sheet 200 transported to the sheet detectable range of the discharged paper sensor 113, so that the tip end of the sheet 200 is withdrawn from the position between the LF roller 109 and the pinch roller 110.

Upon manual paper feeding, by making judgment whether the discharged paper sensor 113 detects the sheet 200 or not, proper paper feeding can be confirmed. Furthermore, upon failure of paper feeding, the sheet 200 is fed back to the position where the sheet 200 is not gripped by the LF roller 109, so that sheet 200 can be easily removed to permit manual paper feeding again.

Upon manual paper feeding, different from ASF feeding, a component, on which the paper collides, is not present. Therefore, folding or mis-feeding of the sheet will never be caused when the sheet is transported backwardly.

As set forth above, after the printer 101 completes the paper feeding operation through the control flow shown in FIG. 28, printing operation is performed. The main body control portion 202 drives the carriage motor 121 via the motor driver 208, so that the not shown carriage linked to the carriage motor 121 is moved. In conjunction therewith, the printing head 115 mounted on the carriage is driven by the head driver 210 to perform printing for one line on the sheet 200. Subsequently, the main body control portion 202 drives the paper feeder motor 120 via the motor driver 206 for feeding the sheet 200 in amount corresponding to width of the printed one line. Then, one line is printed by driving the carriage motor 121 and the printing head 115. By repeating these operation, printing on the sheet 200 is completed. Once, printing for one sheet 200 is completed, the main body control portion 202 drives the LF roller 109 in forward direction by driving the paper feeder motor 120. By this, the paper discharging roller 112 is rotated for discharging the sheet 200 out of the printer 101.

(Paper Feeding Operation (ASF Side))

Figure 29:
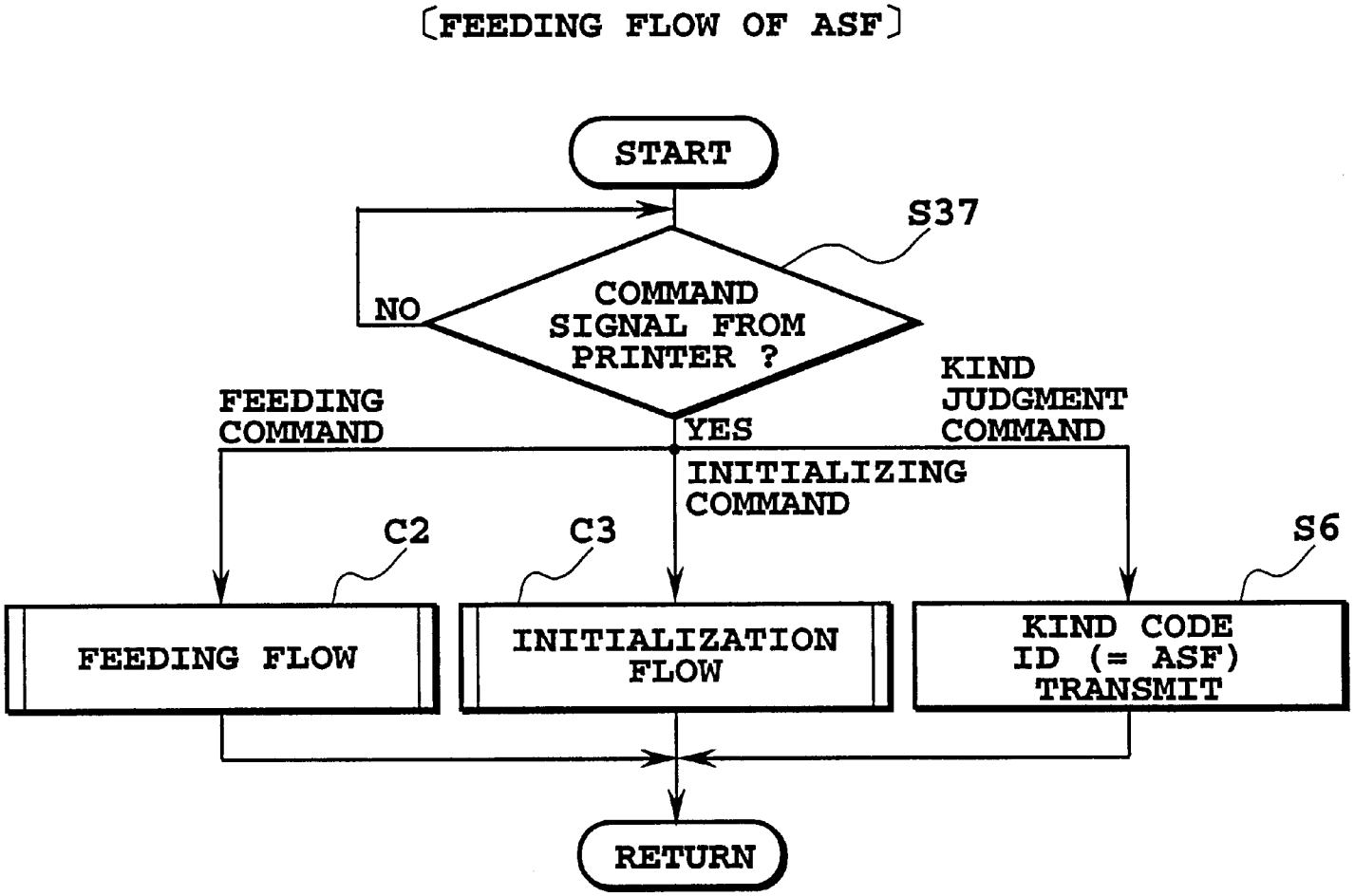
FIG. 29 is a flowchart for explaining a main control of the first embodiment of the automatic feeding apparatus according to the present invention.

FIG. 29 is a flowchart of main control in the ASF 1.

The control portion 201 of the ASF 1 is normally in waiting condition in the condition connected to the printer 101. At step S37, the command signal from the printer 101 is awaited. When the control portion 201 receives the command signal from the printer 101 through a serial receiving port 44*g* of FIG. 35, the process is advanced to the following sub-routine or step depending upon content of the command signal.

Namely, when the command signal from the printer 101 indicates "paper feeding instruction", the process is advanced to a sub-routine C2 controlling ASF paper feeding operation. When the command signal from the printer 101 indicates "initializing instruction", the process is advanced to a sub-routine C3 controlling initializing operation. When each sub-routine is completed, the process is returned to step S37 and again placed into stand-by state. On the other hand, when the command signal from the printer 101 indicates "kind judgment instruction", the process is advanced to step S6, so that the code ID indicative of the kind of the ASF 1 is transmitted to the printer 101 via the serial transmission port 44*f*. Again, the process is returned to step S37 and placed into stand-by state.

Among two sub-routines C2 and C3 set forth above, explanation will be given for the sub-routine C2 controlling the ASF paper feeding operation, at first. The sub-routine C3 controlling initializing operation will be explained in detail, later.

Figure 30:
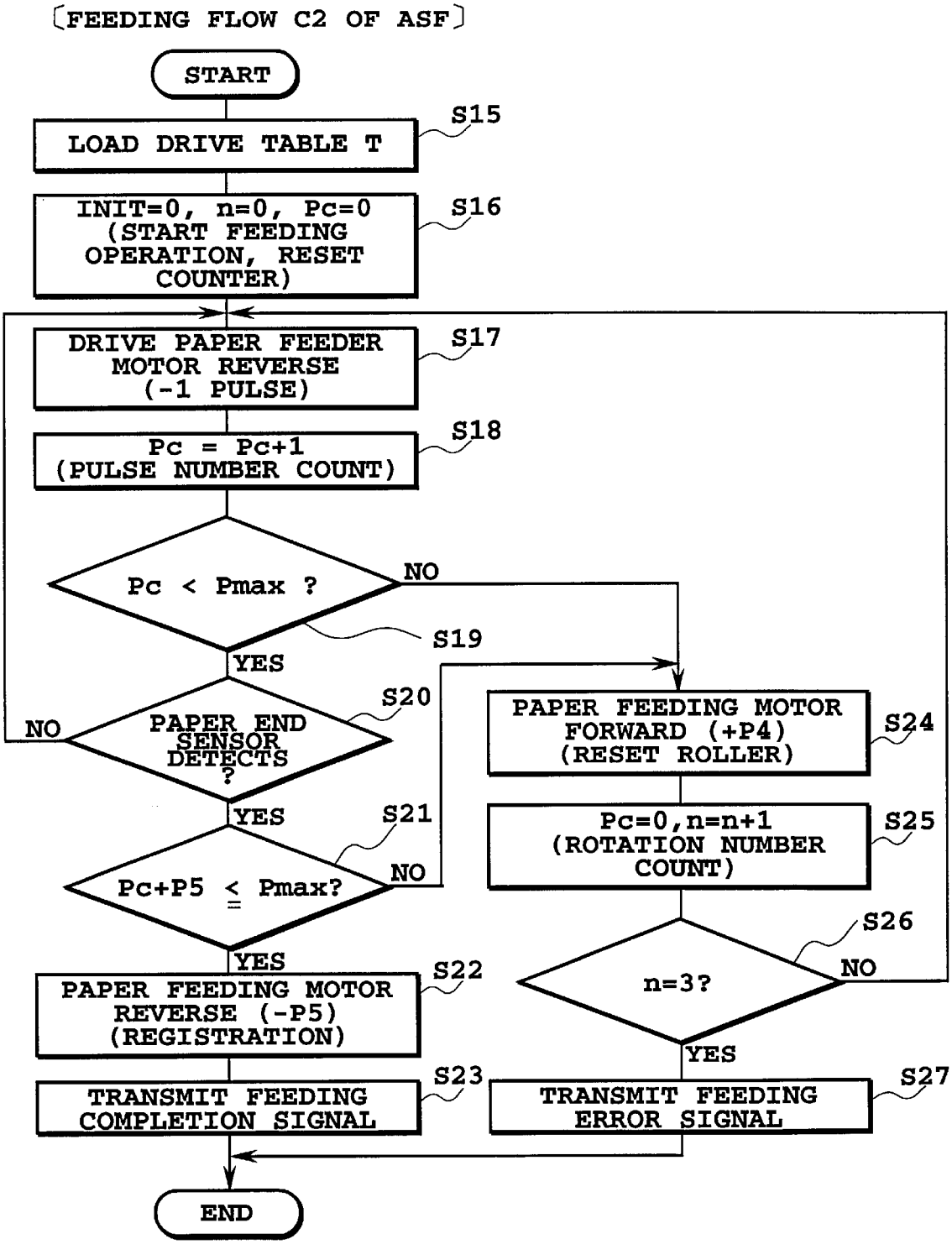
FIG. 30 is a flowchart for explaining feeding operation in the first embodiment of the automatic feeding apparatus according to the present invention.

FIG. 30 is an explanatory illustration of the sub-routine C2 performing paper feeding control operation in the ASF 1.

The ASF control portion 201 loads an optimal drive table T of the paper feeder motor 27 corresponding to kind of paper, to CPU 213 from ROM 214. The optimal drive table T is selected on the basis of paper kind information received with the paper feeding instruction signal from the printer 101. The drive table T contains information indicative of a driving speed of the paper feeding motor 27 which is the pulse motor, and number P5 of registration pulses for rotating the paper feeder roller 19. The number P5 of registration pulses is set to an optimal amount depending upon the kind of the paper. A plurality of kinds of drive tables T are provided depending upon characteristics of the expected sheet.

After loading the drive table T, the ASF control portion 201 sets initial values of respective parameters defined by "INIT", "n", "Pc" to "0", at step S16. Each parameter is stored in RAM 215, in which "INIT" is a flag indicating whether the phase of the rotating direction of the paper feeding roller 19 is in the initial position or not, "n"} is a rotation number counter indicative of how many times the paper feeder roller 19 is rotated from initiation of paper feeding flow C2, and "Pc" is a pulse number counter indicative of how many pulses to drive the paper feeding motor 27 in reverse direction.

Next, the process is advanced to step S17. At step S17, the ASF control portion 201 drives the paper feeding motor 27 via the motor driver 216 in the reverse direction for one pulse. Next, process is advanced to step S18 to count up the value of the pulse number counter "Pc" by one. Thereafter, the process is advanced to step S19. At step S19, the ASF control portion 201 compares the value of the pulse number counter "Pc" and an allowable pulse number Pmax. The allowable pulse number Pmax is the number of the drive pulses for the paper feeder roller 19. Namely, by the paper feeding motor 27 being driven on the basis of the allowable pulse number Pmax, the teeth-less recessed portion 19*b* of the paper roller gear 19*a* is placed in opposition to the reverse planetary gear 35 as set forth above, after initiation of reverse rotation of the paper feeding motor 27. Immediately after initiation of paper feeding, a relationship of Pc<Pmax is established. Then, the process is advanced to step S20. At step S20, the ASF control portion 201 makes judgment of the output voltage of the paper end sensor 108 within the printer 101 via the port 44*h* of FIG. 35. Immediately after initiation of the paper feeding operation, the sheet 200 does not reach inside of the printer 101. Thus, the output voltage of the paper end sensor 108 is held at "LOW" state. Therefore, the process is returned to step S17.

By repeating the foregoing steps S17 to S20, the reverse planetary gear 35 of FIG. 26 causes orbital motion from the position of the two-dotted line to the position of the solid line, so that the reverse planetary gear 35 is meshed with the paper feeder roller gear 19*a*. Then, the paper feeder roller 19 starts rotation. By the paper feeder roller 19 starting rotation from the initial position, the cam portion 19*c* of the paper feeder roller 19 is released from meshing with the cam portion 26*a* of the pressure plate 26. Therefore, the pressure plate 26 is raised by the pressure plate spring 13 so that the sheets 200 stacked on the pressure plate 26 are pressed to the paper feeding rubber 23. At this time, tip end portion of the sheet, which is set with abutting the tip end onto the abutting surface 36*a* of the ridge 36, is also raised to contact with the vicinity of the center portion of the ridge sheet 37.

By further repeating the foregoing steps S17 to S20, the paper feeder roller 19 is rotated by continuous rotation in the reverse direction, so that the feeding of the sheet 200 is started by friction force of the paper feeding rubber 23. Then, only one sheet 200 is separated from the sheets stacked therebelow by a reaction force which is generated by deflecting the ridge sheet 37 of the elastic body. The ridge sheet 37 is deflected by the tip end portion of the sheet 200.

Then, by continuing reverse driving of the paper feeder motor 27 to destroy the relationship of Pc<Pmax, the process is branched at step S19 and advanced to step S24. At step S24, the ASF control portion 201 drives the paper feeder motor 27 in the forward direction for a predetermined pulse number P4. The predetermined pulse number P4 is a sufficient pulse number for rotating the paper feeder roller 19 to the initial position by the forward planetary gear 31. Namely, by executing the step S24, the paper feeder roller 19 rotates just one turn from the initial position. Therefore, the teeth-less recessed portion 19*b* of the paper feeder roller gear 19*a* is placed in opposition to the forward planetary gear 31 to release meshing therebetween, so that the paper feeder roller 19 is stopped. Next, the processing is advanced to step S25 to reset the pulse number counter Pc to "0" and the rotation number counter n is counted up by one. Then, the process is advanced to step S26. At this time, since n=1, the process is returned to step S17 to initiate reverse driving of the paper feeder motor 27.

The ASF control portion 201 repeatedly executes steps S17 to S20, again. Then, the paper feeder roller 19 initiates rotation for the second turn to transport the sheet 200. When the tip end portion of the sheet 200 reaches the paper end sensor 108 within the printer 101, the output voltage of the paper end sensor 108 turns into "HIGH" level, so that the process is advanced from step S20 to step S21. At step S21, the ASF control portion 201 compares a value (Pc+P5) with the allowable pulse number Pmax. The value (Pc+P5) is derived by adding the number P5 of pulses for registration in the loaded drive table T to the value of the pulse number count Pc. If a relationship Pc+P5≦Pmax is established, even when the paper feeder motor 27 is further driven for revolution in the magnitude of P5 pulses in the reverse direction, transmission of the driving force will never been interrupted in the mid-way revolution of the paper feeder motor 27 in the reverse direction. Therefore, when PC+P5≦Pmax is established, the process is advanced to step S22 to drive the paper feeder motor 27 in the reverse direction.

When Pc+P5>Pmax is established, assuming that the paper feeder motor 27 is further driven in the reverse direction for the pulses of P5, the teeth-less recessed portion 19*b* of the paper feeder roller gear 19*a* is placed in opposition to the reverse planetary gear 35, so that interruption of driving force to the paper feeder roller 19 is caused. Therefore, in case of Pc+P5>Pmax, the process is advanced to step S24. At step S24, the paper feeder motor 27 is again driven for revolution in the forward direction for number of pulses of P4. Therefore, the paper feeder roller 19 is returned to the initial position. Then, at step 25, Pc is set to "0" and n is set to n+1, and thereafter, the process is advanced to step S26. Normally, while rotating for the second turn of the paper feeder roller 19, the sheet 200 is detected by the paper end sensor 108, so that the process is returned to step S17 at this timing (n=2). At this timing, the output voltage of the paper end sensor 108 has already been "HIGH" state, and the pulse number counter Pc is in a state immediately after the counter Pc is reset. Therefore, the process is advanced from step S17 to S18, S19, S20 and S21. At this time, since Pc+P5≦Pmax is satisfied, the process is advanced to step S22.

Step S22 is the step for establishing registration. The ASF control portion 201 drives the paper feeder motor 27 in the magnitude corresponding to the pulse number P5 in the loaded drive table T, to drive the paper feeder roller 19 for rotation. At this time, the tip end of the sheet 200 is further fed within the printer 101 from the position detected by the paper end sensor 108. Therefore, the tip end of the sheet 200 stops abutting onto the nip portion defined between the resting LF roller 109 and the pinch roller 110. However, the rear portion of the sheet 200 is pushed forward by the paper feeder roller 19. Therefore, the tip end of the sheet 200 is placed in parallel to the nip portion defined by the LF roller 109 and the pinch roller 110.

Next, the process is advanced to step S23. Then, the ASF control portion 201 completes operation with transmitting of a signal indicative of completion of paper feeding to the printer 101 via the serial transmission port 44 depicted in FIG. 35.

When the sheet 200 is not stacked on the pressure plate 26, the output voltage of the paper end sensor 108 will never become "HIGH" state even when the paper feeding roller 19 is driven to rotate. In this case, the ASF control portion 201 repeats a loop consisting of steps S17, S18, S19, S20 and then S17 for a certain number of times, and then repeats operation of S19, S24, S25, S26 and then S17 twice. In the third time of the later-mentioned operation of steps S19, S24, S25, S26 and then S17, the rotation number counter n=3 is established at step S26, then, the process is advanced to step S27. At step S27, operation is completed with transmitting a paper feeding error signal to the printer 101.

(Other Operation (Printer Side, ASF Side))

Figure 31:
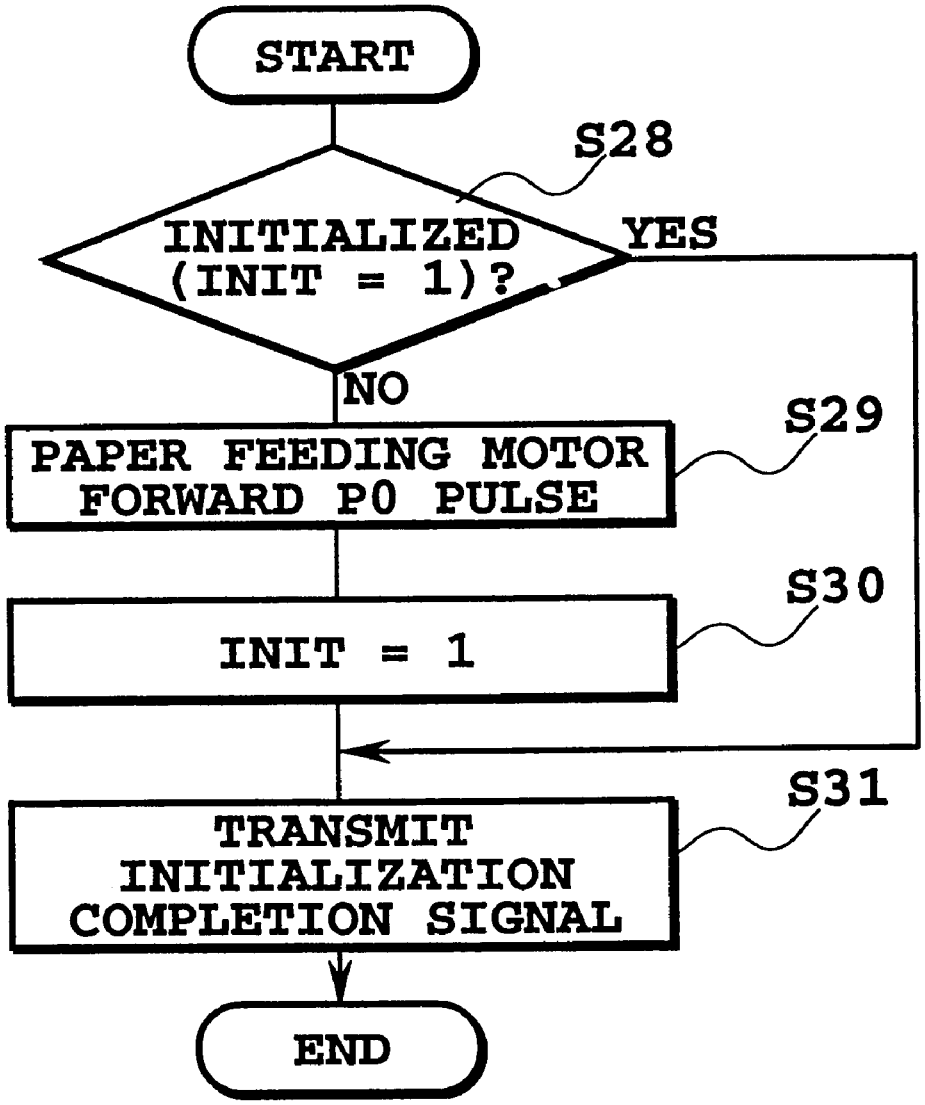
FIG. 31 is a flowchart for explaining initializing operation in the first embodiment of the automatic feeding apparatus according to the present invention.

FIG. 31 is an explanatory illustration of a sub-routine C3 controlling initializing operation of the ASF 1.

The ASF control portion 201 is responsive to the initialization command signal from the printer 101, and advances the process to step S28. At step S28, the value of the flag "INIT" is checked. The flag "INIT" is indicative of whether the phase of the paper feeder roller 19 in rotating direction is in the initial position or not. If INIT=1, it represents that the paper feeder roller 19 is already in the initial position. Therefore, in such case, the process is advanced to step S31. At step S31, an initialization completion signal is transmitted to the printer 101, and then operation is terminated. On the other hand, if INIT=0, the process is advanced to step S29 to drive the paper feeder roller motor 27 in the forward direction for a magnitude corresponding to a predetermined pulse number P0. The predetermined pulse number P0 is set to a value to sufficiently rotate the teeth-less recessed portion 19*b* of the paper feeder roller gear 19*a* in opposition to the forward planetary gear 31, namely to rotate the paper feeder roller 19 to the initial position, from any angular position of the paper feeder motor 27. Accordingly, by executing step S29, the paper feeder roller 19 is rotated to return to the initial position. Then, the pressure plate 26 and the paper feeding rubber 23 are placed away from each other to permit smooth setting of the sheet 200. Subsequently, the process is advanced to step S30 to set the flag INIT=1 for indicating that the paper feeder roller 19 is in the initial position. Thereafter, at step S31, the initialization completion signal is transmitted to the printer 101 and then the operation is terminated.

Figure 32:
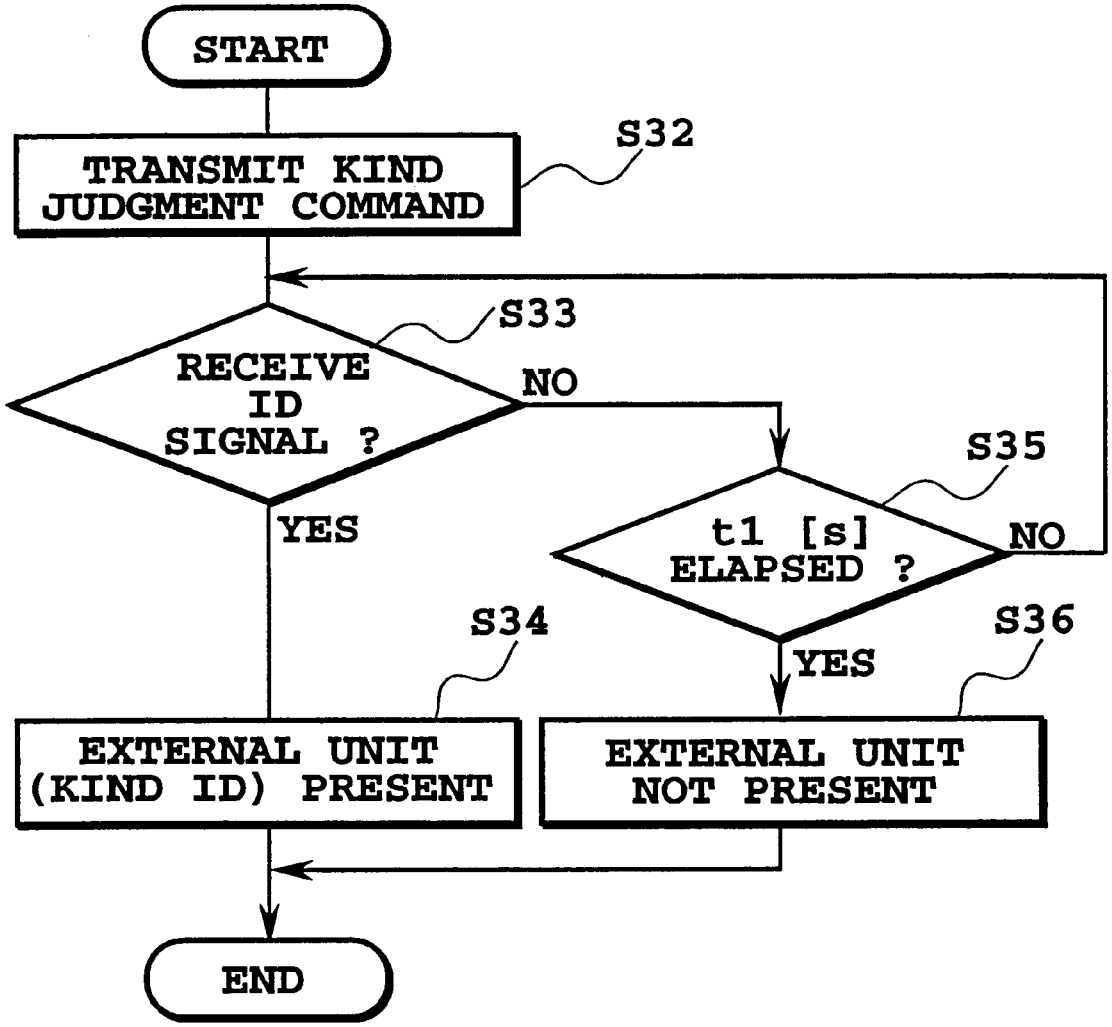
FIG. 32 is a flowchart for explaining a machine kind judgment operation in the first embodiment of the printing apparatus according to the present invention.

FIG. 32 is an explanatory illustration of the sub-routine C1 for performing judgment of the kind to be installed on the outside of the printer 101 via the ports 117*f* and 117*g* shown in FIG. 35.

The main body control portion 202 transmits the kind judgment command signal to the external unit through the port 177*g*, at first at step S32. Then, the process is advanced to step S33. If the response signal from the external unit is not received through the port 117*f*, the process is advanced to step S35. Then, if a time limit t1 is not expired, the process is returned to step S33. If the time limit t1 is expired as checked at step S35, the process is advanced to step S36 to terminate operation under judgment that the external unit is not installed. On the other hand, at step S33, when the response signal from the external unit 1 is received, the process is advanced to step S34. At step S34, the main body control portion 202 terminates operation after reading a code ID from the received response signal. The code ID is indicative of the kind of the installed unit.

(Other Embodiment)

Figure 33:
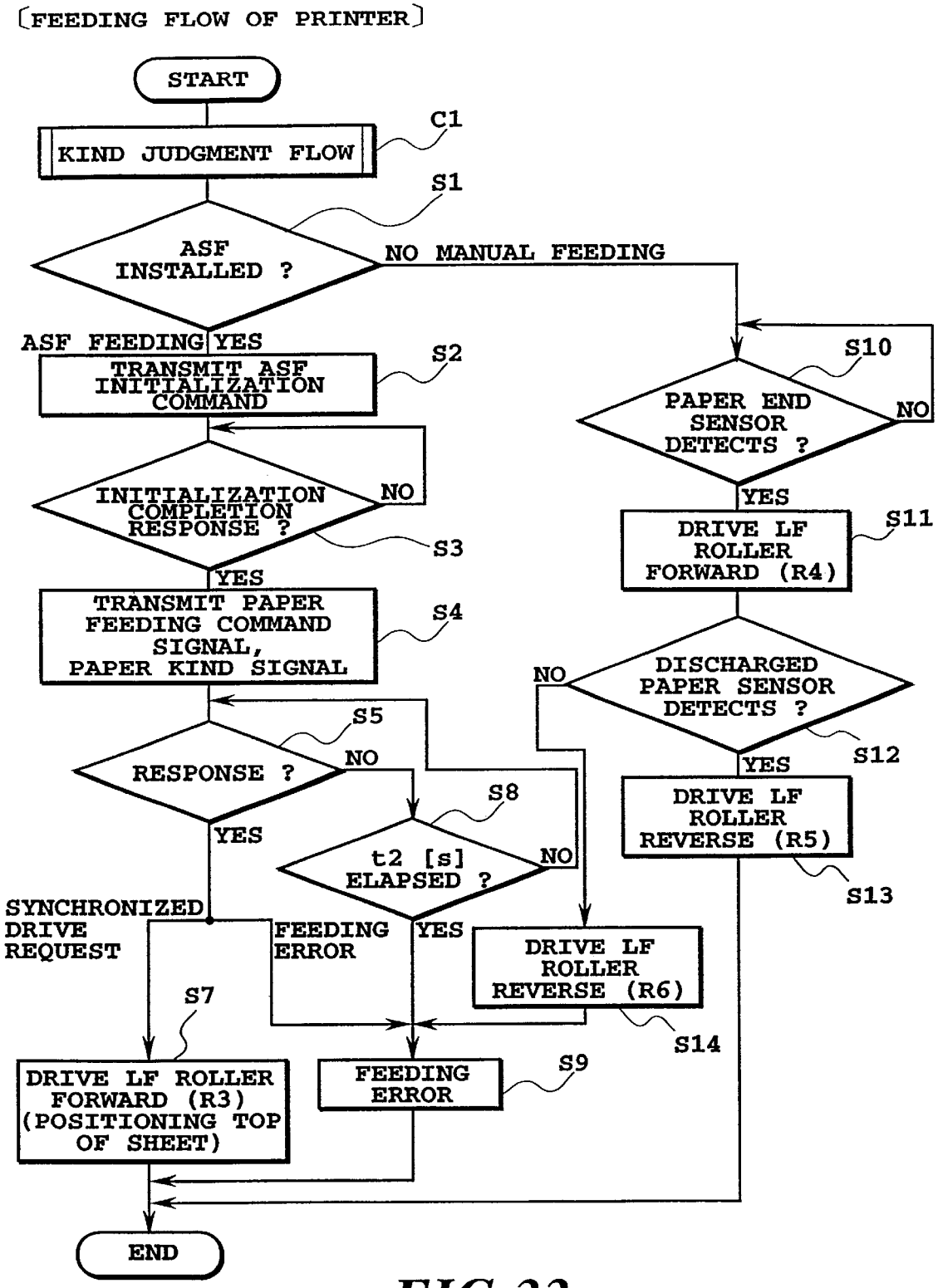
FIG. 33 is a flowchart for explaining feeding operation in the second embodiment of the printing apparatus according to the present invention.
Figure 34:
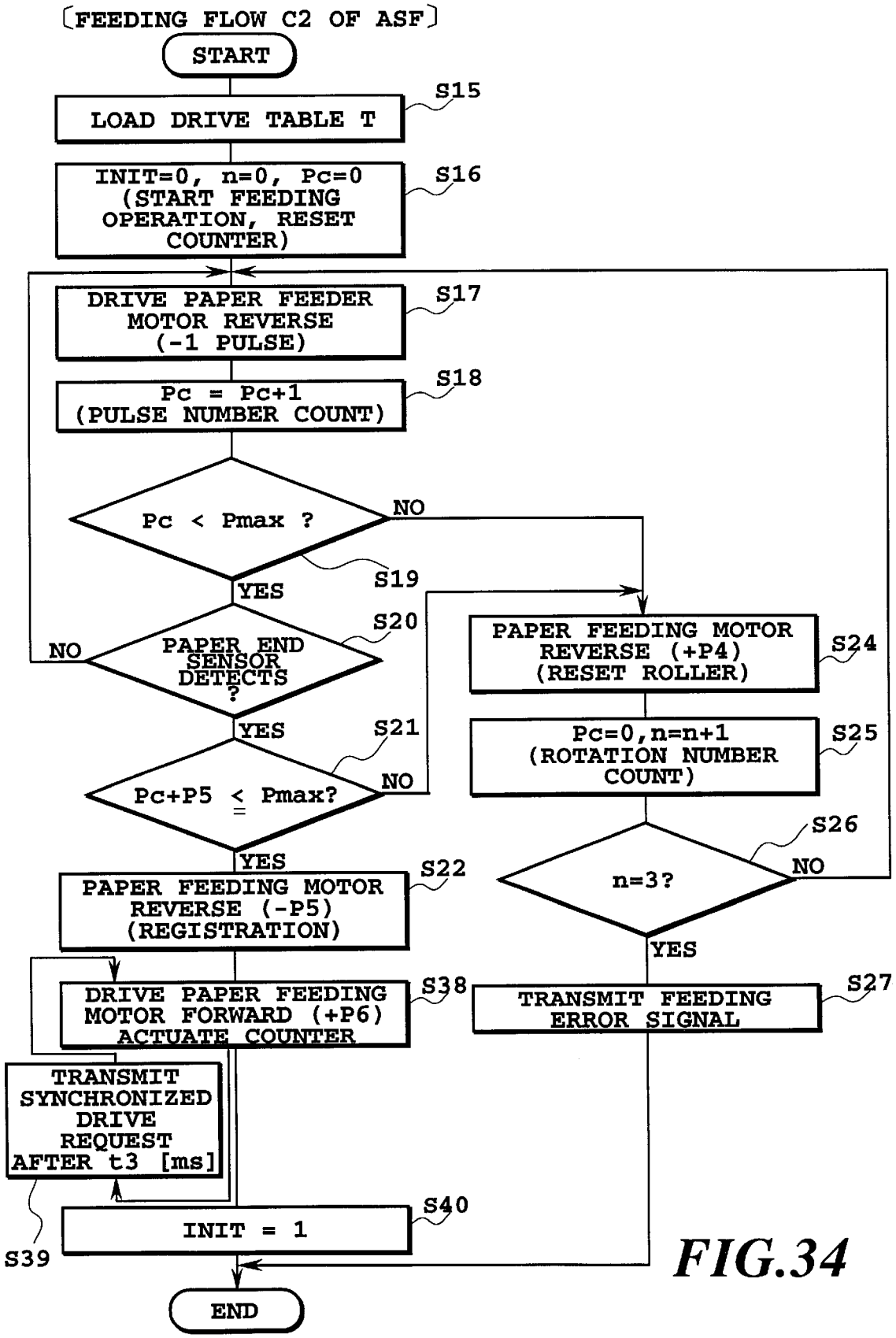
FIG. 34 is a flowchart for explaining feeding operation in the second embodiment of the automatic feeding apparatus according to the present invention.

FIGS. 33 and 34 are explanatory illustrations of the second embodiment, namely flowcharts of control programs in the printer 101 and the external ASF 1 which can be detachably installed in the printer 101. It should be noted that like steps performing the same function as in the first embodiment will be identified by like reference numerals without detailed description. In the first embodiment set forth above, after driving the paper feeder motor 27 in a magnitude corresponding to P5 pulse by the ASF control portion 201 at step S22 as shown in FIG. 30, the paper feeding completion signal is transmitted to the printer 101 at step S23. However, in this case, since the paper feeder roller 19 is not returned to the initial position, the paper feeder roller 19 may be placed in pressure contact with the sheet 200. If positioning operation for positioning top of the sheet or printing operation on the side of the printer main body is performed only with the LF roller 109, a back tension due to the paper feeder roller 19 is caused to degrade precision in transportation of the sheet 200.

The second embodiment is intended to resolve such problem.

Namely, as shown in FIG. 34, the ASF control portion 201 advances the process step to step S38 after performing registration operation at step S22. The paper feeder motor 27 is driven for revolution in the forward direction in a magnitude corresponding to the predetermined pulse number P6. The pulse number P6 is the pulse number for rotating the paper feeder roller 19 up to the initial position. On the other hand, at the same time of forward driving initiation of the paper feeder motor 27, a counter for measuring the elapsed time from forward driving initiation of the paper feeder motor 27 is actuated. When the elapsed time reaches a predetermined time t3, the process is advanced to step S39 to transmit a synchronous driving request signal to the printer 101. The predetermined time t3 is set at a period to be slightly longer than a period from initiation of revolution of the paper feeder motor 27 to starting rotation of the paper feeder roller 19 by meshing the forward planetary gear 31 with the paper feeder roller gear 19*a*. Furthermore, a speed for driving the paper feeder motor 27 at step S36 is set, so that the peripheral speed of the paper feeding rubber 23 mounted on the paper feeder roller 19 is slightly higher than a peripheral speed thereof when the LF roller 109 of the printer 101 is rotated at step S7.

At a timing where the process at step S38 is completed, the paper feeder roller 19 rotates to the same phase as the initial position. Then, the process is advanced to step S40. At step S40, the ASF control portion 201 terminates operation, after indicating the phase of the paper feeder roller 19 in the rotating direction is in the initial condition with setting of the INIT flag at "1". On the other hand, when the main body control portion 202 of the printer receives the synchronized driving request signal transmitted by the ASF control portion 201 at step S39, the main body control portion 202 advances the process from step S5 of FIG. 33 to step S7 to start rotation of the LF roller 109.

Figure 36:
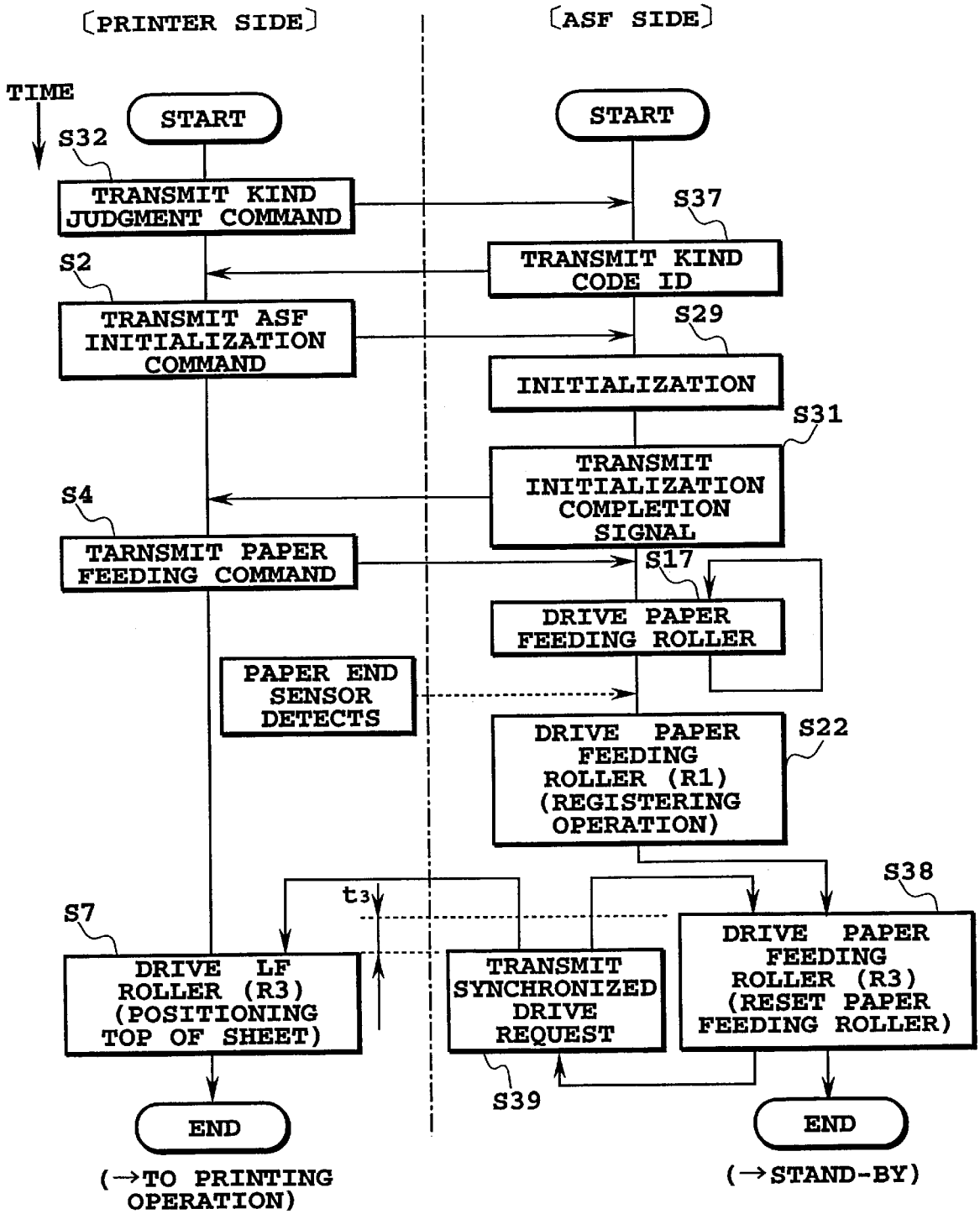
FIG. 36 is a flowchart for briefly explaining a communicating relationship between the printing apparatus and the automatic feeding apparatus in the second embodiment of the present invention.
Figure 37:
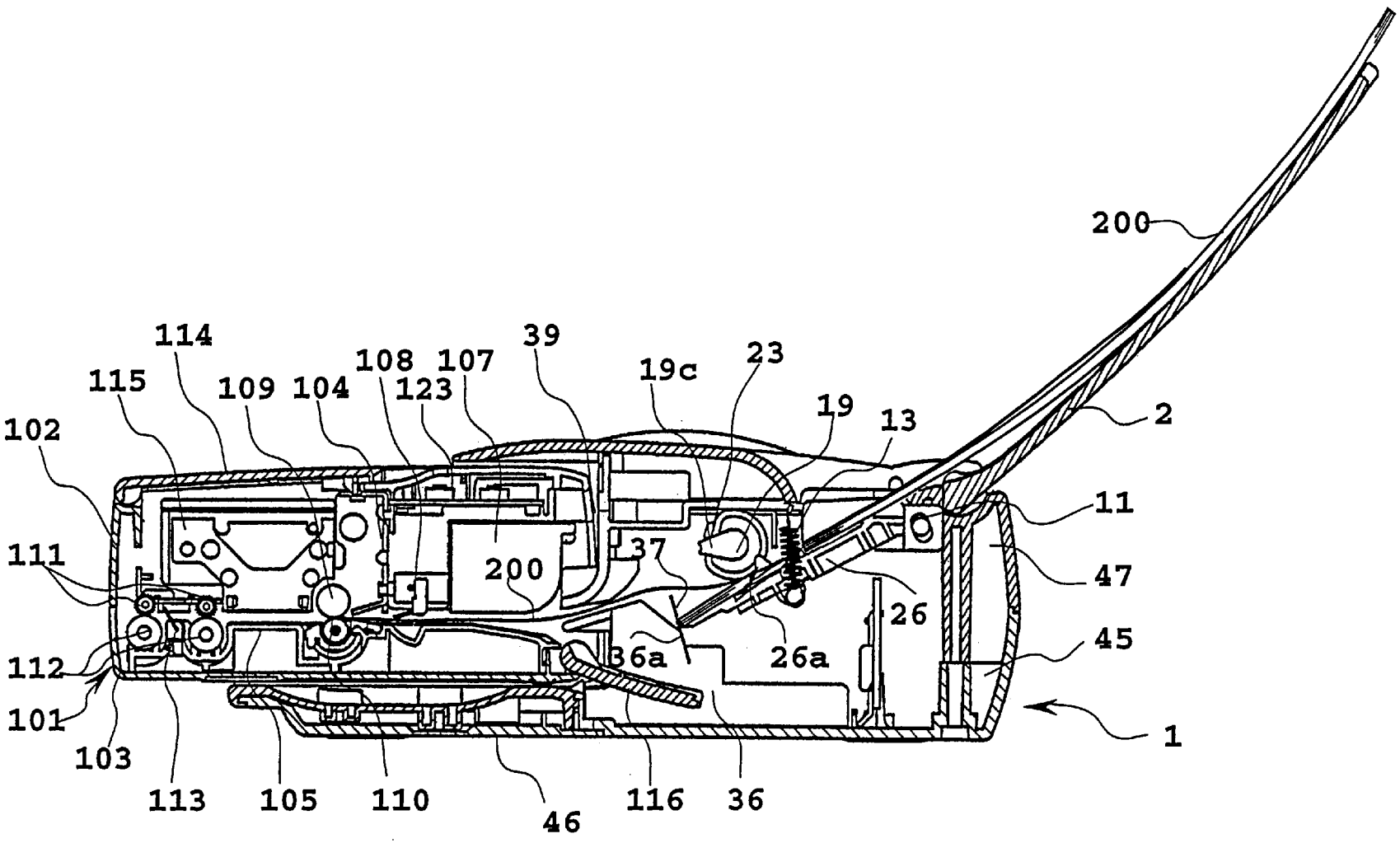
FIG. 37 is a section for explaining operation of the second embodiment of the printing apparatus and the automatic feeding apparatus according to the present invention.

FIG. 36 is a flowchart summarizing associated operation of the printer 101 and the ASF 1 in the shown embodiment.

Upon initiation of paper feeding operation by the printer 101, at first, the kind judgment command signal is transmitted to ASF 1 side (S32). The ASF 1 transmits a signal ID indicative of the kind code to the printer 101 side (S37). Next, the printer 101 transmits the initialization command signal of the ASF 1 to the ASF 1 side (S2). The ASF 1 performs initialization operation by rotating the paper feeder roller 19 if not in the initial state (S29), and transmits the initialization completion signal to the printer 101 side (S31). Next, the printer 101 transmits the paper feeding command signal to the ASF 1 side (S4). The ASF 1 loads the optimal drive table T on the basis of the paper kind information transmitted together with the paper feeding command signal (S15, not shown in FIG. 36), and thereafter drives the paper feeder motor 27 on the basis of the paper feeding operation control flow C2. By this, the paper feeder roller 19 is driven to rotate (S17). The output voltage of the paper end sensor 108 provided on the printer 101 side becomes "HIGH" state when the sensor 108 detect the sheet 200. Then, the ASF 1 drives the paper feeder roller 19 for rotational amount R1 on the basis of the pulse number P5 set forth above to perform registration (S22). After completion of registering operation, the ASF 1 drives the paper feeder roller 19 for further rotation in rotational amount R3 to be placed at the same position as the initial state (S38). In conjunction with this, at a timing where t3 is elapsed from initiation of driving of the paper feeder motor 27, the synchronized driving request signal is transmitted to the printer 101 side (S39).

The printer 101, having received the synchronized driving request signal from the ASF 1, rotates the LF roller 109 in a rotational amount R3 to perform positioning top of the sheet (S7).

As can be clear from the explanation given hereabove, in the shown embodiment, in the condition where step S22 is completed as shown in FIG. 36, the paper feeder roller 19 starts rotation. With slight delay, the LF roller 109 starts rotation. At this time, the peripheral speed of the paper feeding rubber 23 is slightly higher than the peripheral speed of the LF roller 109. Accordingly, when the LF roller 107 starts rotation for positioning top of the sheet at step S7, since the paper feeding rubber 23 in pressure contact with the sheet 200 has started rotation at slightly earlier timing, back tension will never be caused. Furthermore, since the peripheral speed of the paper feeding rubber 23 is slightly higher than the peripheral speed of the LF roller 109, back tension due to peripheral speed difference will not be caused. Therefore, precision in transportation for positioning top of the sheet 200 is stabilized.

If t3 is too small, before transmission of the driving force of the paper feeder motor 27 to the paper feeder roller 19, the LF roller 109 may start rotation. On the other hand, if t3 is excessive, rotation magnitude of the paper feeder roller 19 in advance of initiation of rotation of the LF roller 109 becomes excessive. Therefore, deformation of the sheet 200 is caused. Further, the tip end of the sheet 200 becomes in a non-parallel position to the nip defined between the LF roller 109 and the pinch roller 110. In the shown embodiment, the optimal value of t3 is about 10 ms to 100 ms.

On the other hand, when the peripheral speed of the paper feeding rubber 23 set on the paper feeder roller 19 is not so high in comparison with the peripheral speed of the LF roller 109, if slip is caused in the paper feeding rubber 23 due to kind of the sheet 200 or peripheral environment, back tension can be caused. Conversely, if the peripheral speed of the paper feeding rubber 23 is excessively high, deformation of the sheet 200 can be caused. In optimal condition, the peripheral speed of the paper feeding rubber 23 at step S38 of the shown embodiment is higher than the peripheral speed of the LF roller 109 at step S7 to the extent of about 5% to 50%.

On the other hand, in the shown embodiment, as a name of the signal corresponding to "paper feeding completion signal" in the first embodiment, explanation has been given under the name of "synchronized driving request signal" for difference of meaning of the operation. In practice, a same signal may be used as "paper feeding completion signal" and "synchronized driving request signal" without causing any significant problem. Accordingly, the paper feeding operation control flow (FIGS. 28 and 33) of the printer in the first and second embodiments are essentially the same. Namely, the printer 101 in the first embodiment can be used in installing either the ASF 1 in the first embodiment or the second embodiment.

Here, content of a plurality of drive tables T in the second embodiment will be explained with reference to FIG. 38.

For example, when the paper kind information, which the ASF 1 receives, indicates the plain paper, the ASF control portion 201 selects the drive table T1. In the plain paper, since a resistance force of registering operation at step S22 of FIG. 34, is small, the driving speed is set at medium speed. On the other hand, the plain paper is hardly transported obliquely during paper feeding. Therefore, it is unnecessary to make a large depression amount onto the LF roller 109, and a small value is set as the registering pulse number P5.

On the other hand, when the paper information, which the ASF 1 receives, indicates the envelope, the ASF control portion 201 selects the drive table T3. The envelope has large resistance as it is being fed, particularly the resistance during registering operation at step S22 is significant. Therefore, the driving speed is set at lower speed than that for the plain paper, so that step loss of the paper feeding motor 27 upon feeding the envelope is avoided. In the result, greater torque is provided. On the other hand, in comparison with other kinds of paper, the envelope has higher possibility to be oblique (cause skewing) at the mid-way of feeding. Therefore, as the pulse number P5 for registration at step S22, a medium value greater than that in the table T1 for the plain paper is set. By this, the depression amount of the tip end of the envelope onto the LF roller 109 can be increased, so that the tip end of the envelope is more certainly placed on the predetermined portion.

When the paper kind information indicates a glossy paper, the ASF control portion 201 selects the drive table T4. The glossy paper has large resistance during registering operation but will not cause significant skewing. Therefore, in table T4, the driving speed upon registration is set at low speed, and the pulse number P5 for registration is set at small value equivalent to the plain paper.

On the other hand, if the paper information indicates postcard, the ASF control portion 201 selects the drive table T2. The postcard does not have large resistance during registering operation. Therefore, the driving speed upon registration is set at medium speed equivalent to the plain paper.

On the other hand, in FIG. 36, in case the LF roller 109 on the printer 101 side and the paper feeder roller 19 on the ASF 1 side are rotated simultaneously, when the sheet is difficult to deform due to high rigidity, such as a postcard, the following problem can be caused. Namely, the paper feeder roller 19 having high peripheral speed can push the postcard against friction force of the LF roller 109, so that the tip end of the postcard is transported greater than or equal to the rotational amount R3 of the LF roller 109. Thus, difficulty should be encountered in obtaining proper printing result. In order to avoid this, in the table T2, the pulse number P5 for registration at step S22 is set at a value as great as possible. Particularly, P5=Pmax−Pc is set. The pulse number P5 is set as a parameter determined by reverse driving pulse number of the paper feeder motor 27 required until the paper end sensor 108 detects the sheet 200. By this, whenever the paper end sensor 108 detects the sheet 200, at the execution termination timing of step S22 of FIG. 34, the total of the pulse number of reverse driving of the paper feeder motor 27 becomes Pmax. Namely, the teeth-less recessed portion 19*b* of the paper feeder roller gear 19*a* is certainly driven to rotate to the position in opposition with the reverse planetary gear 35 for disengagement. Therefore, the phase in the rotational direction of the paper feeder roller 19 after completion of step S22 becomes a position significantly advanced from the initial position. Thus, even if the paper feeder roller 19 is rotated at step S40, the phase of the paper feeder roller 19 can be quickly returned to the initial position. Accordingly, the postcard stacked on the pressure plate 26 and the paper feeding rubber 23 are swiftly moved away from each other, immediately after the LF roller 109 and the paper feeder roller 19 initiate synchronous driving. Thus, paper feeder roller 19 may not push the postcard against the friction force of the LF roller 109.

On the other hand, when the paper kind information, which the ASF 1 receives from the printer 101, indicates the paper kind does not correspond to the ASF 1 or the paper kind is not designated, the ASF control portion 201 selects the drive table T5. In the shown embodiment, in the drive table T5, the same values as that of the drive table T2 are stored. However, in some condition to be expected, values same as other paper kind tables or values not matching with the values of the tables of other paper kind can be stored in the table T5.

The printer 101 as the printing apparatus may employ various printing systems, such as an ink-jet type ejecting an ink or a thermal transfer type. In case of the ink-jet type, as an energy for ejecting the ink, an electrothermal transducer generating a thermal energy for causing film boiling in the ink is provided. On the other hand, the printer 101 may be a serial type reciprocally moving the printing head 115 in a direction perpendicularly to the transporting direction of the sheet 200 as the printing medium, or a full line type having the printing head in the length corresponding to the maximum width of the sheet 200. In case of the serial type, the printing head 115 may be detachably mounted on a carriage which is reciprocally movable in a direction intersecting with the transporting direction of the sheet.

On the other hand, the present invention is applicable for the printing apparatus, in which the printer 101 and the ASF 1 are mounted integrally. In this case, the feeding method of the sheet 200 for the printer 101 can be selectively switched between automatic paper feeding or manual paper feeding. Furthermore, similarly to the case explained above, upon manual paper feeding, the sensor located downstream in the paper feeding direction of the printing head is used for making judgment whether paper feeding is successful or not. Upon automatic paper feeding, the judgment whether the paper feeding is successful or not using the sensor 113 is not performed.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A feeding apparatus which is connected to a printing apparatus for printing an image on a printing medium, said feeding apparatus for feeding the printing medium to said printing apparatus, said feeding apparatus having a stacking member for stacking a plurality of printing mediums to be fed to said printing apparatus one by one, comprising:

a communication port for communicating with said printing apparatus; and control means for executing a process for feeding the printing medium upon receipt of a command signal indicative of feeding the printing medium from said printing apparatus through said communication port and transmitting a response signal upon completion of the process to said printing apparatus through said communication port indicative of completion of the process, wherein the process for feeding the printing medium includes a process for feeding the printing mediums stacked on the stacking member to said printing apparatus, and when the printing medium is fed to a predetermined position of said printing apparatus, a signal which indicates that the feeding process was carried out is transmitted to said printing apparatus.

2. A feeding apparatus as claimed in claim 1, further comprising a feeding roller for feeding the printing medium to said printing apparatus and a motor for driving said feeding roller, said control means performs a driving control of said motor on a basis of the command signal received from said printing apparatus and transmits a result of driving control of said motor to said printing apparatus as the response signal.

3. A feeding apparatus as claimed in claim 2, wherein said control means controls said motor to drive said feeding roller for rotation to feed the printing medium to said printing apparatus on the basis of the command signal received from said printing apparatus and transmits the response signal indicative of completion of feeding of the printing medium to said printing apparatus upon completion of feeding of the printing medium.

4. A feeding apparatus as claimed in claim 3, wherein said control means detects completion of feeding of the printing medium to said printing apparatus by reading, through said communication port, a result of detection by a feeding detection sensor provided in said printing apparatus, said feeding detection sensor detecting that the printing medium is fed from said feeding apparatus.

5. A feeding apparatus as claimed in claim 2, wherein said control means performs initialization by rotating said feeding roller to a predetermined position by said motor on a basis of an initialization command signal received from said printing apparatus, and transmits the response signal indicative of completion of initialization to said printing apparatus upon completion of initialization.

6. A feeding apparatus as claimed in claim 2, further comprising a plurality of control tables for establishing control modes for said motor, said control means selects one of said plurality of control tables corresponding to a kind of the printing medium on the basis of the command signal, indicative of the kind of the printing medium, received from said printing apparatus.

7. A feeding apparatus as claimed in claim 1, wherein said control means transmits an identification code indicative of a kind of said feeding apparatus as the response signal on the basis of the command signal received from said printing apparatus.

8. A feeding apparatus as claimed in claim 1, wherein power for controlling and driving said feeding apparatus is supplied from said printing apparatus via a port which can establish electrical connection with said printing apparatus.

9. A feeding apparatus as claimed in claim 1, wherein said communication port permits bidirectional communication with said printing apparatus connected to said feeding apparatus.

10. A printing apparatus connected to a feeding apparatus for printing an image on a printing medium, said feeding apparatus having a stacking member for stacking a plurality of printing mediums to be fed to said printing apparatus one by one, comprising:

a communication port for communicating with said feeding apparatus; and control means for transmitting a command signal to said feeding apparatus through said communication port to execute a process for feeding the printing medium, for receiving a response signal responsive to the command signal from said feeding apparatus through said communication port, and for performing control of printing depending upon reception of the response signal, wherein the process for feeding the printing medium includes a process for feeding the printing mediums stacked on said stacking member to said printing apparatus.

11. A printing apparatus as claimed in claim 10, further comprising a transporting roller for transporting the printing medium fed from said feeding apparatus, said control means controls said transporting roller on a basis of the response signal from said feeding apparatus.

12. A printing apparatus as claimed in claim 10, wherein power for controlling and driving said feeding apparatus is supplied from said printing apparatus via a port which can establish electrical connection between said printing apparatus and said feeding apparatus.

13. A printing apparatus as claimed in claim 10, wherein said communication port permits bidirectional communication with said feeding apparatus connected to said printing apparatus.

14. A feeding control method for feeding a printing medium from a feeding apparatus connected to a printing apparatus, and controlling printing of an image on the printing medium by a printing head of said printing apparatus, the feeding apparatus having a stacking member for stacking a plurality of printing mediums to be fed to said printing apparatus one by one, comprising:

a step of transmitting a command signal to said feeding apparatus through a communication port for communicating with said feeding apparatus;

a step of executing a process for feeding the printing medium upon receipt of the command signal indicative of feeding the printing medium from said printing apparatus through said communication port and transmitting a response signal indicative of completion of the process to said printing apparatus upon completion of the process through said communication port; and a step of performing a control of printing depending upon reception of the response signal from said feeding apparatus through said communication port, wherein the process for feeding the printing medium includes a process for feeding the printing mediums stacked on said stacking member to said printing apparatus, and when the printing medium is fed to a predetermined position of said printing apparatus, a signal which indicates that the feeding process was carried out is transmitted to said printing apparatus.

15. A feeding control method as claimed in claim 14, wherein said feeding apparatus executes the process depending upon the command signal received from said printing apparatus.

16. A feeding control method as claimed in claim 14, wherein the response signal dependent upon the result of the process is transmitted from said feeding apparatus to said printing apparatus.

17. A feeding control method as claimed in claim 14, wherein the control dependent upon said response signal received from said feeding apparatus is a control for controlling an action concerning printing by said printing apparatus.

18. A feeding apparatus which is connected to a printing apparatus having a transporting roller for transporting a printing medium in a predetermined transporting direction and for printing an image on the printing medium, said feeding apparatus for feeding the printing medium to said printing apparatus and having a stacking member for stacking a plurality of printing mediums to be fed to said printing apparatus one by one, comprising:

a feeding roller for feeding the printing mediums stacked on the stacking member one by one toward a transportation start position for said transporting roller; and control means for demanding said printing apparatus to perform transportation of the printing medium by said transporting roller, when a predetermined delay period from initiation of feeding the printing medium by said feeding roller in the transporting direction in which the printing medium is transported by said transporting roller has passed, after feeding the printing medium to said transportation start position for said transporting roller.

19. A feeding apparatus as claimed in claim 18, wherein said feeding roller is driven for rotation by a motor different from that for driving said transporting roller.

20. A feeding apparatus as claimed in claim 18, wherein said feeding roller is displaced away from the printing medium stacked on said stacking member, when said feeding roller is in a condition of a predetermined rotating phase.

21. A feeding apparatus as claimed in claim 18, wherein said control means sets a peripheral speed of said feeding roller to be higher than a peripheral speed of said transporting roller by a range of 5 to 50% upon transporting the printing medium by driving both of said feeding roller and said transporting roller.

22. A feeding apparatus as claimed in claim 18, further comprising a communication port communicating with said printing apparatus, and said control means transmits a demand signal to said printing apparatus through said communication port to demand transportation of the printing medium by said transporting roller.

23. A feeding apparatus as claimed in claim 18, wherein said control means counts the delay period with a timer.

24. A feeding apparatus as claimed in claim 18, wherein said control means sets the delay period within a range of 10 to 100 ms.

25. A feeding apparatus as claimed in claim 22, wherein said communication port permits bidirectional communication between said feeding apparatus and said printing apparatus.

26. A printing apparatus printing an image on a printing medium by using a printing head, the printing medium being fed to said printing apparatus by a feeding roller from a feeding apparatus having a stacking member for stacking a plurality of printing mediums to be fed to said printing apparatus one by one, comprising:

a transporting roller for transporting the printing medium in a predetermined transporting direction; and control means for controlling transporting of the printing medium by said transporting roller, when a predetermined delay period from initiation of feeding the printing medium by said feeding roller in a transporting direction in which the printing medium is transported by said transporting roller has passed, after feeding the printing medium to a transportation start position for said transporting roller.

27. A printing apparatus as claimed in claim 26, wherein said transporting roller is driven for rotation by a motor different from that for said feeding roller.

28. A printing apparatus as claimed in claim 26, wherein said control means sets a peripheral speed of said feeding roller to be higher than a peripheral speed of said transporting roller by a range of 5 to 50% upon transporting the printing medium by driving both of said feeding roller and said transporting roller.

29. A printing apparatus as claimed in claim 26, wherein said printing head is mounted on a carriage which can move reciprocally along a direction transverse to the transporting direction of the printing medium.

30. A printing apparatus as claimed in claim 26, wherein said printing head is an ink-jet head for ejecting ink.

31. A printing apparatus as claimed in claim 30, wherein said printing head comprises an electrothermal transducer generating thermal energy for ejecting the ink.

32. A printing apparatus as claimed in claim 26, wherein said control means counts the delay period with a timer.

33. A printing apparatus as claimed in claim 26, wherein said control means sets the delay period in a range of 10 to 100 ms.

34. A printing apparatus connected to a feeding apparatus for feeding a printing medium in a predetermined feeding direction with a feeding roller, from a stacking member for stacking a plurality of printing mediums to be fed one by one to said printing apparatus, said printing apparatus for printing an image on the printing medium with a printing head, comprising:

a transporting roller for transporting the printing medium fed from said feeding apparatus in a predetermined transporting direction; and control means for controlling transporting of the printing medium by said transporting roller, when a predetermined delay period from initiation of feeding the printing medium by said feeding roller in the transporting direction in which the printing medium is transported by said transporting roller has passed, after feeding the printing medium to a transportation start position for said transporting roller.

35. A printing apparatus as claimed in claim 34, wherein said transporting roller is driven for rotation by a motor different from that for said feeding roller.

36. A printing apparatus as claimed in claim 34, wherein said control means is responsive to a demand from said feeding apparatus so that said transporting roller feeds the printing medium.

37. A printing apparatus as claimed in claim 34, wherein said control means sets a peripheral speed of said feeding roller to be higher than a peripheral speed of said transporting roller by a range of 5 to 50% upon transporting the printing medium by driving both of said feeding roller and said transporting roller.

38. A printing apparatus as claimed in claim 34, further comprising a communication port communicating with said feeding apparatus, said control means receives a demand signal from said feeding apparatus through said communication port to demand transportation of the printing medium by said transporting roller.

39. A printing apparatus as claimed in claim 34, wherein said printing head is mounted on a carriage which can move reciprocally along a direction transverse to the transporting direction of the printing medium.

40. A printing apparatus as claimed in claim 34, wherein said printing head is an ink-jet head for ejecting ink.

41. A printing apparatus as claimed in claim 40, wherein said printing head comprises an electrothermal transducer generating thermal energy for ejecting the ink.

42. A printing apparatus as claimed in claim 34, wherein said control means counts the delay period with a timer.

43. A printing apparatus as claimed in claim 34, wherein said control means sets the delay period in a range of 10 to 100 ms.

44. A feeding control method for transporting a printing medium, fed from a feeding apparatus having a feeding roller and a stacking member for stacking a plurality of printing mediums to be fed one by one, in a predetermined transporting direction by a transporting roller, comprising a step of:

transporting the printing medium by said transporting roller, when a predetermined delay period from initiation of feeding the printing medium by said feeding roller in the transporting direction in which the printing medium is transported by said transporting roller has passed, after feeding the printing medium to a transportation start position for said transporting roller.

* * * * *

UNITED STATES PATENT AND TRADEMARK OFFICE

CERTIFICATE OF CORRECTION

PATENT NO. : 6,471,428 B2
DATED : October 29, 2002
INVENTOR(S) : Iwasaki et al.

It is certified that error appears in the above-identified patent and that said Letters Patent is hereby corrected as shown below:

Drawings,
Sheet 35 of 37, Fig. 36 at reference numeral S4, "TARNSMIT" should read -- TRANSMIT --.

Column 5,
Line 55, "continuos" should read -- continuous --.

Column 9,
Line 28, "such" should read -- such a --.
Line 33, "with" should read -- with a --.
Line 44, "quite" should read -- quite a --.

Column 11,
Line 9, "is" should read -- is a --.

Column 13,
Line 17, "In" should read -- In the -- and "of" should read -- of a --.
Line 19, "cover" should read -- cover, --.

Column 16,
Line 58, "of" (second occurrence) should read -- of the --.

Column 17,
Line 53, "detecting" should read -- detecting an --.

Column 18,
Line 32, "on" should read -- on the --.
Line 39, "in" should read -- in a --.

Column 21,
Line 2, "in" should read -- in a --.
Line 52, "when" should read -- when an --.

Column 22,
Line 10, "popup" should read -- pop-up --.
Line 16, "to" should read -- to that -- and "This condition is" should read -- In this condition, --.
Line 17, "that" should read -- the --.

Column 23,
Line 18, "moves" should read -- move --.

UNITED STATES PATENT AND TRADEMARK OFFICE

CERTIFICATE OF CORRECTION

PATENT NO. : 6,471,428 B2
DATED : October 29, 2002
INVENTOR(S) : Iwasaki et al.

It is certified that error appears in the above-identified patent and that said Letters Patent is hereby corrected as shown below:

Column 24,
Line 11, "follow:" should read -- follows: --.

Column 26,
Line 11, "is" should read -- are --.

Column 27,
Line 35, "by" should read -- by a --.
Line 36, "by twodotted" should read -- by a two-dotted --.

Column 28,
Line 41, "subroutine" should read -- sub-routine --.

Column 30,
Line 33, "in" should read -- in an -- and "to" should read -- to the --.
Line 36, "operation," should read -- operations, --.

Column 32,
Line 41, "been" should read -- be --.

Column 35,
Line 24, "detect" should read -- detects --.

Column 37,
Line 7, "obtaining" should read -- obtaining a --.
Line 49, "perpendicularly" should read -- perpendicular --.

Signed and Sealed this

Twelfth Day of August, 2003

JAMES E. ROGAN
*Director of the United States Patent and Trademark Office*